US008194106B2

(12) United States Patent
Nomura et al.

(10) Patent No.: US 8,194,106 B2
(45) Date of Patent: Jun. 5, 2012

(54) LINE HEAD AND IMAGE FORMING APPARATUS USING THE SAME

(75) Inventors: Yujiro Nomura, Shiojiri (JP); Nozomu Inoue, Matsumoto (JP); Ryuta Koizumi, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 441 days.

(21) Appl. No.: 12/603,424

(22) Filed: Oct. 21, 2009

(65) Prior Publication Data

US 2010/0039489 A1 Feb. 18, 2010

Related U.S. Application Data

(62) Division of application No. 11/832,541, filed on Aug. 1, 2007, now abandoned.

(30) Foreign Application Priority Data

| | | |
|---|---|---|
| Aug. 4, 2006 | (JP) | 2006-213299 |
| Aug. 4, 2006 | (JP) | 2006-213301 |
| Sep. 6, 2006 | (JP) | 2006-241452 |
| Sep. 22, 2006 | (JP) | 2006-257237 |

(51) Int. Cl.
*B41J 2/44* (2006.01)
*G02B 26/10* (2006.01)

(52) U.S. Cl. ..... 347/130; 347/238

(58) Field of Classification Search ..... 347/129, 347/130, 224, 225, 238, 241, 244, 256, 258
See application file for complete search history.

(56) References Cited

U.S. PATENT DOCUMENTS

| | | | | |
|---|---|---|---|---|
| 4,435,064 | A * | 3/1984 | Tsukada et al. | 355/1 |
| 5,023,442 | A | 6/1991 | Taniguchi | 250/208.1 |
| 5,617,131 | A | 4/1997 | Murano et al. | |
| 6,323,890 | B1 * | 11/2001 | Muto et al. | 347/237 |
| 6,538,682 | B2 * | 3/2003 | Ohkubo | 347/241 |
| 6,646,663 | B2 | 11/2003 | Kamoshida et al. | |
| 7,038,706 | B1 | 5/2006 | Hiyoshi | |
| 7,161,611 | B2 * | 1/2007 | Hyuga et al. | 347/238 |
| 7,397,491 | B2 | 7/2008 | Kitazawa | |
| 7,548,251 | B2 | 6/2009 | Terumoto | |
| 7,609,285 | B2 * | 10/2009 | Miyazawa | 347/238 |
| 7,663,655 | B2 | 2/2010 | Kitazawa | |
| 7,683,922 | B2 * | 3/2010 | Nomura et al. | 347/241 |
| 7,952,600 | B2 * | 5/2011 | Kawada et al. | 347/238 |
| 2002/0101501 | A1 | 8/2002 | Miyagawa | 347/238 |
| 2002/0140918 | A1 | 10/2002 | Nakamura | |
| 2003/0007064 | A1 * | 1/2003 | Ohno et al. | 347/238 |
| 2003/0048351 | A1 | 3/2003 | Ohkubo | |
| 2005/0151828 | A1 | 7/2005 | Maeda | |
| 2005/0151829 | A1 * | 7/2005 | Hyuga et al. | 347/238 |
| 2005/0174419 | A1 | 8/2005 | Kitazawa | 347/118 |

(Continued)

FOREIGN PATENT DOCUMENTS

JP 02104243 U 8/1990

(Continued)

*Primary Examiner* — Huan Tran
(74) *Attorney, Agent, or Firm* — DLA Piper LLP (US)

(57) ABSTRACT

A line head includes multiple light emitting element groups each including multiple light emitting elements. In each light emitting element group, the multiple light emitting elements are disposed in a two-dimensional arrangement so that a distance Gx is greater than a distance Gy. The light emitting element groups are arranged so that pitches Px are greater than pitches Py.

3 Claims, 36 Drawing Sheets

U.S. PATENT DOCUMENTS

| | | | | |
|---|---|---|---|---|
| 2008/0094464 | A1* | 4/2008 | Kawada et al. | 347/234 |
| 2011/0193931 | A1* | 8/2011 | Kawada et al. | 347/238 |

FOREIGN PATENT DOCUMENTS

| | | | |
|---|---|---|---|
| JP | 07061035 | | 3/1995 |
| JP | 07186444 | A | 7/1995 |
| JP | 08104030 | A | 4/1996 |
| JP | 09-226171 | | 9/1997 |
| JP | 2000-158705 | | 6/2000 |
| JP | 2001130051 | A | 5/2001 |
| JP | 2001328292 | A | 11/2001 |
| JP | 2002019177 | A | 1/2002 |
| JP | 2002225330 | A | 8/2002 |
| JP | 2002264393 | A | 9/2002 |
| JP | 2003-332633 | | 11/2003 |
| JP | 2004042661 | A | 2/2004 |
| JP | 2006021384 | A | 1/2006 |
| JP | 2006065280 | A | 3/2006 |

* cited by examiner

LINE HEAD AND IMAGE FORMING APPARATUS USING THE SAME

CROSS REFERENCE TO RELATED APPLICATION

This application is a divisional of application Ser. No. 11/832,541, filed on Aug. 1, 2007, the entire contents of which are incorporated herein by reference. The disclosure of Japanese Patent Applications enumerated below including specification, drawings and claims is incorporated herein by reference in its entirety:

No. 2006-213299 filed Aug. 4, 2006;
No. 2006-213301 filed Aug. 4, 2006;
No. 2006-241452 filed Sep. 6, 2006; and
No. 2006-257237 filed Sep. 22, 2006.

BACKGROUND

1. Technical Field

The present invention relates to a line head which make a light beam scan a surface-to-be-scanned and an image forming apparatus which uses the same.

2. Related Art

Proposed is a line head which uses a light emitting element group (i.e., "the light emitting element array" described in JP-A-2000-158705) which is formed by an arrangement of multiple light emitting elements as that according to JP-A-2000-158705. Further, in the line head, multiple light emitting element groups are arranged and one imaging lens is disposed as it is opposed to each one of the multiple light emitting element groups. Light beams emitted from the light emitting elements of one light emitting element group is converged by the imaging lens opposed to this light emitting element group as spots on a surface-to-be-scanned.

Proposed is another line head one which uses plural organic EL (Electro Luminescence) elements as light emitting elements. It is described in JP-A-9-226171 for example. In this line head, a chip-on-board substrate seats plural organic EL elements and plural driver ICs (which correspond to the "driver circuits" of the invention) which are spaced apart from a region where the organic EL elements are provided. Bonding wires electrically connect the chip-on-board substrate with the driver ICs and the driver ICs with the organic EL elements.

SUMMARY

By the way, it is preferable in the line head described in the JP-A-2000-158705 that the light beams emitted from the light emitting elements of one light emitting element group impinge only upon the imaging lens opposed to this light emitting element group. However, in this line head, so-called crosstalk sometimes occurs since the multiple light emitting element groups are arranged side by side and one imaging lens is disposed as it is opposed to each one of the multiple light emitting element groups. In short, a light beam emitted from a certain light emitting element may impinge upon the imaging lens which is next to the imaging lens which is opposed to this light emitting element. This may result in a problem that it is not possible to create a favorable spot.

A first advantage of some aspects of the invention is to provide a technique which makes it possible to create excellent spots while suppressing crosstalk in a line head in which multiple light emitting element groups are arranged side by side and plural imaging lenses are in one-to-one-correspondence to the multiple light emitting element groups.

Where the line head described above is supposed to form two spots next to each other for instance, it is desirable that the line head forms the two spots in such a manner that the two spots are contiguous. However, a varied structure of the apparatus or the like may sometimes give rise to a defect that two spots intended to be contiguous to each other on a surface-to-be-scanned are isolated from each other, which is a failure of forming favorable spots.

A second advantage of some aspects of the invention is to provide a technique which makes it possible for a line head which is capable of imaging a light beam on a surface-to-be-scanned and forming plural spots next to each other to form favorable spots while discouraging occurrence of a defect that two spots which are supposed to be contiguous to each other fail to be contiguous and become discontiguous.

In the line head described in JP-A-9-226171, the plural organic EL elements and the driver ICs are formed separated from each other on the chip-on-board substrate and the bonding wires electrically connect them with each other. This demands large mounting areas for the organic EL elements, the driver ICs, etc. This also dramatically increases the number of the organic EL elements to be mounted on the substrate in order to meet a recently required high resolution, and hence, increases the number of the driver ICs to be mounted. The mounting space to mount the driver ICs therefore becomes small, which gives rise to a problem that it is not possible to obtain a sufficient drive current to drive the organic EL elements. Further, the increased number of the organic EL elements and the driver ICs makes it difficult to ensure an interconnection space. Due to these factors, it is increasingly difficult to satisfy the needs for size reduction of the line head and a higher resolution at the same time.

A third advantage of some aspects of the invention is to provide a high-resolution compact line head and an image forming apparatus which comprises such a line head.

For the purpose of forming spots with as much light as possible, it is preferable that in the line head described above, light beams emitted the light emitting elements impinge upon the associated imaging lenses to the maximum extent. However, the following problem may occur with the farthest light emitting element (outer-most element) from the optical axis of the associated imaging lens among the light emitting elements of the light emitting element group. That is, due to an inappropriate relationship between the outer-most element and the diameter of the imaging lens corresponding to the outer-most element, of the light beam emitted from the outer-most element, the amount of the light beam which impinges upon the imaging lens decreases. This reduces the amount of the light beam which contributes to creation of a spot which corresponds to the outer-most element and may sometimes prevent favorable spot creation.

A fourth advantage of some aspects of the invention is to provide a technique which makes it possible to form an excellent spot while suppressing a decrease of the amount of the light beam which contributes to creation of a spot which corresponds to the outer-most element in a line head which images, with its imaging lenses corresponding to multiple light emitting elements, light beams emitted from the multiple light emitting elements on a surface-to-be-scanned.

According to a first aspect of the invention, there is provided a line head, comprising: multiple light emitting element groups each including multiple light emitting elements which are arranged along a first direction; and multiple imaging lenses which are disposed in association with the light emitting element groups, wherein each light emitting element group converges a light beam emitted from each light emitting element on a surface-to-be-scanned which is transported in a second direction, in each light emitting element group, multiple light emitting element rows each formed by the light emitting elements which are lined up along the first direction are arranged along the second direction to dispose the multiple light emitting element in a two-dimensional arrangement so that a distance Gx is greater than a distance Gy, the distance Gx being a distance between the upstream-most light emitting element and the downstream-most light emitting element along the first direction, the distance being a distance Gy between the upstream-most light emitting element and the downstream-most light emitting element along the second direction, multiple group rows, in which the light emitting element groups are lined up along the first direction at pitches Px, are arranged at pitches Py along the second direction, and the pitches Px are greater than the pitches Py.

According to a second aspect of the invention, there is provided an image forming apparatus comprising: a latent image carrier; multiple light emitting element groups each including multiple light emitting elements which are arranged along a first direction; and multiple imaging lenses which are disposed in association with the light emitting element groups, wherein each light emitting element group converges a light beam emitted from each light emitting element on the latent image carrier, in each light emitting element group, multiple light emitting element rows each formed by the light emitting elements which are lined up along the first direction are arranged along the second direction to dispose the multiple light emitting element in a two-dimensional arrangement so that a distance Gx is greater than a distance Gy, the distance Gx being a distance between the upstream-most light emitting element and the downstream-most light emitting element along the first direction, the distance being a distance Gy between the upstream-most light emitting element and the downstream-most light emitting element along the second direction, multiple group rows, in which the light emitting element groups are lined up along the first direction at pitches Px, are arranged at pitches Py along the second direction, and the pitches Px are greater than the pitches Py.

According to a third aspect of the invention, there is provided a line head comprising: multiple light emitting element groups each including multiple light emitting elements; and multiple imaging lenses which are disposed in association with the light emitting element groups, wherein k light emitting elements (k is a natural number which is equal to or larger than 2) are arranged at first pitches $\Delta e$ along a first direction in each one of the light emitting element groups, and the light emitting element groups are disposed at second pitches $\Delta g$ along the first direction, each one of the multiple imaging lenses converges light beams from the light emitting elements and forms spots along the first direction on a surface-to-be-scanned which is transported in a second direction, and the absolute value h of the optical magnification of the imaging lenses, the first pitch $\Delta e$ and the second pitch $\Delta g$ are related to each other so as to satisfy the formula below: $\Delta g-(k-1)\cdot\Delta e\cdot h<\Delta e\cdot h$.

According to a fourth aspect of the invention, there is provided an image forming apparatus comprising: a latent image carrier; multiple light emitting element groups each including multiple light emitting elements; and multiple imaging lenses which are disposed in association with the light emitting element groups, wherein k light emitting elements (k is a natural number which is equal to or larger than 2) are arranged at first pitches $\Delta e$ along a first direction in each one of the light emitting element groups, and the light emitting element groups are disposed at second pitches $\Delta g$ along the first direction, each one of the multiple imaging lenses converges light beams from the light emitting elements and forms spots along the first direction on a surface-to-be-scanned which is transported in a second direction, and the absolute value h of the optical magnification of the imaging lenses, the first pitch $\Delta e$ and the second pitch $\Delta g$ are related to each other so as to satisfy the formula below: $\Delta g-(k-1)\cdot\Delta e\cdot h<\Delta e\cdot h$.

According to a fifth aspect of the invention, there is provided a line head comprising: a substrate including multiple light emitting elements; an imaging optical system converging light beams emitting from the light emitting elements on a surface-to-be-scanned to form a latent image; driver circuits which drive the light emitting elements; and interconnections connecting the driver circuits with the light emitting elements, wherein multiple light emitting element groups in which the light emitting elements are in a two-dimensional arrangement, the imaging optical system includes multiple imaging lenses which are disposed in association with the light emitting element groups and have an optical magnification exceeding 1, and the interconnections are disposed partially or in their entirety between the light emitting element groups on the substrate.

According to a sixth aspect of the invention, there is provided an image forming apparatus comprising: a latent image carrier; a substrate including multiple light emitting elements; an imaging optical system converging light beams emitting from the light emitting elements on a surface-to-be-scanned to form a latent image; driver circuits which drive the light emitting elements; and interconnections connecting the driver circuits with the light emitting elements, wherein multiple light emitting element groups in which the light emitting elements are in a two-dimensional arrangement, the imaging optical system includes multiple imaging lenses which are disposed in association with the light emitting element groups and have an optical magnification exceeding 1, and the interconnections are disposed partially or in their entirety between the light emitting element groups on the substrate.

According to a seventh aspect of the invention, there is provided a line head comprising: a transparent substrate which has first and second surfaces and can transmit light beams; multiple light emitting element groups each including multiple light emitting elements which are formed on the first surface of the transparent substrate; and multiple imaging lenses which are disposed on the second surface of the transparent substrate in association with the multiple light emitting element groups, and each of which converges the light beams emitted from the multiple light emitting elements on a surface-to-be-scanned, wherein the radius of the imaging lens is greater than a distance between the optical axis of the imaging lens and a farthest position within a light-beam passage area from the optical axis of the imaging lens, the light-beam passage area being an area within the transparent substrate which the light beam emitted from an outer-most element can move passed without getting totally reflected, the outer-most being a farthest one among the light emitting elements belonging to light emitting element group from the optical axis of the imaging lens.

According to an eighth aspect of the invention, there is provided an image forming apparatus comprising: a latent image carrier; a transparent substrate which has first and second surfaces and can transmit light beams; multiple light emitting element groups each including multiple light emitting elements which are formed on the first surface of the transparent substrate; and multiple imaging lenses which are disposed on the second surface of the transparent substrate in association with the multiple light emitting element groups, and each of which converges the light beams emitted from the multiple light emitting elements on a surface-to-be-scanned, wherein the radius of the imaging lens is greater than a distance between the optical axis of the imaging lens and a farthest position within a light-beam passage area from the optical axis of the imaging lens, the light-beam passage area being an area within the transparent substrate which the light beam emitted from an outer-most element can move passed without getting totally reflected, the outer-most being a farthest one among the light emitting elements belonging to light emitting element group from the optical axis of the imaging lens.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

First Embodiment

Figure 1:
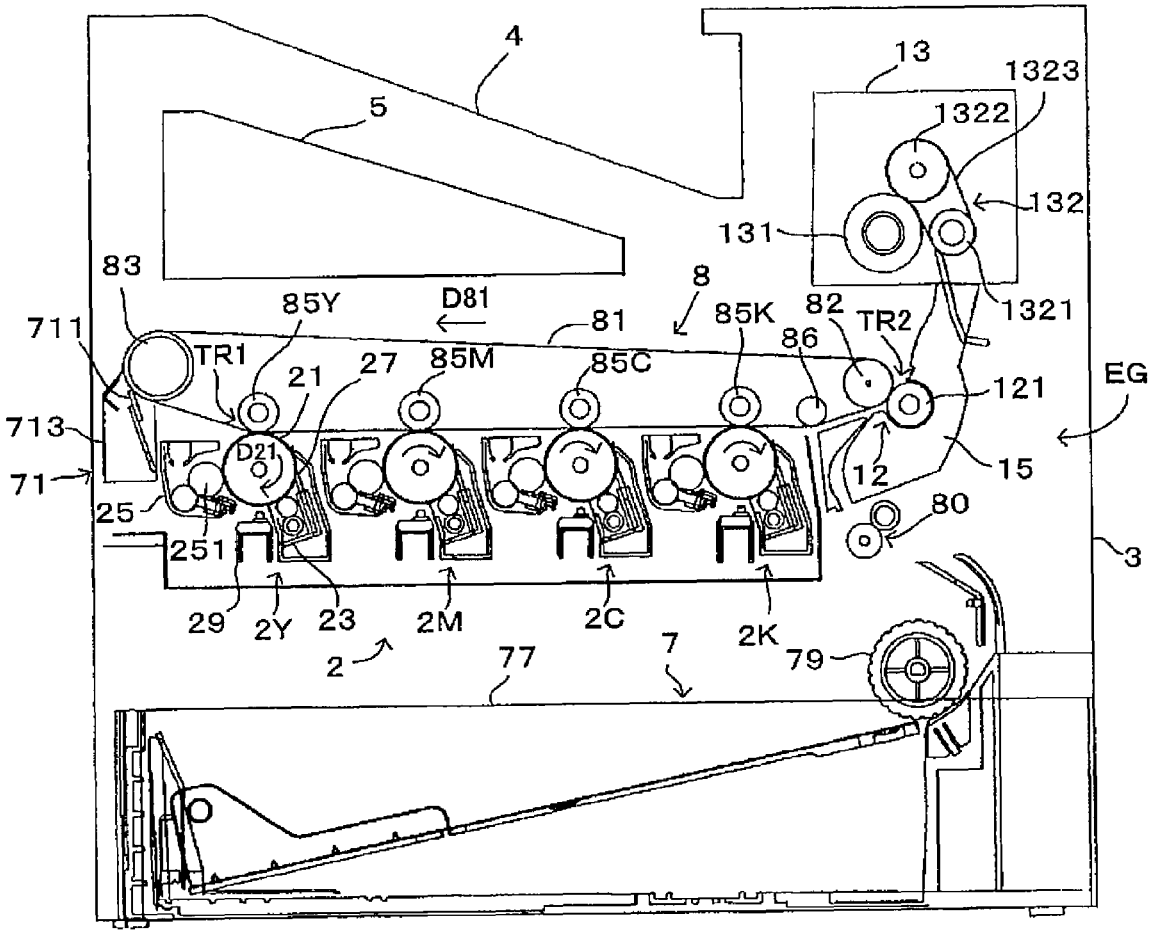
FIG. 1 is a drawing which shows an image forming apparatus according to a first embodiment of the invention.
Figure 2:
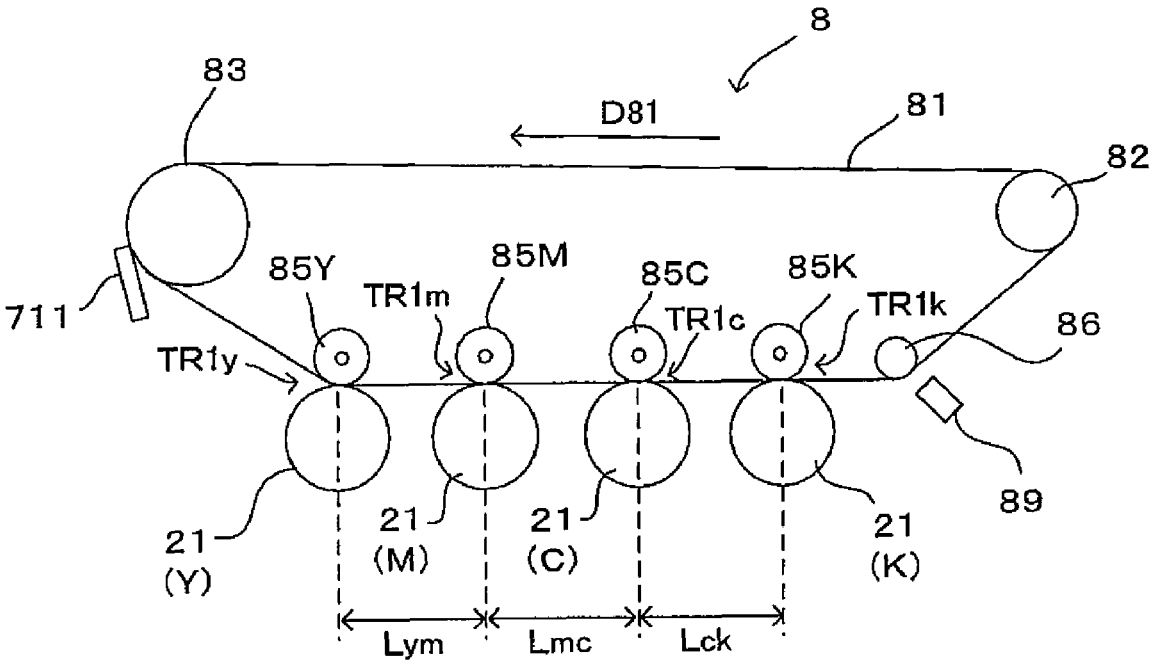
FIG. 2 is a drawing which shows an arrangement of image forming stations in the image forming apparatus of FIG. 1.
Figure 3:
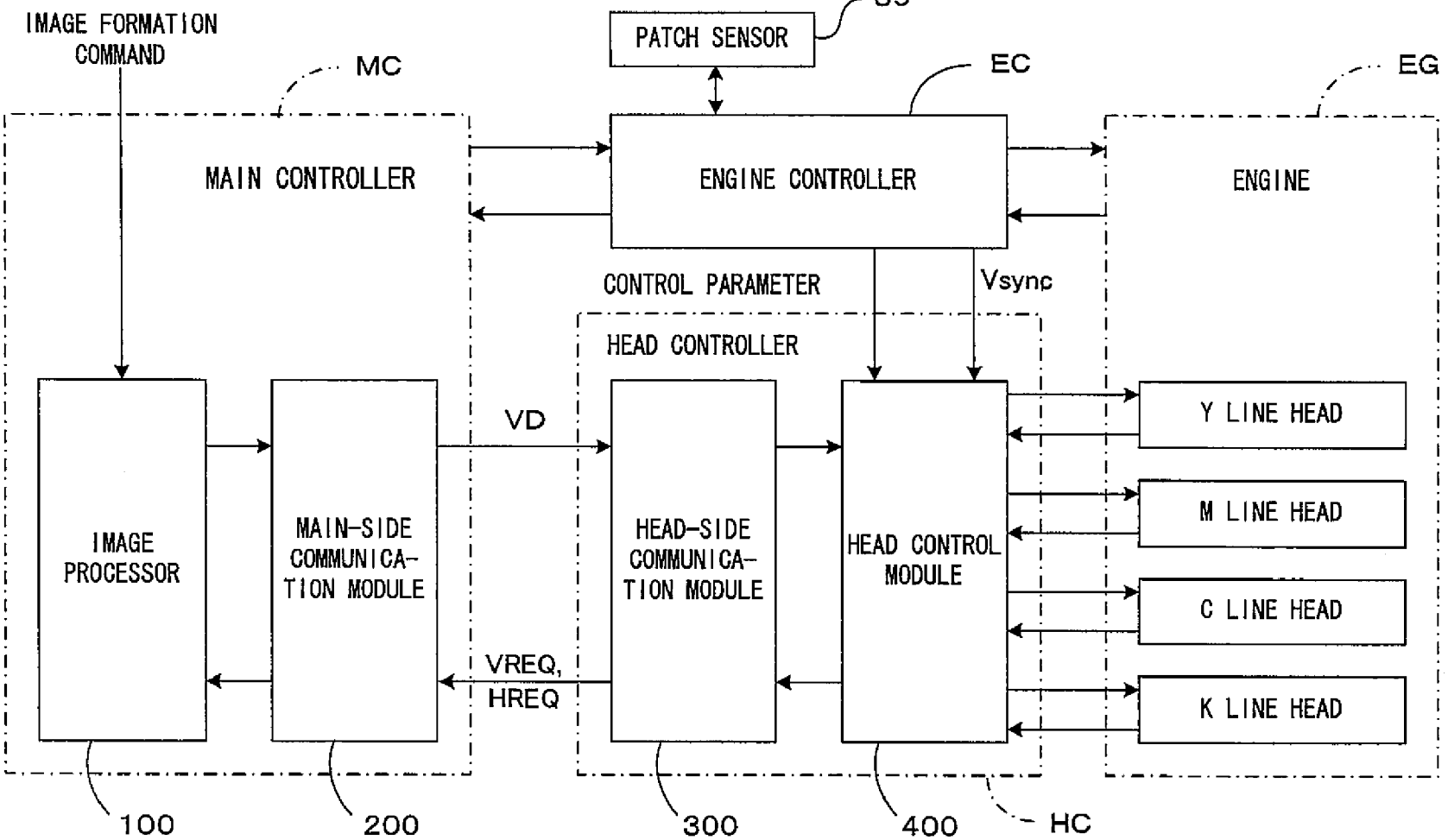
FIG. 3 is a drawing which shows the electric structure of the image forming apparatus shown in FIG. 1.

FIG. 1 is a drawing which shows an image forming apparatus according to a first embodiment of the invention. FIG. 2 is a drawing which shows an arrangement of image forming stations in the image forming apparatus of FIG. 1. FIG. 3 is a drawing which shows the electric structure of the image forming apparatus shown in FIG. 1. This apparatus is an image forming apparatus which is capable of selectively executing a color mode for superimposing toner in four colors of black (K), cyan (C), magenta (M) and yellow (Y) one atop the other and accordingly forming a color image and a monochrome mode for forming a monochrome image using toner in the black color (K) alone. In this image forming apparatus, when an external apparatus such as a host computer gives an image forming command to a main controller MC which comprises a CPU, a memory and the like, the main controller MC provides an engine controller EC with a control signal or the like. Based on the signal or the like, the engine controller EC controls a head controller HC, an engine EG or the respective portions of the apparatus to executes a predetermined image forming operation, whereby an image corresponding to the image forming command is formed on a sheet which may be a copy paper, a transfer paper, a general paper or a transparency for an overhead projector.

Disposed inside a housing body 3 of the image forming apparatus according to this embodiment is an electric parts box 5 which houses a power source circuit board, the main controller MC, the engine controller EC and the head controller HC. Also disposed inside the housing body 3 is an image forming unit 7, a transfer belt unit 8 and a paper feeder unit 11. In addition, on the right-hand side inside the housing body 3 in FIG. 1, a secondary transfer unit 12, a fixing unit 13 and a sheet guide member 15 are disposed. The paper feeder unit 11 is freely attachable to and detachable from the housing body 3. It is possible to detach the paper feeder unit 11 and the transfer belt unit 8 independently for repair or replacement.

The image forming unit 2 comprises the four image forming stations 2Y (for yellow), 2M (for magenta), 2C (for cyan) and 2K (for black) which form colors in plural mutually different colors. Since the image forming stations of the image forming unit 2 have identical structures to each other, for the simplicity of illustration, merely some image forming stations are denoted at reference symbols but other image forming stations are not denoted at reference symbols in FIG. 1.

Each one of the image forming stations 2Y, 2M, 2C and 2K is equipped with a photosensitive drum 21 on whose surface a toner image of each associated color is to be formed. Each photosensitive drum 21 is connected with a dedicated drive motor and driven into rotations at a predetermined speed along the direction of the arrow D21 shown in FIG. 1. Disposed around the photosensitive drum 21 are a charging section 23, a line head 29, a developing section 25 and a photosensitive cleaner 27 along the direction in which the photosensitive drum 21 rotates. These functional sections realize a charging operation, a latent image forming operation and a toner developing operation. Hence, toner images formed by all image forming stations 2Y, 2M, 2C and 2K are laid on a transfer belt 81 of the transfer belt unit 8 one atop the other and a color image is accordingly formed during execution of the color mode. During execution of the monochrome mode, the image forming station 2K alone operates and a monochrome image is formed.

The charging section 23 comprises a charging roller whose surface is made of elastic rubber. This charging roller is structured so as to abut on, follow and rotate together with the surface of the associated photosensitive drum 21. As the photosensitive drum 21 rotates, the charging roller follows and rotates together with the photosensitive drum 21 at the circumferential velocity in a direction which follows the photosensitive drum 21. Further, the charging roller is connected with a charging bias generator (not shown) so that when provided with a charging bias fed from the charging bias generator, it charges up the surface of the photosensitive drum 21 at a charging position where the charging section 23 abuts on the photosensitive drum 21.

The line head 29 comprises multiple light emitting elements which are lined up along the axial direction of the photosensitive drum 21 (i.e., the perpendicular direction to the plane of FIG. 1), and is spaced apart from the photosensitive drum 21. These light emitting elements emit light upon the surface of the photosensitive drum 21 charged up by the charging section 23, and a latent image is formed on this surface. In this embodiment, the head controller HC is disposed for control of the line heads 29 for the respective colors, and each line head 29 is controlled based on video data VD fed from the main controller MC and a signal fed from the engine controller EC. That is, an image processor 100 of the main controller MC receives image data contained in the image forming command according to this embodiment. The image data are subjected to various types of image treatments, and video data VD for each color are created and supplied to the head controller HC via a main-side communication module 200. In the head controller HC, the video data VD are fed to a head control module 400 via a head-side communication module 300. The engine controller EC provides the head control module 400 with the signal indicative of the parameter values related to latent image creation and the vertical synchronizing signal Vsync mentioned above. The head controller HC generates a signal for control of driving of the elements forming the line head 29 for each color based on these signals, the video data VD and the like, and outputs the signal to each line head 29. This attains proper control of operations of the light emitting elements in each line head 29, thereby forming latent images which correspond to the image forming command.

The developing section 25 comprises a developing roller 251 whose surface is to carry toner. With application of a developing bias upon the developing roller 251 from a developing bias generator (not shown) which is electrically connected with the developing roller 251, charged toner moves from the developing roller 251 to the photosensitive drum 21 and the electrostatic latent image formed by the line head 29 is visualized at a developing position where the developing roller 251 abuts on the photosensitive drum 21.

The toner image thus visualized at the developing position described above is transported in the direction of rotation D21 of the photosensitive drum 21 and primarily transferred onto the transfer belt 81 at a primary transfer position TR1 described in detail later where the transfer belt 81 and the photosensitive drum 21 abut on each other.

Further, in this embodiment, on the downstream side to the primary transfer position TR1 along the direction of rotation D21 of the photosensitive drum 21 but on the upstream side to the charging section 23, the photosensitive cleaner 27 which abuts on the surface of the photosensitive drum 21 is disposed. Abutting on the surface of the photosensitive drum 21, the photosensitive cleaner 27 removes toner remaining on the surface of the photosensitive drum 21 and accordingly cleans the surface of the photosensitive drum 21.

The transfer belt unit 8 comprises a driving roller 82, a follower roller 83 (blade-facing roller) which is disposed on the left-hand side to the driving roller 82 in FIG. 1, and the transfer belt 81 which stretches across these rollers and rotates in the direction of the arrow D81 shown in FIG. 1 (transportation direction). The transfer belt unit 8 further comprises, inside the transfer belt 81, four primary transfer rollers 85Y, 85M, 85C and 85K which are respectively opposed to the associated photosensitive drums 21 which the respective image forming stations 2Y, 2M, 2C and 2K comprise when the photosensitive cartridges are mounted. These primary transfer rollers 85 are electrically connected with a primary transfer bias generator (not shown), respectively.

As described in detail later, during execution of the color mode, as all primary transfer rollers 85Y, 85M, 85C and 85K are positioned to the image forming stations 2Y, 2M, 2C and 2K as shown in FIG. 1, the transfer belt 81 is pushed toward and made abut on the photosensitive drums 21 of the respective image forming stations 2Y, 2M, 2C and 2K and the primary transfer positions TR1 are defined between the respective photosensitive drums 21 and the transfer belt 81. As the primary transfer bias is applied upon the primary transfer rollers 85 from the primary transfer bias generator mentioned above at proper timing, toner images formed on the surfaces of the photosensitive drums 21 are transferred onto the surface of the transfer belt 81 at the associated primary transfer positions TR1, whereby a color image is formed.

In the case of an image forming apparatus of the so-called tandem type, primary transfer positions at which toner images are primarily transferred from the photosensitive drums 21 onto the transfer belt 81 are different between the image forming stations. In this embodiment, the yellow image forming station 2Y, the cyan the image forming station 2C, the magenta the image forming station 2M and the black the image forming station 2K are disposed in this order along the direction in which the transfer belt 81 moves. Hence, a yellow primary transfer position TR1*y* and a magenta primary transfer position TR1*m* are at a distance Lym from each other, the magenta primary transfer position TR1*m* and a cyan primary transfer position TR1*c* are at a distance Lmc from each other, and the cyan primary transfer position TR1*c* and a black primary transfer position TR1*k* are at a distance Lck from each other.

Meanwhile, during execution of the monochrome mode, of the four primary transfer rollers 85, only the monochrome primary transfer roller 85K abuts on the image forming station 2K and the image forming station 2K alone abuts on the transfer belt 81 while the color primary transfer rollers 85Y, 85M and 85C move away from the image forming stations 2Y, 2M and 2C to which they are respectively opposed to. This defines the primary transfer position TR1 only between the monochrome primary transfer roller 85K and the image forming station 2K. With the primary transfer bias applied upon the monochrome primary transfer roller 85K from the primary transfer bias generator mentioned above at proper timing, a toner image formed on the surface of the photosensitive drum 21 is transferred onto the surface of the transfer belt 81 at the primary transfer position TR1, whereby a monochrome image is formed.

The transfer belt unit 8 further comprises a downstream guide roller 86 which is disposed on the downstream side to the monochrome primary transfer roller 85K but on the upstream side to the driving roller 82. The downstream guide roller 86 abuts on the transfer belt 81, on a common inscribed line between the primary transfer roller 85K and the photosensitive drum 21 at the primary transfer position TR1 which is created as the monochrome primary transfer roller 85K abuts on the photosensitive drum 21 of the image forming station 2K.

A patch sensor 89 is disposed so as to be opposed to the surface of the transfer belt 81 which stretches around a downstream guide roller 86. The patch sensor 89, formed by a reflection-type photosensor for instance, optically detects a change of the reflectance at the surface of the transfer belt 81 and detects as needed the position, the density or the like of a patch image which is formed on the surface of the transfer belt 81.

The paper feeder unit 11 comprises a paper feeder part which includes a paper feeder cassette 77 which is capable of holding a stack of sheets and a pick-up roller 79 which feeds the sheets one by one from the paper feeder cassette 77. The sheet fed by the pick-up roller 79 from the paper feeder cassette 77, after adjusted as for its paper feeding timing by paired resist rollers 80, arrives at the secondary transfer position TR2 along a sheet guiding member 15. The driving roller 82 abuts on a secondary transfer roller 121 at the secondary transfer position TR2.

The secondary transfer roller 121 is disposed so that it can freely abut on and move away from the transfer belt 81, and when driven by a secondary transfer roller drive mechanism (not shown), abuts on and moves away from the transfer belt. The fixing unit 13 comprises a heat roller 131, which incorporates a heating element such as a halogen heater and can freely rotate, and a pressurizing section 132 which presses the heat roller 131. The sheet guiding member 15 guides the sheet now seating on its surface the secondarily transferred image to a nip area which is created by the heat roller 131 and a pressurizing belt 1323 of the pressurizing section 132, and the image is heat-fixed at a predetermined temperature in the nip area. The pressurizing section 132 is formed by two rollers 1321 and 1322 and the pressurizing belt 1323 stretching about these rollers. As a tense belt surface between the two rollers 1321 and 1322 within the surface of the pressurizing belt 1323 is pressed against the circumferential surface of the heat roller 131, the heat roller 131 and the pressurizing belt 1323 create a wide nip area. The sheet thus subjected to fixing is conveyed to a discharge tray 4 which is disposed in an upper portion of the main housing section 3.

The drive roller 82 drives the transfer belt 81 into cyclic rotations along the transportation direction D81 in the drawing, and serves also as a backup roller for a secondary transfer roller 121. The circumferential surface of the drive roller 82 seats a rubber layer whose thickness is about 3 mm and whose volume resistivity is 1000 kΩ·cm or less. Grounding via a metallic shaft establishes a conductive path for a secondary transfer bias which is fed via the secondary transfer roller 121 from a secondary transfer bias generator not shown. As the drive roller 82 has the rubber layer which is highly resistive and absorbs an impact, an impact developing upon entry of a sheet to an abutting area (secondary transfer position TR2) between the drive roller 82 and the secondary transfer roller 121 does not easily reach the transfer belt 81, which makes it possible to prevent an image degradation.

Further, a cleaner section 71 is disposed opposed against the blade-facing roller 83 within this apparatus. The cleaner section 71 comprises a cleaner blade 711 and a waste toner box 713. As a front edge portion of the cleaner blade 711 abuts on the blade-facing roller 83 via the transfer belt 81, foreign matters such as paper dust and toner on the transfer belt which remain residual even after secondary transfer are removed. Thus removed foreign matters are collected by the waste toner box 713. The cleaner blade 711 and the waste toner box 713 are formed integrated with the blade-facing roller 83.

In this embodiment, the photosensitive drum 21, the charging section 23, the developing section 25 and the photosensitive cleaner 27 of each one of the image forming stations 2Y, 2M, 2C and 2K are unitized as a photosensitive cartridge. Each photosensitive cartridge can be freely attached to and detached from a body of the apparatus. Furthermore, each photosensitive cartridge comprises a non-volatile memory for storage of information regarding the photosensitive cartridge. The engine controller EC and each photosensitive cartridge communicates with each other wirelessly. The information regarding each photosensitive cartridge is thus transmitted to the engine controller EC, and the information inside each memory is updated and held. Based on the information, history of use of the each cartridge and lifetime of consumables are managed.

Figure 4:
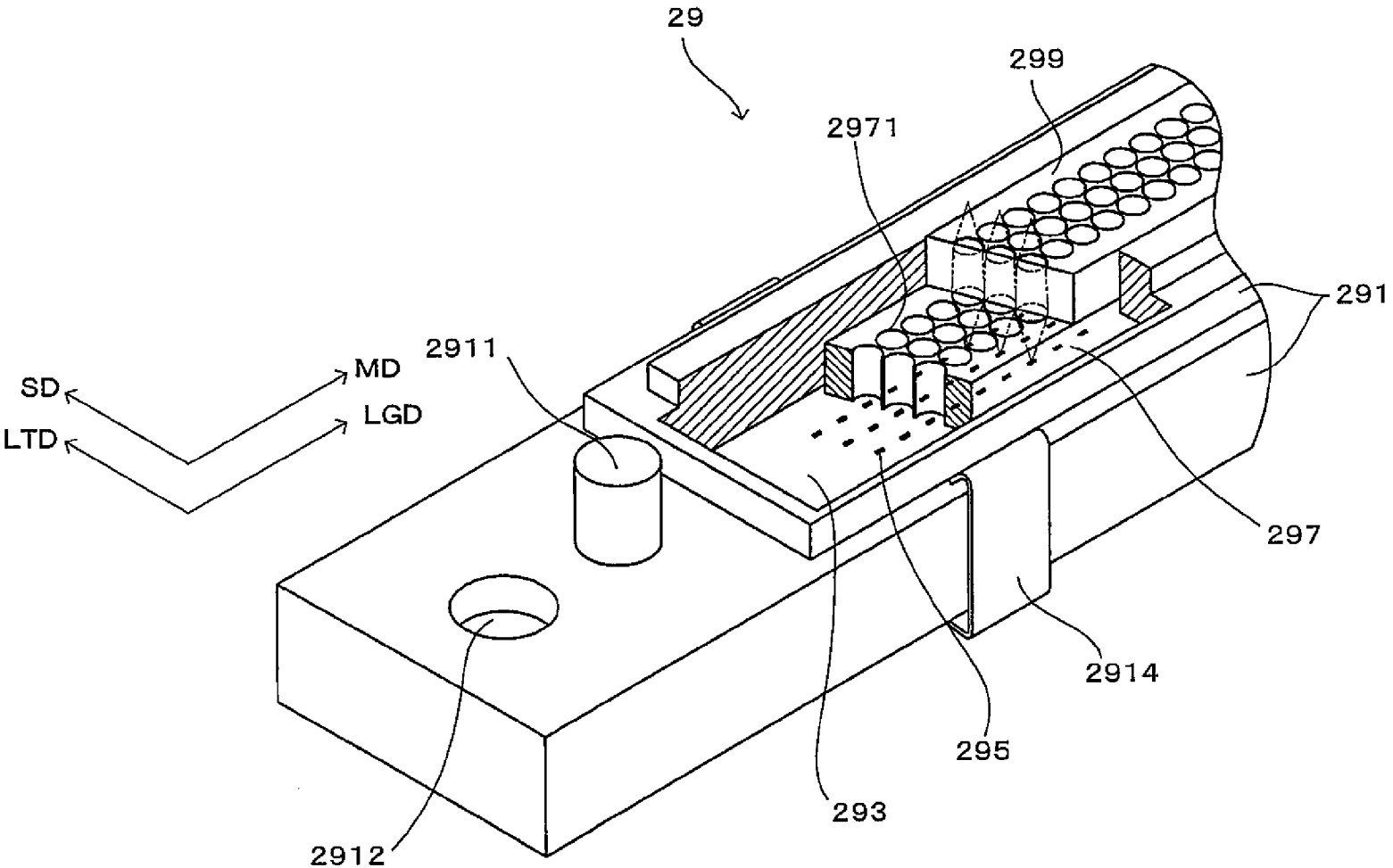
FIG. 4 is a schematic perspective view of a line head according to an embodiment of the invention.
Figure 5:
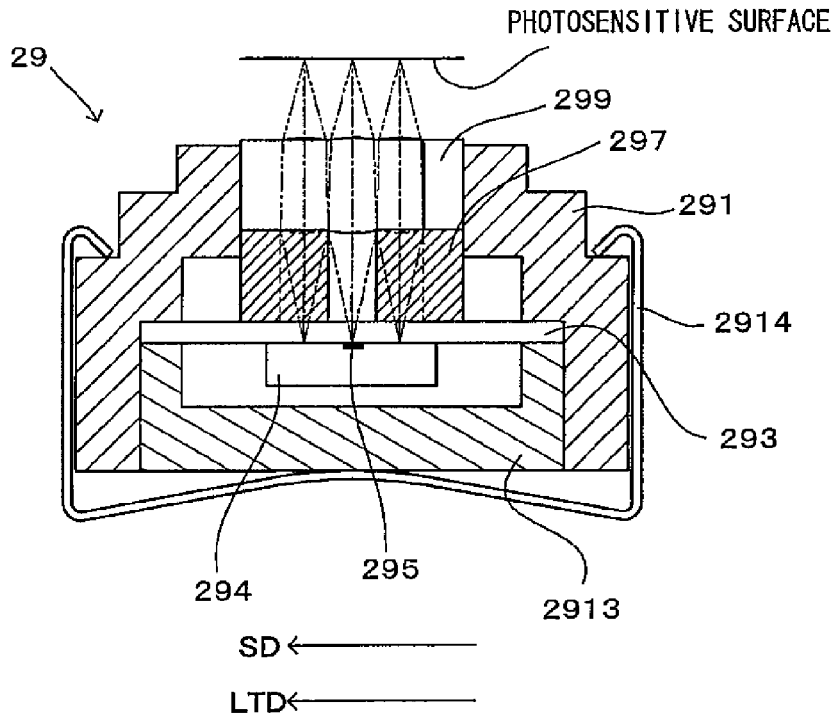
FIG. 5 is a cross sectional view of the line head according to the invention taken along a sub scanning direction.

FIG. 4 is a schematic perspective view of the line head according to an embodiment of the invention. FIG. 5 is a cross sectional view of the line head according to the invention taken along a sub scanning direction. The line head (exposure section) 29 according to the embodiment comprises a case 291 whose longitudinal direction is along a main scanning direction MD, and positioning pins 2911 and screw insertion holes 2912 are formed at the both ends of the case 291. With the positioning pins 2911 fit in positioning holes (not shown) formed in a photosensitive member cover (not shown) which covers the photosensitive drum 21 and is positioned relative to the photosensitive drum 21, the line head 29 is positioned relative to the photosensitive drum 21. As fixing screws are screwed into and fixed in screw holes (not shown) of the photosensitive member cover via the screw insertion holes 2912, the line head 29 is positioned and fixed to the photosensitive drum 21. That is, the line head 29 is positioned so that the longitudinal direction LGD of the line head 29 corresponds to the main scanning direction MD and lateral direction LTD of the line head 29 corresponds to the sub scanning direction SD.

In this specification, the structure of the line head 29 is described using the main scanning direction MD and the sub scanning direction SD. According to the circumstances, it can be described using the longitudinal direction LGD and the sub scanning direction SD.

The case 291 holds a microlens array 299 at a position opposed to the surface of the photosensitive drum 21. A light blocking member 297 and a glass substrate 293 are disposed in this order with a distance away from the microlens array 299 inside the case 291. The back surface of the glass substrate 293 (which is one of the two surfaces of the glass substrate 293 which is on the opposite side to the microlens array 299) seats plural light emitting element groups 295. In short, the plural light emitting element groups 295 are arranged in a two-dimensional arrangement on the back surface of the glass substrate 293 so that they are spaced apart from each other by predetermined pitches along the main scanning direction MD and the sub scanning direction SD. Each light emitting element group 295 is formed by a two-dimensional arrangement of multiple light emitting elements. This embodiment uses organic ELs (Electro-Luminescence) as the light emitting elements. That is, organic ELs are mounted as light emitting elements on the back surface of the glass substrate 293 according to this embodiment. Light beams emitted from the multiple light emitting elements toward the photosensitive drum 21 head for the light blocking member 297 via the glass substrate 293.

The light blocking member 297 include plural light guiding holes 2971 which correspond to the plural light emitting element groups 295 in one-to-one correspondence. The light guiding holes 2971 are bored as approximately column-shaped holes which penetrate the light blocking member 297 along central axes which are parallel to a normal line to the glass substrate 293. Hence, light beams leaving the light emitting elements belonging to one light emitting element group 295 in its entirety heads are guided to the microlens array 299 via the same light guiding hole 2971. The light beams moving passed through the light guiding holes 2971 formed in the light blocking member 297 are imaged by the microlens array 299 as spots on the surface of the photosensitive drum 21.

As shown in FIG. 5, a fixing tool 2914 presses a back lid 2913 against the case 291 via the glass substrate 293. In short, the fixing tool 2914 has elasticity which pushes the back lid 2913 toward the case 291, and as the back lid 2913 is pressed with the elasticity, the inside of the case 291 is sealed up light-tight (i.e., so that light will not leak out from within the case 291 and light will not come into the case 291 from outside). There plural such fixing tools 2914 at plural locations along the longitudinal direction of the case 291. The light emitting element groups 295 are covered with a sealing member 294.

Figure 6:
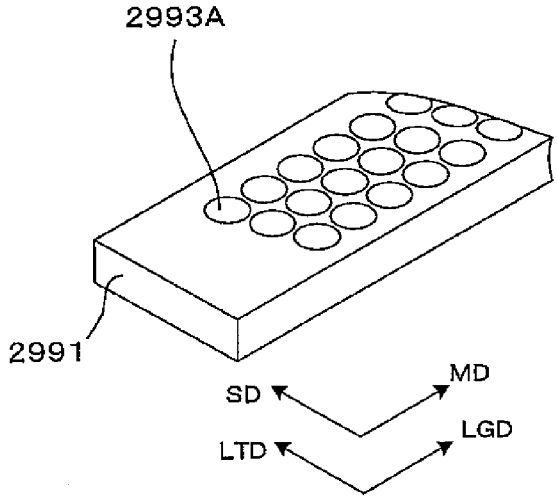
FIG. 6 is a schematic perspective view of the microlens array.
Figure 7:
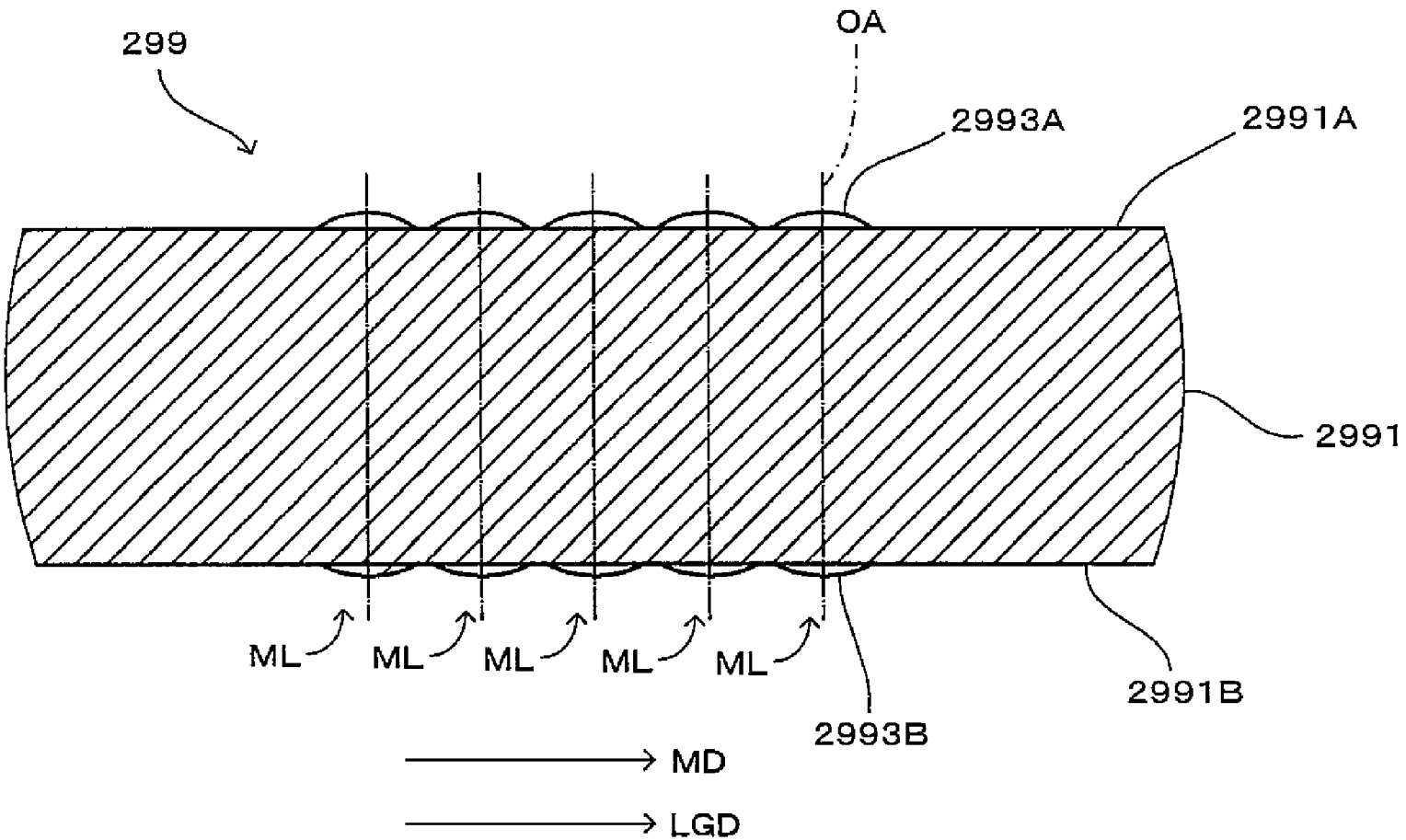
FIG. 7 is a cross sectional view of the microlens array taken along the main scanning direction.

FIG. 6 is a schematic perspective view of the microlens array. FIG. 7 is a cross sectional view of the microlens array taken along the main scanning direction. The microlens array 299 comprises a glass substrate 2991 and multiple lens pairs each formed by two lenses 2993A and 2993B which are disposed in one-to-one correspondence on the both sides of the glass substrate 2991. The lenses 2993A and 2993B may be made of resin.

That is, a front surface 2991A of the glass substrate 2991 seats the multiple lenses 2993A and a back surface 2991B of the glass substrate 2991 seats the multiple lenses 2993B in such a manner that the lenses 2993A and the lenses 2993B are in one-to-one correspondence to each other. The two lenses 2993A and 2993B which form a lens pair share the same optical axis OA. The multiple lens pairs are disposed in one-to-one correspondence to the multiple light emitting element groups 295. An optical system formed by one lens pair of lenses 2993A, 2993B and the glass substrate 2991 located between the lenses of the pair will be hereinafter referred to as a "microlens ML". The multiple lens pairs (microlenses ML) are disposed in a two-dimensional arrangement which matches with the arrangement of the light emitting element groups 295 such that they are spaced apart from each other by predetermined gaps along the main scanning direction MD and the sub scanning direction SD.

Each one of the imaging optical systems, owing to the optical function of the associated microlens ML, images at a predetermined optical magnification light beams from the light emitting elements 2951 of the corresponding light emitting element group 295 on the surface of the photosensitive drum 21. At this stage, the light beams from the light emitting elements 2951 are imaged on the surface of the photosensitive drum 21 as they are rotated 180 degrees with respect to the optical axis OA of the imaging optical system (namely, the optical axis OA of the microlens ML). That is, spots are formed as inverted images of the light emitting elements 2951 on the surface of the photosensitive drum 21. The characteristic of the imaging optical systems (or the microlenses ML) of imaging on the surface of the photosensitive drum 21 images which are inverted with respect to the optical axes OA will be hereinafter referred to as an "inversion characteristic".

Figure 8:
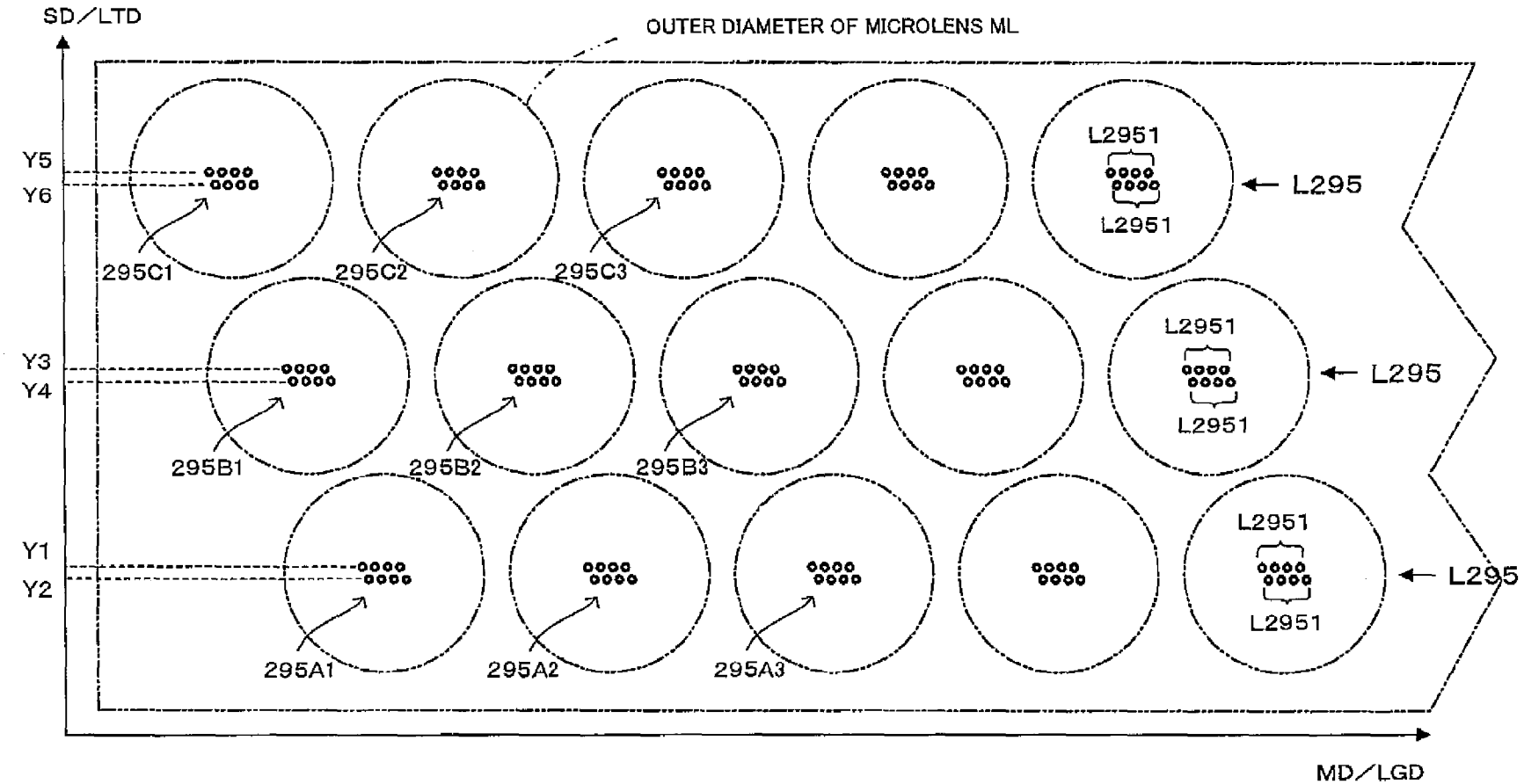
FIG. 8 is a drawing which shows the arrangement of the multiple light emitting element groups.

FIG. 8 is a drawing which shows the arrangement of the multiple light emitting element groups. This embodiment requires arranging along the lateral direction LTD corresponding to the sub scanning direction SD two light emitting element rows L2951, each formed by four light emitting elements 2951 which are lined up equidistant from each other along the longitudinal direction LGD corresponding to the main scanning direction MD, which forms one light emitting element group 295. That is, eight light emitting elements 2951, which correspond to the microlens ML denoted at the double-dot lines in FIG. 8, constitute one light emitting element group 295. The multiple light emitting element groups 295 are arranged in the following manner.

In other words, the multiple light emitting element groups 295 are disposed in a two-dimensional arrangement so that three light emitting element group rows L295 (group rows), each formed by a predetermined number of (two or more) light emitting element groups 295 which are arranged along the longitudinal direction LGD corresponding to the main scanning direction MD, are lined up along the lateral direction LTD corresponding to the sub scanning direction SD. All light emitting element groups 295 are located at main-scanning-direction positions which are different from each other.

Further, the multiple light emitting element groups 295 are disposed in such a manner that the sub-scanning-direction positions of those light emitting element groups whose main-scanning-direction positions are next to each other (e.g., a light emitting element group 295C1 and a light emitting element group 295B1) are different from each other. The geometric gravity points of the light emitting elements 2951 are herein treated as the positions of the light emitting elements 2951. Hence, a distance between two light emitting elements is a distance between the geometric gravity points of these light emitting elements. In addition, what is herein referred to as the "geometric gravity point of the light emitting element group" are the geometric gravity point of all light emitting elements which belong to the same light emitting element group 295. Further, main-scanning-direction positions and sub-scanning-direction positions mean main-scanning-direction components and sub-scanning-direction components at target positions.

The light guiding holes 2971 are formed in the light blocking member 297 at positions which correspond to how the light emitting element groups 295 are arranged, and the lens pairs formed by the lenses 2993A and 2993B are disposed. That is, in this embodiment, the gravity positions of the light emitting element groups 295, the central axes of the light guiding holes 2971 and the optical axes OA of the lens pairs formed by the lenses 2993A and 2993B approximately coincide with each other. Light beams emitted from the light emitting elements 2951 of the light emitting element groups 295 impinge upon the microlens array 299 via the corresponding light guiding holes 2971, and are imaged by the microlens array 299 as spots on the surface of the photosensitive drum 21.

Figure 9:
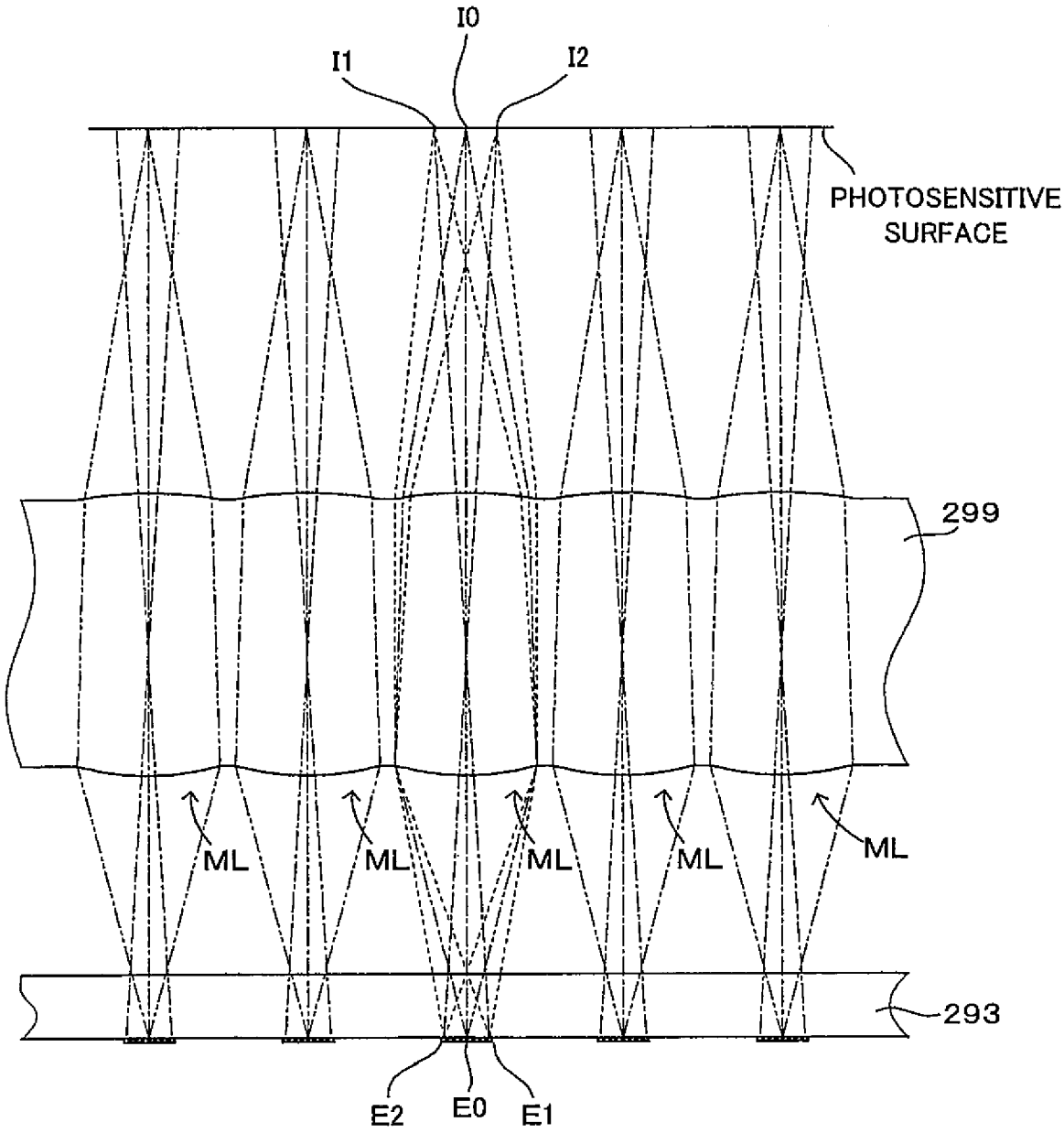
FIG. 9 is a drawing which shows how the microlens array forms an image according to the first embodiment.

FIG. 9 is a drawing which shows how the microlens array forms an image according to this embodiment. For the purpose of illustrating the imaging characteristic of the microlens array 299, FIG. 9 shows the geometric gravity points E0 of the light emitting element groups 295 and the trajectories of light beams emitted from the positions E1 and E2 which are away by predetermined gaps from the geometric gravity points E0. As the trajectories indicate, the light beams emitted from the respective positions, after impinging upon the back surface of the glass substrate 293, exit the front surface of the glass substrate 293. The light beams leaving the front surface of the glass substrate 293 thereafter reach the surface of the photosensitive drum (surface-to-be-scanned) via the microlens array 299.

As FIG. 9 shows, the light beams coming from the geometric gravity points E0 of the light emitting element groups are imaged at intersections I0 of the surface of the photosensitive drum 21 and the optical axes OA of the lens pairs formed by the lenses 2993A and 2993B. This is because the geometric gravity points E0 of the light emitting element groups 295 (namely, the positions of the light emitting element groups 295) are on the optical axes OA of the lens pairs formed by the lenses 2993A and 2993B in this embodiment as described above. Meanwhile, the light beams coming from the positions E1 and E2 are imaged respectively at positions I1 and I2 on the surface of the photosensitive drum 21. In short, the light beams coming from the positions E1 are imaged at the positions I1 which are on the opposite side to the optical axes OA of the lens pairs formed by the lenses 2993A and 2993B along the main scanning direction MD, and the light beams coming from the positions E2 are imaged at the positions I2 which are on the opposite side to the optical axes OA of the lens pairs formed by the lenses 2993A and 2993B along the main scanning direction MD. Imaging lenses formed by the lens pairs of the lenses 2993A and 2993B sharing the common optical axes and the glass substrate 2991 located between the lenses of the pairs thus serve as so-called inverting optical systems which exhibit an inversion characteristic.

Further, as shown in FIG. 9, distances between the positions I1 and I0 at which the light beams are imaged are longer than distances between the positions E0 and E1. That is, the absolute value of the magnification (optical magnification) of the imaging lenses exceeds "1" in this embodiment, which means that the optical systems according to this embodiment are so-called expanding optical systems which exhibit an expansion characteristic. In this embodiment, the microlens ML, which are the optical systems formed by the lens pairs formed by the lenses 2993A and 2993B sharing the common optical axes and the glass substrate 2991 located between the lenses of the pairs, function as the "imaging lenses" of the invention.

Figure 10:
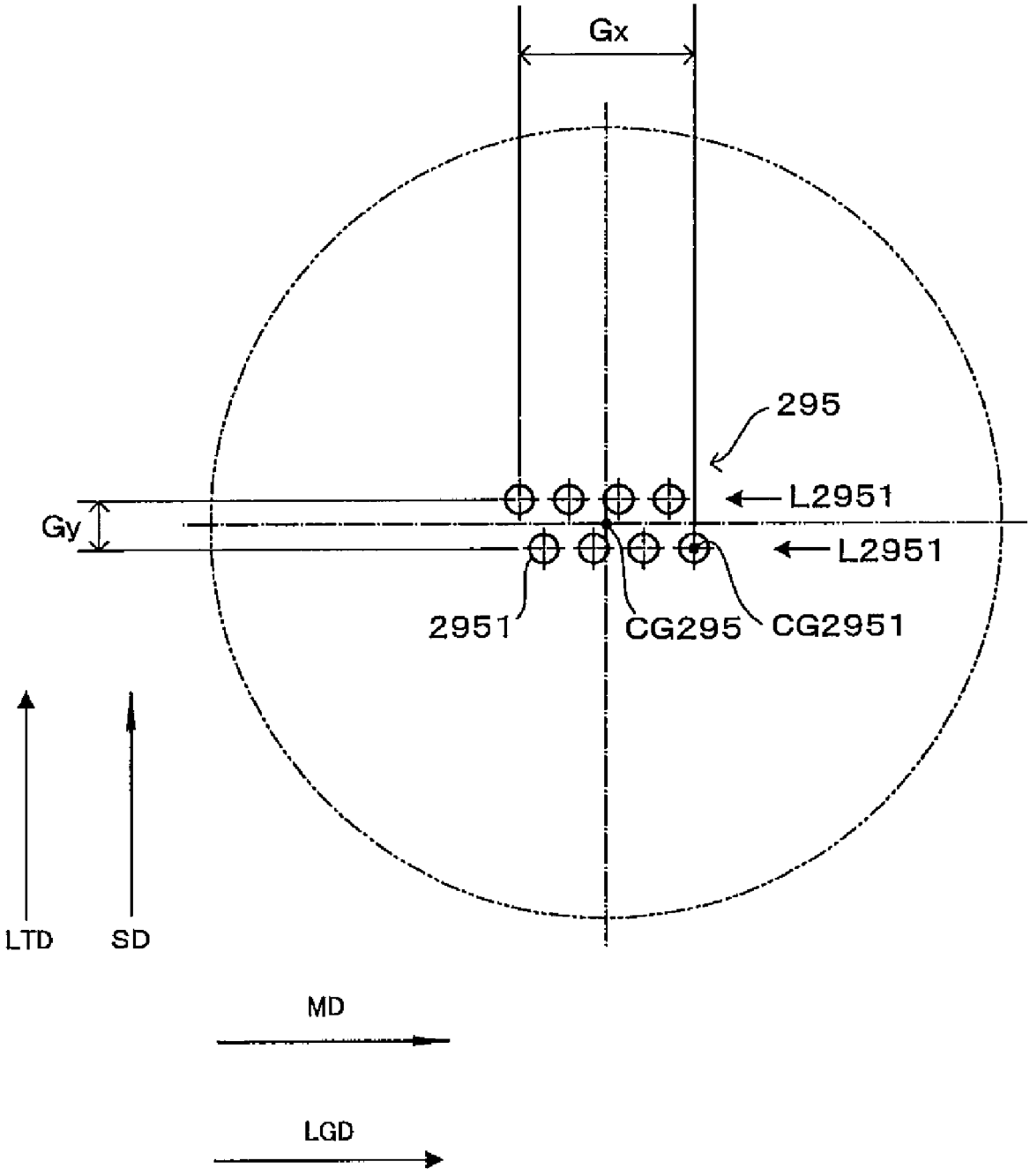
FIG. 10 is a drawing which shows the detailed arrangement of the light emitting elements in the first embodiment.

FIG. 10 is a drawing which shows the detailed arrangement of the light emitting elements in the first embodiment. In FIG. 10, denoted at CG2951 are the geometric gravity points of the light emitting elements 2951 (which are the positions of the light emitting elements 2951). Denoted at CG295 is the geometric gravity point representing the positions of the eight light emitting elements 2951 which belong to the light emitting element group 295 (i.e., the geometric gravity point of the light emitting element group 295). As shown in FIG. 10, according to this embodiment, the eight light emitting elements 2951 are arranged in a two-dimensional arrangement so that two light emitting element rows L2951, each formed by four light emitting elements which are arranged at predetermined pitches along the main scanning direction MD, are lined up along the sub scanning direction SD. Within the same light emitting element group, these two light emitting element rows L2951 are lined up along the sub scanning direction SD such that the positions of the eight light emitting elements 2951 along the main scanning direction MD are different from each other and two light emitting elements 2951 whose positions in the main scanning direction MD are next to each other belong to different light emitting element rows L2951. In the first embodiment, the eight light emitting elements 2951 belonging to the same light emitting element group thus correspond to the "multiple light emitting elements" of the invention.

In FIG. 10, denoted at Gx is a distance between the upstream-most light emitting element 2951 and the downstream-most light emitting element 2951 along the longitudinal direction LGD corresponding to the main scanning direction MD within one light emitting element group 295 (namely, a main-scanning-direction group width). Denoted at Gy is a distance between the upstream-most light emitting element 2951 and the downstream-most light emitting element 2951 along the lateral direction LTD corresponding to the sub scanning direction SD within one light emitting element group 295 (namely, a sub-scanning-direction group width). As shown in FIG. 10, in this embodiment, the main-scanning-direction group width Gx is wider than the sub-scanning-direction group width Gy. In short, each light emitting element group 295 has a flat arrangement structure whose longer axis is along the main scanning direction MD. Describing this in more specific details, Gx=0.148 mm and Gy=0.021 mm in the first embodiment.

Figure 11:
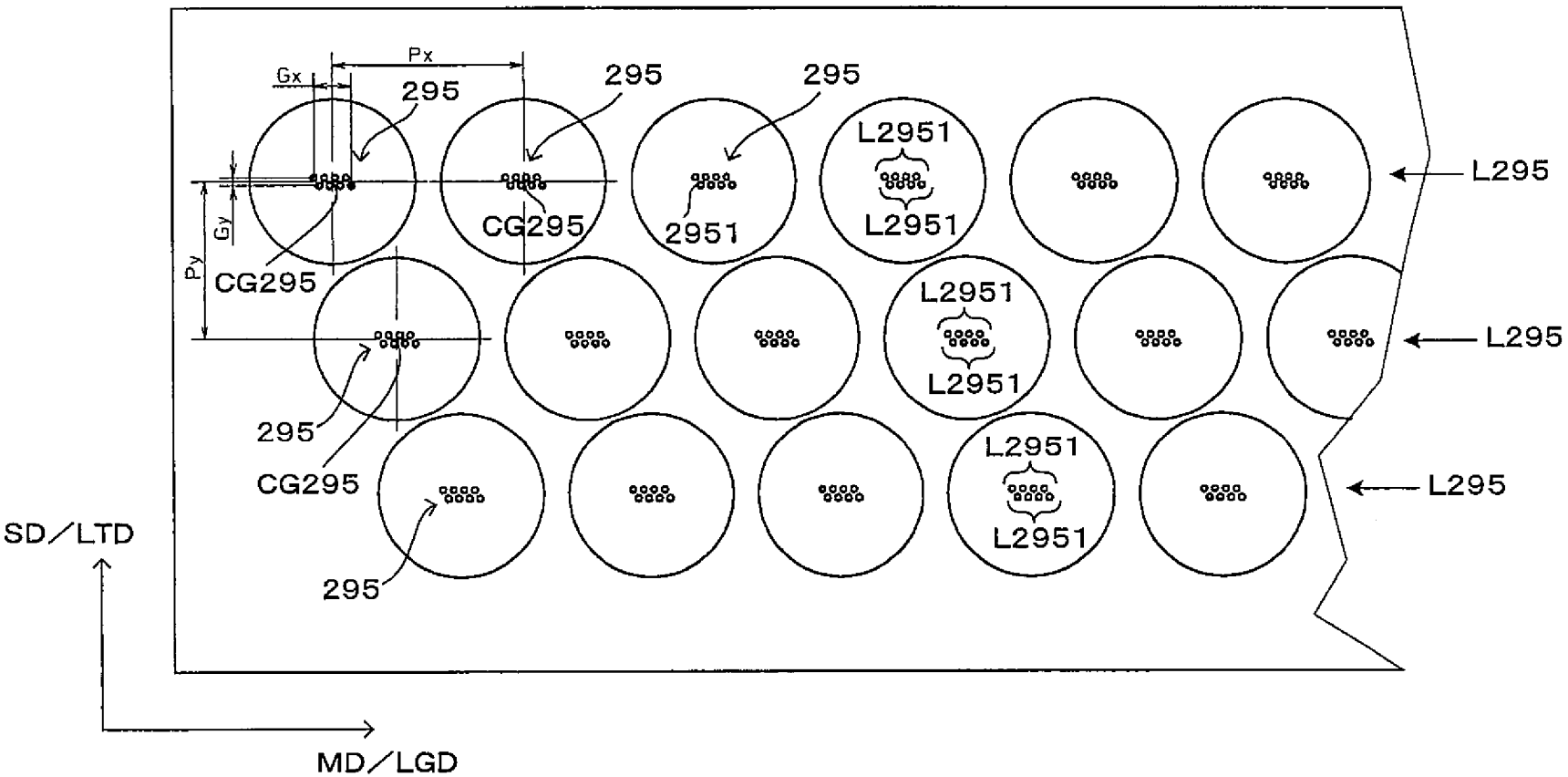
FIG. 11 is a drawing which shows a relationship between the neighboring light emitting element groups according to the first embodiment.

FIG. 11 is a drawing which shows a relationship between the neighboring light emitting element groups according to the first embodiment. In FIG. 11, denoted at Pox is a distance between the geometric gravity points CG295 of the two light emitting element groups 295 whose positions in the main scanning direction MD are next to each other (main-scanning-direction inter-group gap). Denoted at Py is a distance between the geometric gravity points CG295 of the two light emitting element groups 295 whose positions in the sub scanning direction SD are next to each other (sub-scanning-direction inter-group gap). As shown in FIG. 11, the main-scanning-direction group pitch Px is wider than the sub-scanning-direction group pitch Py. To be more specific, Pox 0.16 mm and Py=0.9 mm in the first embodiment.

Figure 12:
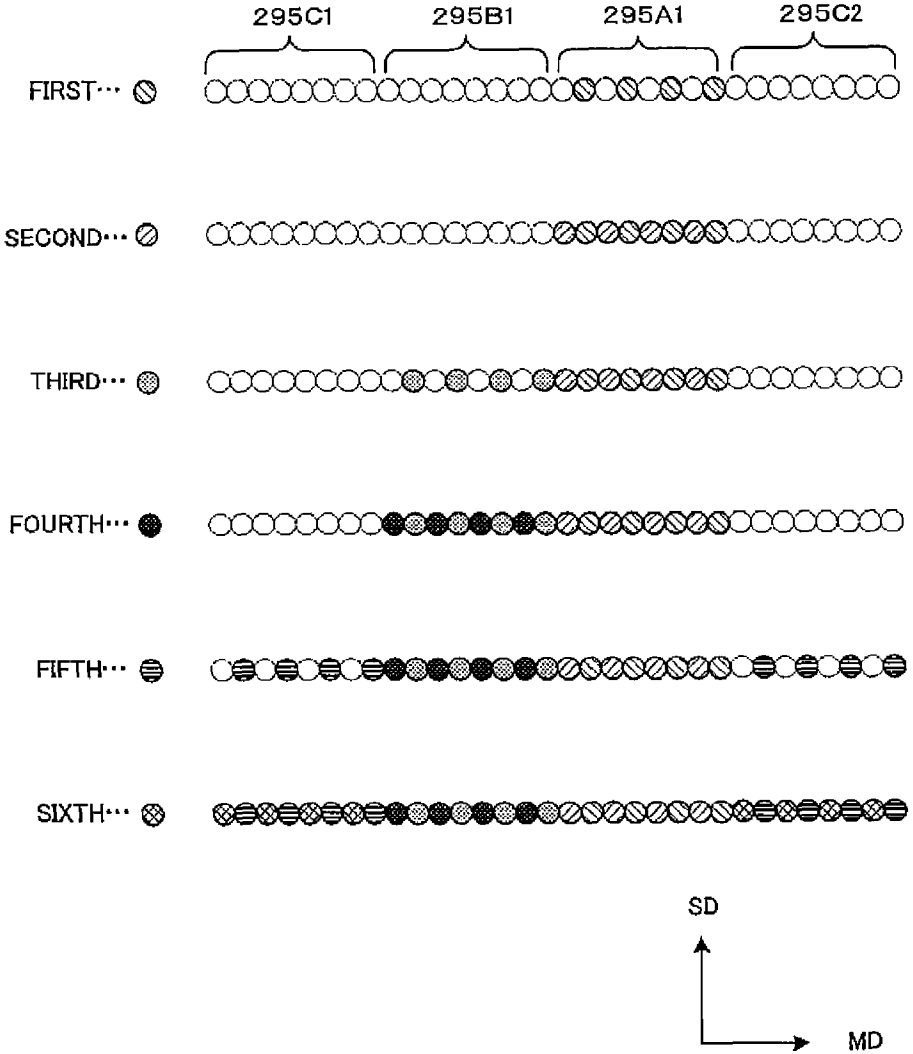
FIG. 12 is a drawing which shows a spot forming operation with using the line head according to the first embodiment.

FIG. 12 is a drawing which shows a spot forming operation with using the line head according to the first embodiment. The spot forming operation by the line head according to this embodiment will now be described with reference to FIGS. 2, 8 and 12. For easy understanding of the invention, the following is dedicated to an instance that plural spots are formed side by side on a straight line which extends in the main scanning direction MD. In the first embodiment, the head control module 400 makes the multiple light emitting elements emit light at predetermined timing while the surface (surface-to-be-scanned) of the photosensitive drum 21 (latent image carrier) is being transported in the sub scanning direction SD, thereby forming plural spots side by side on a straight line which extends in the main scanning direction MD.

In other words, there are six light emitting element rows L2951 lined up along the sub scanning direction SD within the line head according to the first embodiment such that they correspond to the sub-scanning-direction positions Y1 to Y6, respectively (FIG. 8). Noting this, in this embodiment, the light emitting element rows L2951 located at the same sub-scanning-direction position emit light approximately the same timing while light emission from the light emitting element rows L2951 located at the different sub-scanning-direction positions is timed differently Describing this in more specific details, the light emitting element rows L2951 emit light while taking turns in the order of the sub-scanning-direction positions Y1 to Y6. As the light emitting element rows L2951 emit light in this order while the surface of the photosensitive drum 21 is being transported in the sub scanning direction SD, plural spots are formed side by side on a straight line which extends in the main scanning direction MD.

This operation will now be described with reference to FIGS. 8 and 11. First light emission is from the light emitting elements 2951 of the light emitting element rows L2951 located at the sub-scanning-direction position Y1 and belonging to the upstream-most light emitting element groups 295A1, 295A2, 295A3, . . . along the sub scanning direction SD. Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIRST" in FIG. 12. In FIG. 12, the white circles denote future spots yet to be formed. Meanwhile, the spots denoted at 295C1, 295B1, 295A1 and 295C2 in FIG. 12 are spots formed by the light emitting element groups 295 which correspond to these reference symbols.

Next light emission is from the light emitting elements 2951 of the light emitting element rows L2951 located at the sub-scanning-direction position Y2 and belonging to the upstream-most light emitting element groups 295A1, 295A2, 295A3, . . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SECOND" in FIG. 12. The reason why light emission starts at the downstream light emitting element rows L2951 along the sub scanning direction SD (i.e., in the order of the sub-scanning-direction positions Y1 and Y2) while the transportation direction of the surface of the photosensitive drum 21 is the sub scanning direction SD is because the "imaging lenses" exhibit the inversion characteristic.

Next light emission is from the light emitting elements 2951 of the light emitting element rows L2951 located at the sub-scanning-direction position Y3 and belonging to the second upstream-most light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "THIRD" in FIG. 12.

Next light emission is from the light emitting elements 2951 of the light emitting element rows L2951 located at the sub-scanning-direction position Y4 and belonging to these light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FOURTH" in FIG. 12.

Next light emission is from the light emitting elements 2951 of the light emitting element rows L2951 located at the sub-scanning-direction position Y5 and belonging to the downstream-most light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIFTH" in FIG. 12.

The last light emission is from the light emitting elements 2951 of the light emitting element rows L2951 located at the sub-scanning-direction position Y6 and belonging to these light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SIXTH" in FIG. 12. As the first through the sixth light emitting operations are thus executed, the plural spots are formed side by side on the straight lines which extend in the main scanning direction MD.

As described above, the line head according to the first embodiment comprises: the multiple light emitting element groups 295 each formed by the multiple light emitting elements 2951; and the multiple microlens ML (imaging lenses) which are disposed in one-to-one correspondence to the multiple light emitting element groups 295 and which each image, on the surface of the photosensitive drum (surface-to-be-scanned), the light beam emitted from each light emitting element 2951 belonging to the associated light emitting element group 295. Further, the multiple light emitting element groups 295 and the multiple light emitting elements 2951 are disposed in the following arrangement. In short, the multiple light emitting element groups 295 are disposed in a two-dimensional arrangement so that the multiple light emitting element group rows L295, each formed by the two or more light emitting element groups 295 which are arranged along the longitudinal direction LGD corresponding to the main scanning direction MD, are lined up along the sub scanning direction SD. In addition, the multiple light emitting elements 2951 belonging to the same light emitting element group 295 are disposed in a two-dimensional arrangement so that two or more light emitting elements are lined up along the sub scanning direction SD.

The line head 29 described above has a structure in which the main-scanning-direction group width Gx is wider than the sub-scanning-direction group width Gy. Such a line head 29 could give rise to crosstalk in the main scanning direction since the light emitting element groups 295 have flat arrangement structures whose longer axes are along the longitudinal direction LGD corresponding to the main scanning direction MD. Where the light emitting element groups 295 are provided in this manner, the distance Δ between the light emitting elements 2951 at an end of one light emitting element group 295 in the longitudinal direction LGD and the imaging lens which is next to the imaging lens in the longitudinal direction LGD which corresponds to the light emitting element 2951 tends to be short. Hence, crosstalk in the main scanning direction MD could occur that the light beams emitted from the light emitting elements 2951 at the ends of the light emitting element groups 295 impinge also upon the imaging lenses which are next to the imaging lenses in the main scanning direction MD which correspond to these light emitting elements 2951. Such crosstalk may make it impossible to form favorable spots. This problem and a solution to the problem will now be described with reference to the associated drawings.

Figure 13:
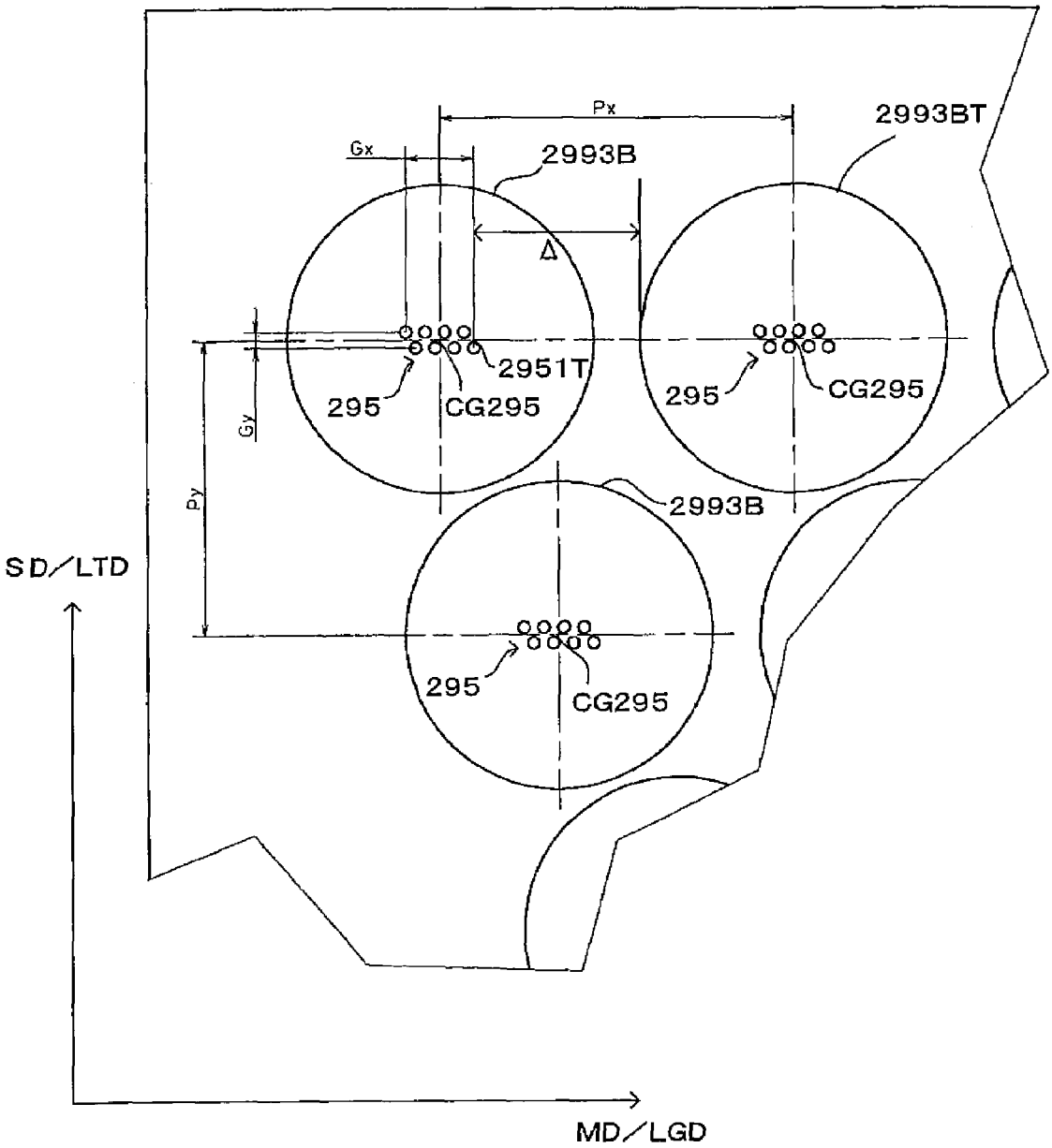
FIG. 13 is a drawing which shows a spot forming operation with using the line head according to the invention.

FIG. 13 is a schematic view which illustrates the principle of the invention. In FIG. 13, the circles 2993B, 2993B denoted at the solid lines denote the lenses 2993B among the elements which form the microlens ML (imaging lenses). As described earlier, the lenses 2993B are disposed so as to correspond to the light emitting element groups 295. In the event that the line head has a flat arrangement structure whose longer axis is along the longitudinal direction LGD corresponding to the main scanning direction MD as in the first embodiment, crosstalk in the main scanning direction MD may occur. In other words, via the lens 2993BT, the light beam from the light emitting element 2951T at the end of the light emitting element group 295 (FIG. 13) could impinge also upon the imaging lens which is adjacent along the main scanning direction MD (that is, longitudinal direction LGD) to the imaging lens which corresponds to the light emitting element 2951T. In contrast, the line head described above has the following structure: the main-scanning-direction group pitch Px is wider than the sub-scanning-direction group pitch Py where a distance between the geometric gravity points CG295 of the two light emitting element groups 295 whose positions in the longitudinal direction LGD are next to each other is the main-scanning-direction group pitch Px and a distance between the geometric gravity points CG295 of the two light emitting element groups 295 whose positions in the lateral direction LTD corresponding to the sub scanning direction SD are next to each other is the sub-scanning-direction group pitch Py. This ensures the sufficient distance Pox between the two light emitting element groups whose positions in the main scanning direction are next to each other. Hence, this therefore ensures the sufficient distance Δ between the light emitting element 2951T which is at the end of the light emitting element group 295 along the longitudinal direction LGD corresponding to the main scanning direction M and the imaging lens which is adjacent along the longitudinal direction LGD to the imaging lens which corresponds to the light emitting element 2951T. It is therefore possible to suppress crosstalk along the main scanning direction MD, a phenomenon that the light beam emitted from the light emitting element 2951T at the end of these light emitting element group 295 impinges also upon the imaging lens which is next to the imaging lens in the main scanning direction MD which corresponds to these light emitting element 2951T, and hence, to form favorable spots.

By the way, the line head 29 described above images, by means of its the microlenses ML (imaging lenses), the light beams emitted from the light emitting elements 2951 of these light emitting element groups 295 and consequently forms spots on the surface-to-be-scanned. At this stage, the line head 29 forms favorable spots on the surface-to-be-scanned so as to attain a predetermined resolution. In other words, the distances between the light emitting elements which are adjacent to each other on the surface-to-be-scanned are set such that the predetermined resolution will be achieved. The imaging lenses image the light beams emitted from the multiple light emitting elements 2951 of the light emitting element groups 295 as spots on the surface-to-be-scanned at a predetermined magnification (optical magnification) so that such inter-spot distances will be realized. To this end, the line head 29 according to the first embodiment uses, as the imaging lenses, expanding optical systems the absolute value of the magnification of which is greater than 1. This makes it possible to more effectively suppress crosstalk along the main scanning direction MD, and therefore, form even better spots. The reason will now be described.

Before describing the reason, let a consideration be given on the structure of the light emitting element groups 295 which is demanded to realize the above resolution for an instance that the imaging lenses are expanding optical systems (the absolute value of the magnification of which exceeds 1) and for an instance that the imaging lenses are shrinking optical systems (the absolute value of the magnification of which is smaller than 1). Where the imaging lenses are expanding optical systems, light beams emitted from two light emitting elements 2951 which are adjacent to each other in the longitudinal direction LGD corresponding to the main scanning direction MD are imaged on the surface of the photosensitive drum (surface-to-be-scanned) as two spots while getting expanded. In short, a distance between two spots on the surface of the photosensitive drum is longer than a distance between these two light emitting elements. On the contrary, a relationship between the distances between the light emitting elements and the distances between the spots for an instance that the imaging lenses are shrinking optical systems is to opposite to that for an instance that the imaging lenses are expanding optical systems. That is, a distance between two spots on the surface of the photosensitive drum is shorter than a distance between these two light emitting elements. For the purpose of attaining the same resolution (i.e., realizing the same inter-spot distances), it is desirable where expanding optical systems are used that the distances between the light emitting elements which are adjacent to each other in the longitudinal direction LGD are short, whereas where shrinking optical systems are used, it is desirable that the distances between the light emitting elements which are adjacent to each other in the longitudinal direction LGD are long. In short, while the light emitting element groups 295 whose main-scanning-direction group width Gx is narrow are required in the event that expanding optical systems are used, the light emitting element groups whose main-scanning-direction group pitch Px is wide are required in the event that shrinking optical systems are used.

Noting this, the absolute value of the magnification of the imaging lenses is set to a value which exceeds 1 in the line head according to the embodiment described above. This is because this structure permits more effective suppression of crosstalk described above along the main scanning direction MD that the light beams emitted from the light emitting elements 2951 at the ends of these light emitting element groups 295 impinge also upon the imaging lenses which are next to the imaging lenses in the main scanning direction MD which correspond to these light emitting elements 2951, and realizes even better spot creation. In short, as the discussion above indicates, where the imaging lenses are expanding optical systems, the main-scanning-direction group width Gx of these light emitting element groups 295 can be reduced. This allows extension of the distances Δ between the light emitting elements 2951T which are at the ends of the light emitting element groups 295 along the longitudinal direction LGD and the imaging lenses which are adjacent along the main scanning direction MD to the imaging lenses which correspond to the light emitting elements 2951T. Hence, it is possible to more effectively suppress crosstalk along the main scanning direction MD that the light beams emitted from the light emitting elements 2951 at the ends of the light emitting element groups 295 impinge also upon the imaging lenses which are next to the imaging lenses in the main scanning direction MD which correspond to these light emitting elements 2951, and hence, to form even better spot.

Further, in one light emitting element group 295, the multiple light emitting elements 2951 belonging to this light emitting element group 295 are disposed in a symmetric arrangement with respect to the geometric gravity point CG295 of the light emitting element group 295 according to the embodiment above. This embodiment uses the structure in which the positions of the light emitting element groups 295 are located respectively on the optical axes OA of the associated imaging lenses. This is because of more effective suppression of crosstalk along the main scanning direction MD that the light beams emitted from the light emitting elements 2951 at the ends of the light emitting element groups 295 impinge also upon the imaging lenses which are next to the imaging lenses in the main scanning direction MD which correspond to these light emitting elements 2951, which permits forming more favorable spots. The reason will now be described.

Figure 14:
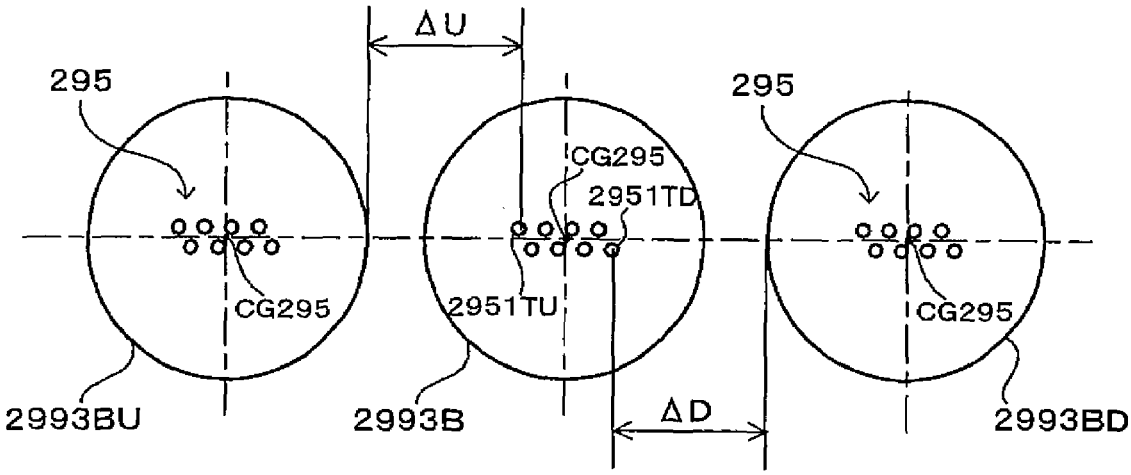
FIG. 14 is a drawing which shows an instance that the positions of the light emitting element groups match with the optical axes of the imaging lenses.
Figure 15:
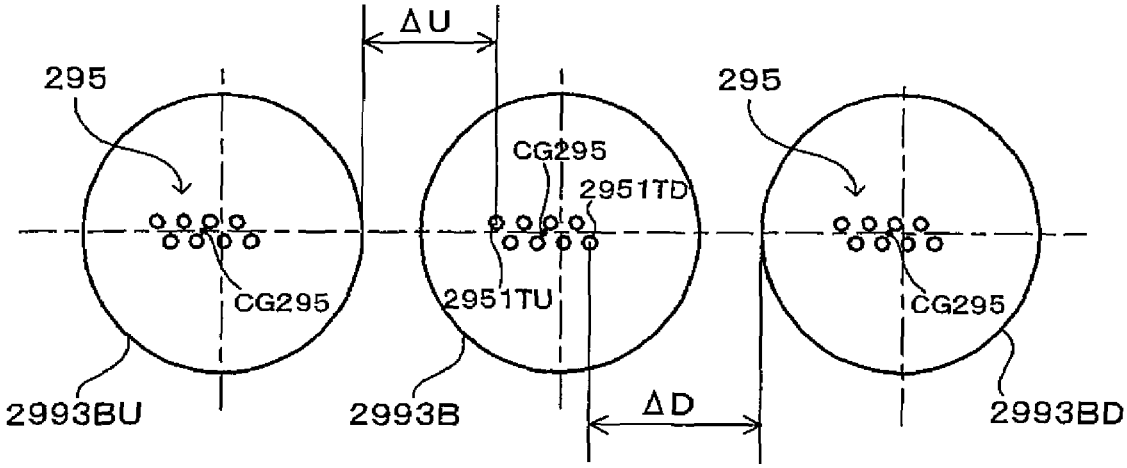
FIG. 15 is a drawing which shows an instance that the positions of the light emitting element groups do not match with the optical axes of the imaging lenses.

FIG. 14 is a drawing which shows an instance that the positions of the light emitting element groups match with the optical axes of the imaging lenses. FIG. 15 is a drawing which shows an instance that the positions of the light emitting element groups do not match with the optical axes of the imaging lenses. The light emitting element groups 295 comprise the light emitting elements 2951 at their both ends along the longitudinal direction LGD corresponding to the main scanning direction MD. Further, in the line head 29 having the structure described above, the multiple light emitting elements 2951 are disposed in a symmetric arrangement with respect to the positions of the light emitting element groups 295 which serve as the axes of symmetry and the optical axes OA of the imaging lenses (i.e., the optical axes of the lenses 2993B) match with the axes of symmetry. In FIGS. 14 and 15, the optical axes OA of the imaging lenses are approximately at the center of the respective lenses 2993B, and each at the position of the intersection of the two dotted-and-chained lines one of which is vertical and the other of which is horizontal. Hence, in the line head 29 having the structure described above, distances from the optical axis OA of each imaging lens to the light emitting elements 2951TD, 2951TU at the both ends along the main scanning direction are equal to each other (FIG. 14). In other words, the distance AU from the light emitting element 2951TU at the other end along the main scanning direction to the lens 2993BU is equal to the distance AD from the light emitting element 2951TUD at the other end along the main scanning direction to the lens 2993BD.

On the contrary, where the axes of symmetry of the light emitting element groups 295 do not match with the optical axes of the imaging lenses but are off from the optical axes toward one side or the other side along the longitudinal direction LGD, that is, in the instance as that shown in FIG. 15, this distance relationship is different. In FIG. 15, the geometric gravity points CG295 of the light emitting element groups are off from the optical axes OA of the imaging lenses (which are the optical axes of the lenses 2993B) toward the upstream side along the longitudinal direction LGD. Due to this, the distance AU from the light emitting element 2951TU at the other end along the main scanning direction to the lens 2993BU is shorter than the distance AD from the light emitting element 2951TUD at the other end along the main scanning direction to the lens 2993BD. That is, the distance between the light emitting element 2951TU and the imaging lens is short. It is therefore more likely for the light beam emitted from the light emitting element 2951TU to impinge upon the lens 2993BU. In other words, crosstalk along the main scanning direction MD described above is more likely.

As the discussion above indicates, the geometric gravity points CG295 of the light emitting element groups do not match with the optical axes OA of the corresponding imaging lenses, crosstalk along the main scanning direction MD described above is likely to occur. In contrast, the embodiment above requires that the positions of the light emitting element groups are on the optical axes OA of the associated imaging lenses. This makes it possible to more effectively suppress crosstalk along the main scanning direction MD that the light beams emitted from the light emitting elements 2951 at the ends of the light emitting element groups 295 impinge also upon the imaging lenses which are next to the imaging lenses in the main scanning direction MD which correspond to these light emitting elements 2951, and hence, to form more favorable spots.

Further, the image forming apparatus according to this embodiment which uses the line head described above forms spots on the surfaces of the photosensitive drums (surfaces-to-be-scanned) using the line head described above. In short, the apparatus is capable of forming latent images on the surfaces of the photosensitive drums while suppressing crosstalk. This realizes better image formation, which is preferable.

Second Embodiment

Although the embodiments above require forming the light emitting element groups 295 in the manner shown in FIG. 8, the structure of the light emitting element groups 295 is not limited to this. The important benefit is that as the embodiments require that the main-scanning-direction group pitch Px is wider than the sub-scanning-direction group pitch Py in the line head which has the structure that the main-scanning-direction group width Gx is wider than the sub-scanning-direction group width Gy, it is possible to form favorable spots while suppressing crosstalk in the main scanning direction MD. The light emitting element groups may therefore be formed as described below, for instance.

Figure 16:
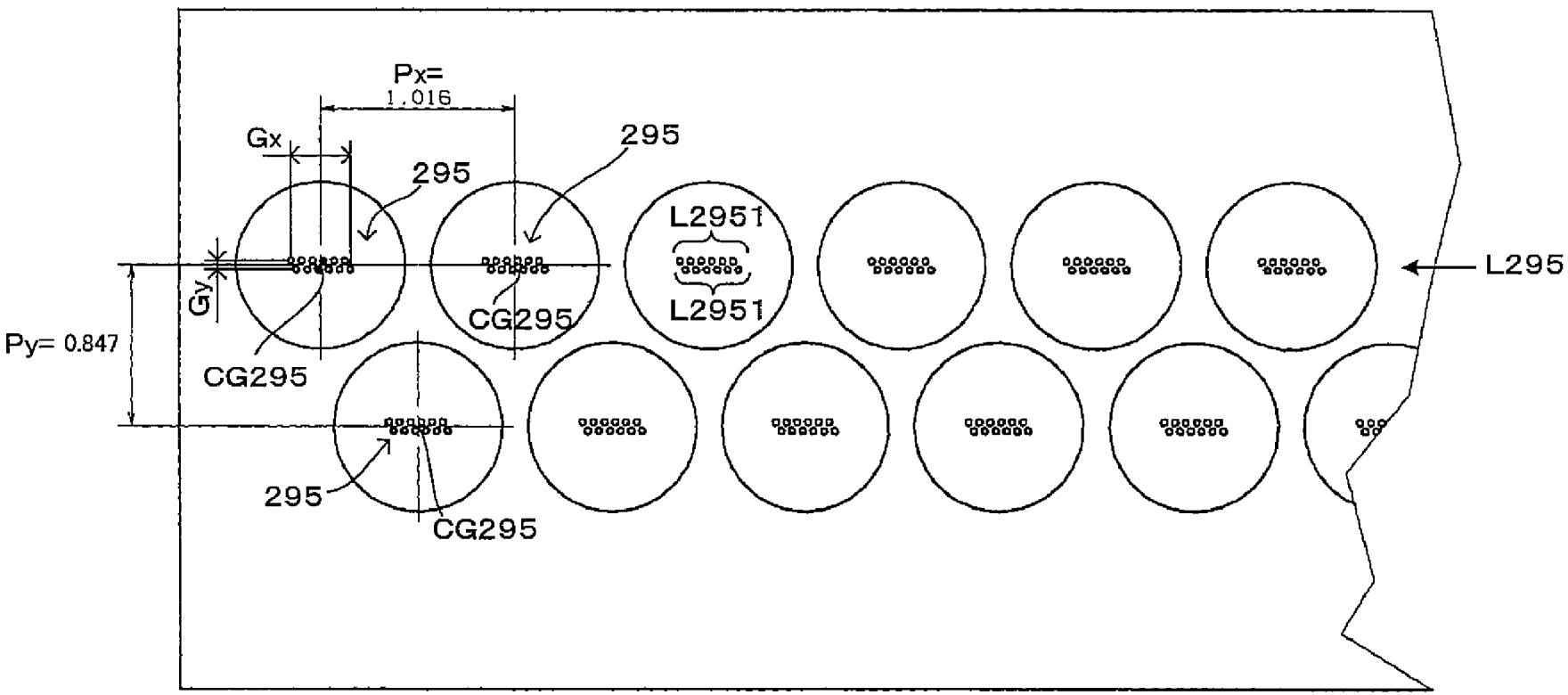
FIG. 16 is a drawing which shows the structure of the light emitting element groups according to a second embodiment of the invention.

FIG. 16 is a drawing which shows the structure of the light emitting element groups according to a second embodiment of the invention. In FIG. 16, one light emitting element group 295 is formed by arranging in the lateral direction LTD corresponding to the sub scanning direction SD two light emitting element rows L2951 each formed by six light emitting elements which are arranged at predetermined pitches along the longitudinal direction LGD corresponding to the main scanning direction MD. The multiple light emitting element groups 295 are arranged as follows. That is, the light emitting element groups 295 are disposed in a two-dimensional arrangement so that the two light emitting element group rows L295 (group rows), each formed by a predetermined number of (two or more) light emitting element groups 295 which are arranged along the longitudinal direction LGD, are lined up along the lateral direction LTD.

In the embodiment shown in FIG. 16 as well, the main-scanning-direction group width Gx is wider than the sub-scanning-direction group width Gy: the light emitting element groups 295 have flat arrangement structures that their longer axes are along the longitudinal direction LGD. To be more specific, Gx=0.310 mm and Gy=0.032 mm in the second embodiment. Further, as FIG. 16 shows, the main-scanning-direction group pitch Px is wider than the sub-scanning-direction group pitch Py: Pox=1.016 mm and Py=0.847 mm in this embodiment.

The main-scanning-direction group width Gx thus exceeds the sub-scanning-direction group width Gy in the embodiment shown in FIG. 16 as well. In other words, the longer axes of the light emitting element groups 295 are along the longitudinal direction LGD. Therefore, crosstalk as that described above could occur in the main scanning direction. However, to overcome the problem, the embodiment shown in FIG. 16 uses the structure that the main-scanning-direction group pitch Px is wider than the sub-scanning-direction group pitch Py. This ensures the sufficient distance Pox between the two light emitting element groups whose positions in the main scanning direction are next to each other. Hence, it is possible according to the embodiment shown in FIG. 16 as well to suppress crosstalk along the main scanning direction MD that the light beams emitted from the light emitting elements at the ends of the light emitting element groups 295 impinge also upon the imaging lenses which are next to the imaging lenses in the main scanning direction MD which correspond to these light emitting elements, which in turn allow forming favorable spots.

Third Embodiment

Figure 17:
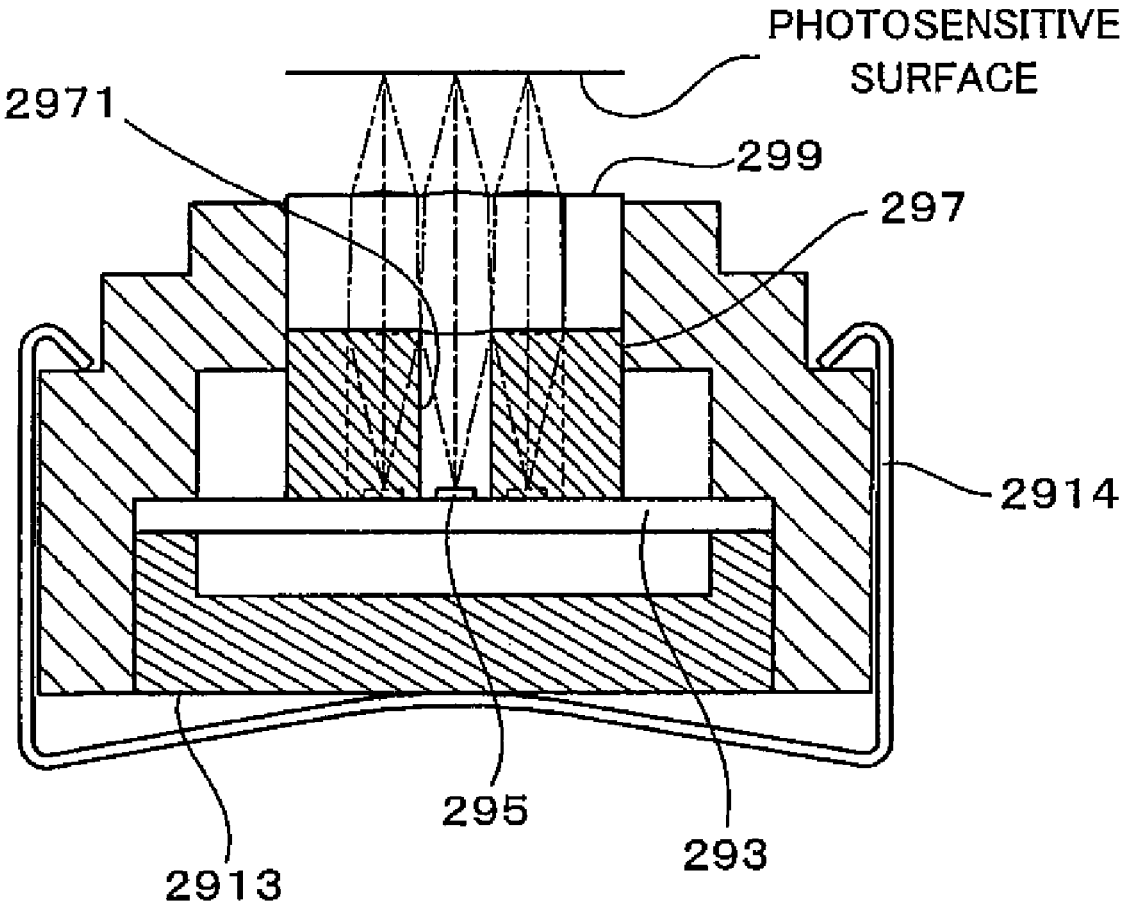
FIG. 17 is a cross sectional view of the line head (exposure section) according to a third embodiment of the invention taken along the sub scanning direction.

FIG. 17 is a cross sectional view of the line head (exposure section) according to a third embodiment of the invention taken along the sub scanning direction. In short, the line head shown in FIG. 17 uses LEDs as the light emitting elements. A major difference from the line head which uses organic ELs as the light emitting elements described with reference to FIG. 4 lies in the positions at which the light emitting elements are disposed. As shown in FIG. 5, in the line head which uses organic ELs as the light emitting elements, the light emitting elements (light emitting element groups 295) are disposed on the back surface of the glass substrate 293. Meanwhile, in the line head shown in FIG. 17 which uses LEDs as the light emitting elements, the light emitting elements are disposed on the front surface of the glass substrate 293. The other structures are common between the line heads shown in FIGS. 5 and 17, and therefore, the common features are denoted at corresponding reference symbols but will not be described in redundancy. As for the arrangement of the light emitting elements 2951 within the surface of the glass substrate 293, a similar arrangement to that for use of organic ELs may be used where LEDs are used.

The line head having this structure includes multiple light emitting element groups formed by multiple light emitting elements, as described with the first to third embodiments. Further, imaging lenses are disposed for the respective light emitting element groups. That is, the same number of the imaging lenses as the number of the light emitting element groups are disposed so that the multiple light emitting element groups and the multiple imaging lenses correspond to each other in one-to-one correspondence. In each one of the multiple light emitting element groups, multiple light emitting element trains in each of which two or more light emitting elements are arranged along a longitudinal direction corresponding to a main scanning direction are arranged along a lateral direction corresponding to a sub scanning direction so that multiple light emitting elements are in a two-dimensional arrangement. In addition, as these light emitting elements emit light beams, the imaging lean corresponding to this light emitting element group converges the light beams into spots on the surface-to-be-scanned. To be noted in particular, the light emitting element groups and the imaging lenses are arranged in the following manner according to the invention. In short, the light emitting element groups are arranged at main-scanning group pitches Px along the main scanning direction, thereby forming multiple group rows. Further, these group rows are at sub-scanning group pitches Py along the lateral direction. In this manner, the multiple light emitting element groups are in a two-dimensional arrangement.

In each light emitting element group, a distance Gx between the upstream-most light emitting element along the longitudinal direction and the downstream-most light emitting element along the longitudinal direction is greater than a distance Gy between the upstream-most light emitting element along the lateral direction and the downstream-most light emitting element along the lateral direction. Hence, each light emitting element group has a flat arrangement structure whose longer axis is along the longitudinal direction. This gives rise to a possibility of crosstalk along the longitudinal direction. This is because a distance Δ between the light emitting element at an end of one light emitting element group and the imaging lens corresponding to the light emitting element group next to this light emitting element tends to shrink in the line head having the above structure.

Noting this, according to the first to third embodiments of the invention, the pitches between the multiple light emitting element groups forming the group rows, namely, the main-scanning group pitches Px are greater than the pitches between the group rows, namely, the sub-scanning group pitches Py. This ensures sufficient gaps between the neighboring light emitting element groups which are adjacent to each other along the longitudinal direction corresponding to the main scanning direction. The distance Δ described above is therefore sufficient. It is therefore possible to suppress crosstalk along the main scanning direction that a light beam emitted from the light emitting element located at an end of one light emitting element group impinges also upon the imaging lens which is adjacent to the imaging lens corresponding to this light emitting element, and hence, to create an excellent spot.

In the first to third embodiments, as the light beams emitted from the light emitting elements of the light emitting element groups are imaged by the imaging lenses in the line head described above, spots are created on the surface-to-be-scanned. At this stage, the line head creates the spots on the surface-to-be-scanned so as to realize a predetermined resolution. In other words, a distance between neighboring spots on the surface-to-be-scanned is set so as to realize a preset resolution. Hence, in an attempt to realize such an inter-spot distance, the imaging lenses expand or shrink the light beams emitted from the multiple light emitting elements of the light emitting element groups at a predetermined magnification and form spots on the surface-to-be-scanned.

Consideration is now given on the structure of the light emitting element groups which is needed to realize such a resolution described above for an instance that the imaging lenses are expanding optical systems (which are imaging lenses whose magnification taken in the absolute value is greater than 1) and an instance that the imaging lenses are shrinking optical systems (which imaging lenses whose magnification taken in the absolute value is smaller than 1). In the even that the imaging lenses are expanding optical systems, light beams emitted from two light emitting elements which are next to each other along the main scanning direction are imaged as two spots on the surface-to-be-scanned while getting suppressed. That is, a distance between the two spots on the surface-to-be-scanned is greater than a distance between these two light emitting elements. On the contrary, where the imaging lenses are shrinking optical systems, the relationship between the distance between the light emitting elements and the inter-spot distance is the opposite to where the imaging lenses are expanding optical systems. That is, the distance between the two spots on the surface-to-be-scanned is shorter than the distance between these two light emitting elements. Hence, in order to realize the same resolution, a distance between light emitting elements which are next to each other along the longitudinal direction corresponding to the main scanning direction needs be short where expanding optical systems are used, whereas a distance between light emitting elements which are next to each other along the longitudinal direction needs be long where shrinking optical systems are used. While light emitting element groups whose main-scanning group widths are narrow are thus necessary for expanding optical systems, light emitting element groups whose main-scanning group widths are wide are necessary for shrinking optical systems.

The absolute value of the magnification of the imaging lenses may therefore be set to a value which is greater than 1. This is because this structure makes it possible to more effectively suppress crosstalk along the main scanning direction described above that a light beam emitted from the light emitting element located at the end of one light emitting element group impinges also upon the imaging lens which is adjacent along the main scanning direction to the imaging lens corresponding to this light emitting element, and hence, to realize better spot creation. In other words, in the event that expanding optical systems are used as the imaging lenses, the main-scanning group width of the light emitting element group can be reduced as discussed above. It is therefore possible to extend a distance between the light emitting element located at the end of one light emitting element group along the longitudinal direction and the imaging lens which is adjacent along the main scanning direction to the imaging lens corresponding to this light emitting element. Hence, it is possible to more effectively suppress crosstalk along the main scanning direction that a light beam emitted from the light emitting element located at one end of the light emitting element group impinges also upon the imaging lens which is adjacent along the main scanning direction to the imaging lens corresponding to this light emitting element, which in turn makes it possible to realize better spot creation.

Further, where in one light emitting element group, the multiple light emitting elements belonging to this light emitting element group are arranged in a symmetric arrangement relative to the location of the light emitting element group, the light emitting element group may be located on the optical axis of the corresponding imaging lens. This is because this structure makes it possible to more effectively suppress crosstalk along the main scanning direction that a light beam emitted from the light emitting element located at the end of one light emitting element group impinges also upon the imaging lens which is adjacent along the main scanning direction to the imaging lens corresponding to this light emitting element, and hence, to realize better spot creation.

The image forming apparatus according to the first to third embodiments of the invention is characterized in comprising a latent image carrier whose surface is transported along the sub scanning direction and an exposure section having the same structure as that of the line head which treats the surface of the latent image carrier as the surface-to-be-scanned and creates spots on the surface of the latent image carrier. Hence, it is possible to suppress crosstalk along the main scanning direction that a light beam emitted from the light emitting element located at the end of one light emitting element group impinges also upon the imaging lens which is adjacent along the main scanning direction to the imaging lens corresponding to this light emitting element, and hence, to form an image with better spots.

Fourth Embodiment

Figure 18:
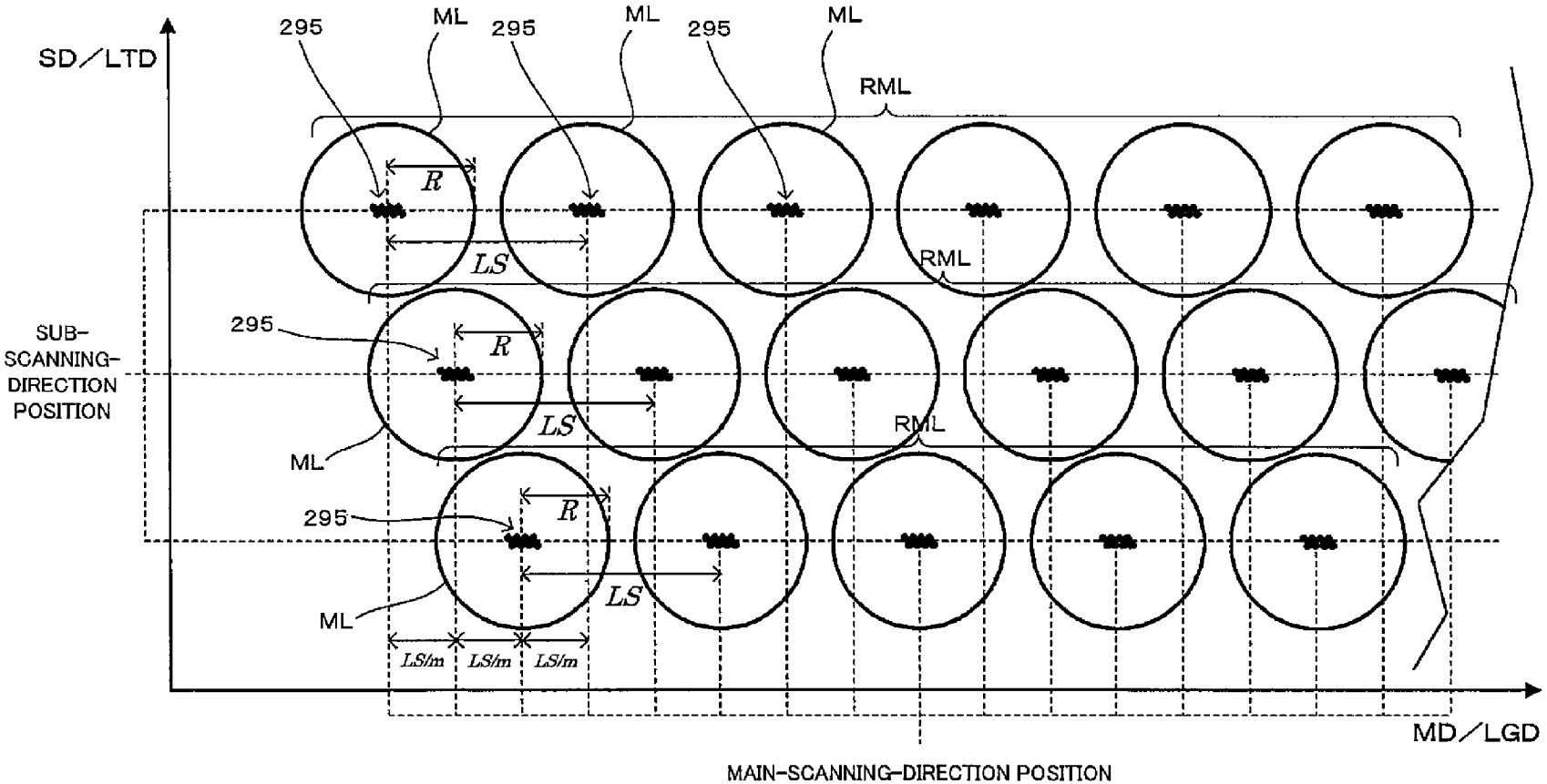
FIG. 18 is a drawing which shows the arrangement of the light emitting element groups and the imaging optical systems according to a fourth embodiment of the invention.

FIG. 18 is a drawing which shows the arrangement of the light emitting element groups and the imaging optical systems according to a fourth embodiment of the invention. In FIG. 18, the imaging optical systems are expressed as the microlenses ML. As shown in FIG. 18, in this embodiment, the multiple light emitting element groups 295 are disposed in a two-dimensional arrangement so that they are spaced apart from each other by predetermined pitches in the longitudinal direction LGD and the lateral direction LTD, the lateral direction LTD corresponding to the main scanning direction MD whereas the lateral direction LTD corresponding to the sub scanning direction SD. The multiple imaging optical systems (the microlenses ML) are disposed in one-to-one correspondence to the multiple light emitting element groups 295. As shown in FIG. 18, the multiple microlenses ML are arranged, thereby forming lens rows RML in which the microlenses ML are at lens spacing LS along the main scanning direction MD. There are three such lens rows RML in the sub scanning direction SD in such a manner that the main-scanning-direction positions of the multiple microlenses ML are different from each other. Further, the multiple microlenses ML are arranged so that the sub-scanning-direction positions of two microlenses ML whose main-scanning-direction positions are next to each other are different from each other. In other words, the multiple microlenses ML are arranged in such a manner that the two microlenses ML whose main-scanning-direction positions are next to each other belong to different lens rows RML from each other and that a distance along the main scanning direction between these two microlenses ML is approximately equal to LS/m. The value m denotes the number of the lens rows RML lined up along the sub scanning direction SD, and m=3 in this embodiment. The radius R of the microlenses ML is smaller than half the lens spacing LS.

Figure 19:
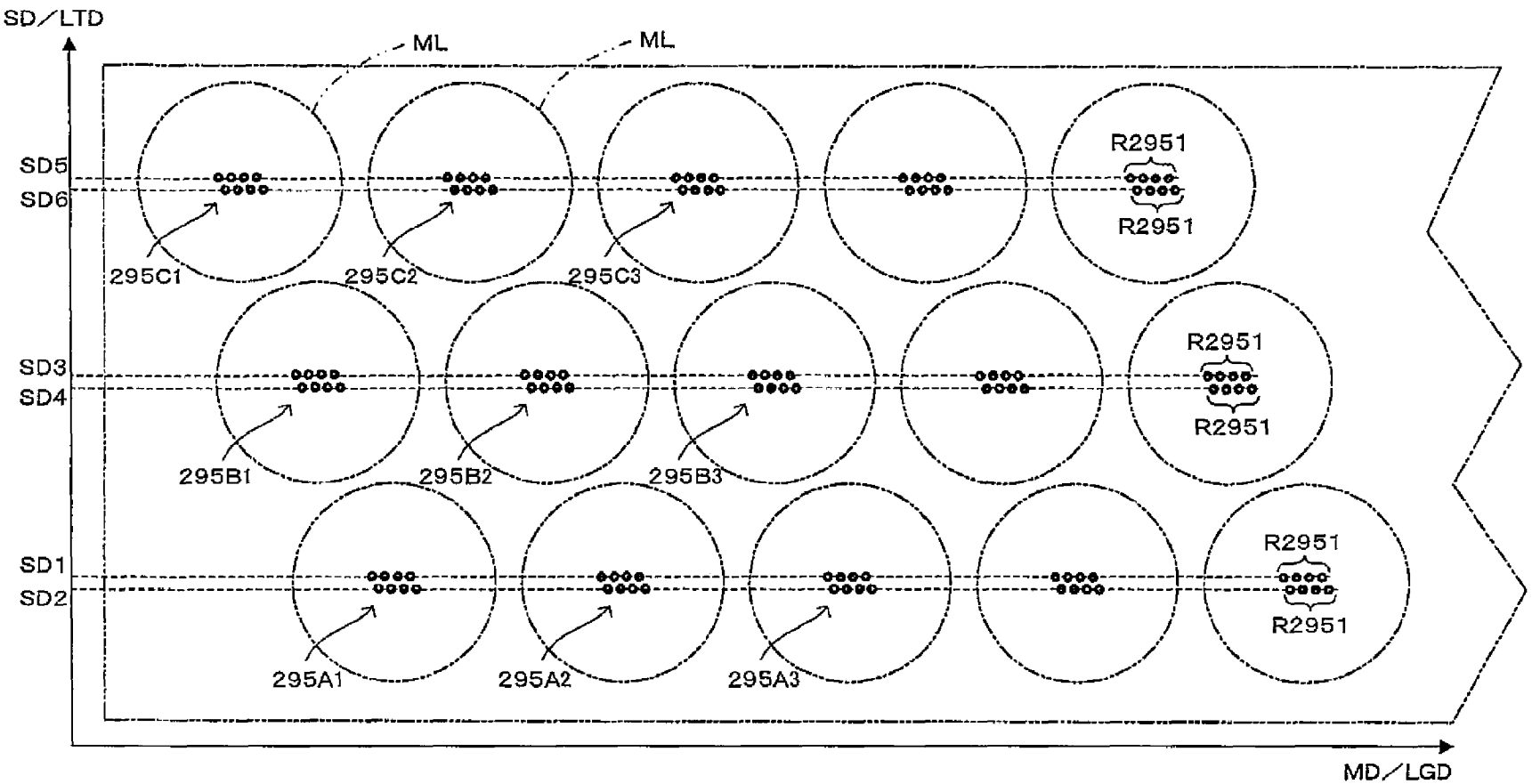
FIGS. 19 and 20 are explanatory diagrams for describing operations of the line head according to the fourth embodiment.
Figure 20:
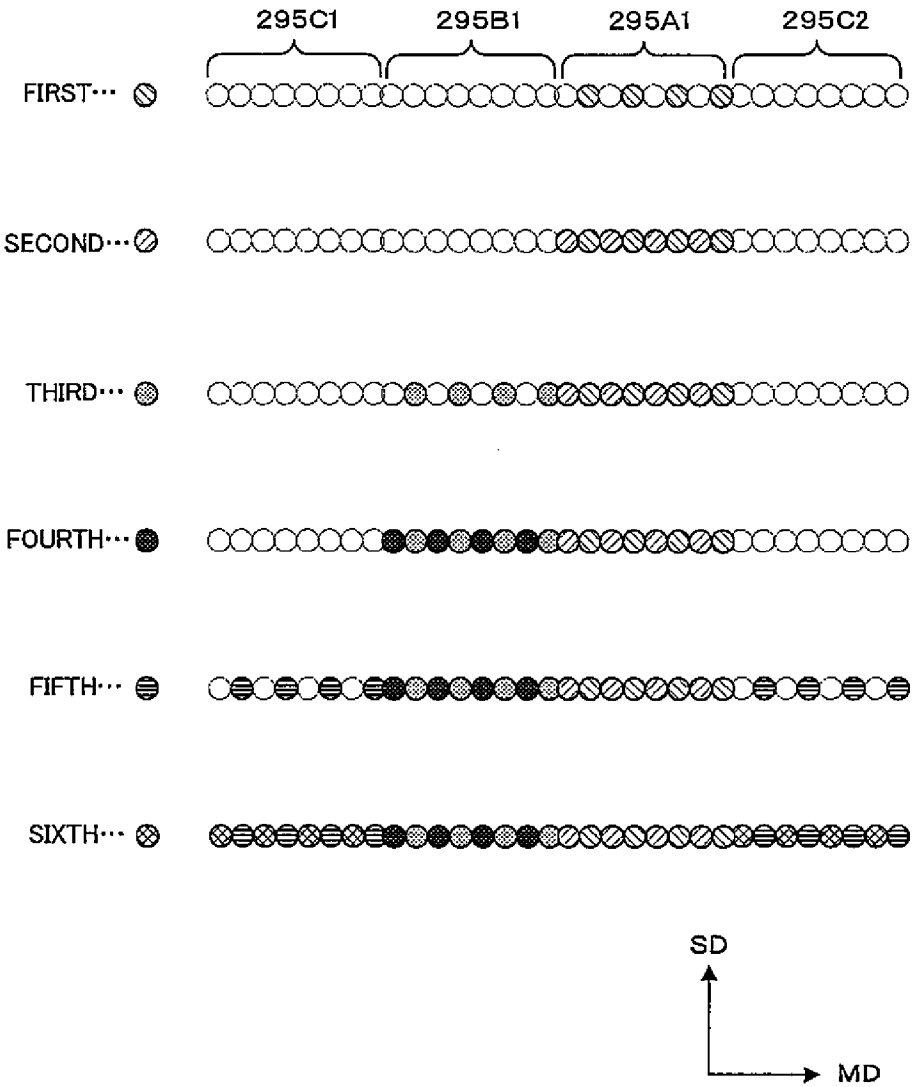

FIGS. 19 and 20 are explanatory diagrams for describing operations of the line head according to the fourth embodiment. The spot forming operation performed by the line head 29 according to this embodiment will be now described with reference to FIGS. 3, 19 and 20. Forming of plural equidistant spots on a straight line which extends in the main scanning direction MD will also be described. In the fourth embodiment, the multiple light emitting elements 2951 emit light at predetermined timing under control of the head control module 400 while the surface (surface-to-be-scanned) of the photosensitive drum 21 (latent image carrier) is being transported in the sub scanning direction SD, thereby forming plural spots side by side on a straight line which extends in the main scanning direction MD.

In other words, there are six light emitting element rows R2951 lined up along the sub scanning direction SD within the line head according to the fourth embodiment such that they correspond to the sub-scanning-direction positions SD1 to SD6, respectively (FIG. 19). Noting this, in this embodiment, the light emitting element rows R2951 located at the same sub-scanning-direction position emit light approximately the same timing while light emission from the light emitting element rows R2951 located at the different sub-scanning-direction positions is timed differently. Describing this in more specific details, the light emitting element rows R2951 emit light while taking turns in the order of the sub-scanning-direction positions SD1 to SD6. As the light emitting element rows R2951 emit light in this order while the surface of the photosensitive drum 21 is being transported in the sub scanning direction SD, plural spots are formed side by side on a straight line which extends in the main scanning direction MD.

This operation will now be described with reference to FIGS. 19 and 20. First light emission is from the light emitting elements 2951 of the light emitting element rows R2951 located at the sub-scanning-direction position SD1 and belonging to the upstream-most light emitting element groups 295A1, 295A2, 295A3, . . . along the sub scanning direction SD. Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIRST" in FIG. 20. In FIG. 20, the white circles denote future spots yet to be formed. Meanwhile, the spots denoted at 295C1, 295B1, 295A1 and 295C2 in FIG. 20 are spots formed by the light emitting element groups 295 which correspond to these reference symbols.

Next light emission is from the light emitting elements 2951 of the light emitting element rows R2951 located at the sub-scanning-direction position SD2 and belonging to the upstream-most light emitting element groups 295A1, 295A2, 295A3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SECOND" in FIG. 20. The reason why light emission starts at the downstream light emitting element rows R2951 along the sub scanning direction SD (i.e., in the order of the sub-scanning-direction positions SD1 and SD2) while the transportation direction of the surface of the photosensitive drum 21 is the sub scanning direction SD is because the "imaging lenses" exhibit the inversion characteristic.

Next light emission is from the light emitting elements 2951 of the light emitting element rows R2951 located at the sub-scanning-direction position SD3 and belonging to the second upstream-most light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "THIRD" in FIG. 20.

Next light emission is from the light emitting elements 2951 of the light emitting element rows R2951 located at the sub-scanning-direction position SD4 and belonging to these light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FOURTH" in FIG. 20.

Next light emission is from the light emitting elements 2951 of the light emitting element rows R2951 located at the sub-scanning-direction position SD5 and belonging to the downstream-most light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIFTH" in FIG. 20.

The last light emission is from the light emitting elements 2951 of the light emitting element rows R2951 located at the sub-scanning-direction position SD6 and belonging to these light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SIXTH" in FIG. 20. As the first through the sixth light emitting operations are thus executed, the plural spots are formed side by side on the straight lines which extend in the main scanning direction MD.

As described above, light beams emitted from the light emitting element groups 295 impinge upon the microlenses ML after transmitted by the glass substrate 293. The microlenses ML then image the light beams on the surface of the photosensitive drum 21 (surface-to-be-scanned). In this embodiment, the glass substrate 293 and the microlenses ML function as the "imaging optical systems" of the invention, and the multiple "imaging optical systems" are disposed in one-to-one correspondence to the plural light emitting element groups 295.

As described above, the line head 29 according to this embodiment forms plural spots side by side along the main scanning direction MD. In other words, one light emitting element group 295 forms a spot row in which k (k=8 in this embodiment) spots are lined up side by side in the main scanning direction MD. A spot row will hereinafter denote k spots which are formed side by side in the main scanning direction MD by one light emitting element group 295. As the multiple light emitting element groups 295C1, 295B1, 295A1, 295C2, . . . form spot rows side by side along the main scanning direction MD, plural spots are formed side by side in the main scanning direction MD as shown in FIG. 20.

Figure 21:
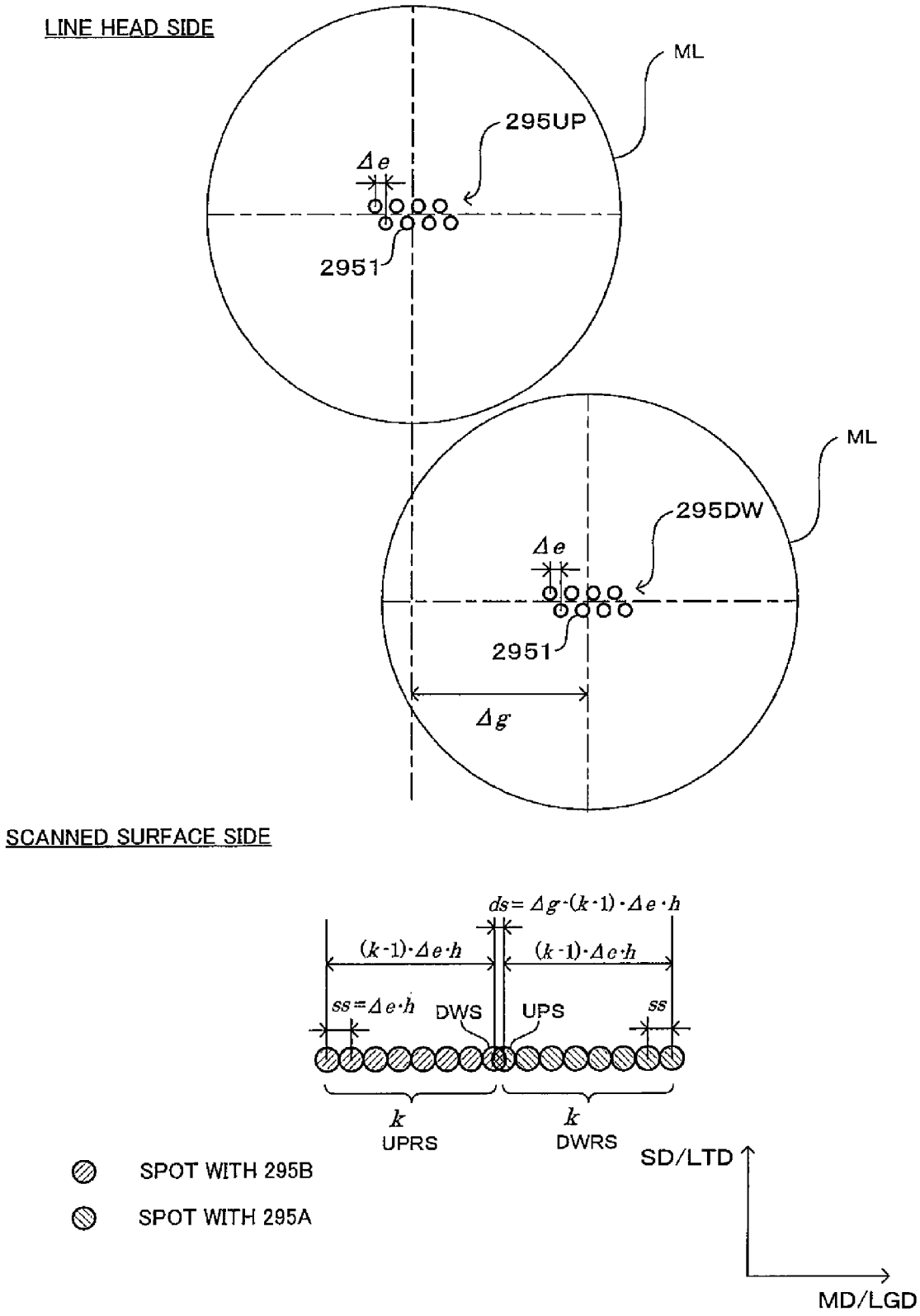
FIG. 21 is a drawing which shows spot intervals between spots which the line head according to the fourth embodiment forms.

FIG. 21 is a drawing which shows spot pitches between spots which the line head according to the fourth embodiment forms. In FIG. 21, the microlenses ML represent the imaging optical systems. Further, for easier understanding of the invention, FIG. 21 shows only two light emitting element groups 295UP and 295DW whose main-scanning-direction positions are next to each other, the upstream-side light emitting element group 295UP of which being the light emitting element group which is on the upstream side along the longitudinal direction LGD corresponding to the main scanning direction M and the downstream-side light emitting element group 295DW of which being the light emitting element group which is on the downstream side along the longitudinal direction LGD. As shown in FIG. 21, in each one of the upstream-side light emitting element group 295UP and the downstream-side light emitting element group 295DW, the k light emitting elements 2951 (k=8) are disposed at the first main-scanning-direction pitches Δe along the longitudinal direction LGD. The upstream-side light emitting element group 295UP and the downstream-side light emitting element group 295DW are disposed at the second main-scanning-direction pitch Δg along the longitudinal direction LGD. The first main-scanning-direction pitch Δe is a pitch between the main-scanning-direction positions of two light emitting elements 2951 whose main-scanning-direction positions are next to each other within the same light emitting element group 295, whereas the second main-scanning-direction pitch Δg is a pitch between the main-scanning-direction positions of two light emitting element groups 295 whose main-scanning-direction positions are next to each other. The positions of the light emitting element groups 295 herein refer to the geometric gravity points of the light emitting element groups 295.

As described above, the imaging optical systems image at the predetermined optical magnification light beams from the light emitting element groups 295UP, 295DW into spot rows on the surface-to-be-scanned. The upstream-side light emitting element group 295UP forms the spot row UPRS and the downstream-side light emitting element group 295DW forms the spot row DWRS, side by side along the main scanning direction MD. The spot row UPRS and the spot row DWRS are each formed by the k spots.

The fourth embodiment requires associating the first main-scanning-direction pitches Δe, the second main-scanning-direction pitches Δg and the absolute value h of the magnification of the imaging optical systems with each other so that they satisfy the following spots relationship. The spots relationship herein referred to is a relationship that in the two light emitting element groups 295UP, 295DW whose main-scanning-direction positions are next to each other, the downstream-most spot DWS in the upstream-side spot row UPRS formed by the upstream-side light emitting element group 295UP is located on the upstream side to the upstream-most spot UPS in the downstream-side spot row DWRS formed by the downstream-side light emitting element group 295DW and that the spot pitch ss between the downstream-most spot DWS and the upstream-most spot UPS is narrower than spot pitches ds in the spot rows UPRS, DWRS (FIG. 21). In other words, the spot pitch ss in the respective spot rows UPRS, DWRS and the spot pitch ds between the downstream-most spot DWS and the upstream-most spot UPS are both values which are determined by the first main-scanning-direction pitches Δe, the second main-scanning-direction pitches Δg and the absolute value h of the magnification of the imaging optical systems. Noting this, this embodiment requires setting the first main-scanning-direction pitches Δe, the second main-scanning-direction pitches Δg and the absolute value h of the optical magnification to appropriate values to thereby form the line head 29 so that the spot pitches ds are narrower than the spot pitches ss.

How the spot pitches ds and the spot pitches ss are calculated for the line head 29 having the structure shown in FIG. 21 will now be specifically described. The spot pitches ss in the spot rows UPRS, DWRS are yielded by the following formula:

$$ss=\Delta e\cdot h \qquad \text{(Formula 1)}$$

which requires multiplying the first main-scanning-direction pitches Δe by the absolute value h of the optical magnification. Meanwhile the spot pitch between a spot at the upstream-most location and a spot at the downstream-most location in one spot row is expressed as:

$$(k-1)\cdot\Delta e\cdot h$$

A distance between the gravity points of the two spot rows UPRS, DWRS which are side by side along the main scanning direction MD is equal to the second main-scanning-direction pitch Δg. Hence, the spot pitch ds between the downstream-most spot DWS and the upstream-most spot UPS is expressed by the following formula:

$$ds=\Delta g-(k-1)\cdot\Delta e\cdot h \qquad \text{(Formula 2)}$$

The spot pitches ss and the spot pitches ds are thus yielded by formula 1 and formula 2, respectively. Further, as these formulae indicate, the spot pitches ss and the spot pitches ds are both values which are determined by the first main-scanning-direction pitches Δe, the second main-scanning-direction pitches Δg and the absolute value h of the magnification of the imaging optical systems.

As the discussion above indicates, the spot pitch ss between two spots formed by the same light emitting element group 295 and adjacent to each other along the main scanning direction MD is a pitch which is calculated by multiplying the first main-scanning-direction pitch Δe by the absolute value h of the magnification of the imaging optical systems. In short, the spot pitch ss between two spots formed by the same light emitting element group 295 and adjacent to each other along the main scanning direction MD is determined primarily by the two factors, namely, the first main-scanning-direction pitch Δe and the absolute value h of the optical magnification. Meanwhile, the spot pitch ds between two spots formed by the different light emitting element groups 295UP, 295DW and adjacent to each other along the main scanning direction MD, namely, the spot pitch ds between the downstream-most spot DWS formed by the upstream-side light emitting element group 295UP and the upstream-most spot UPS formed by the downstream-side light emitting element group 295DW is relevant to a factor attributable to the fact that the light emitting element groups are different, besides the two factors above. A factor attributable to the fact that the light emitting element groups are different may for example be different distances from the two light emitting element groups 295UP, 295DW to the surface of the photosensitive drum 21 (the surface-to-be-scanned), etc. In this manner, the spot pitch ds between the two spots (the downstream-most spot and the upstream-most spot) formed by the different light emitting element groups 295UP, 295DW is more susceptible to more factors than the spot pitch ss between the two spots formed by the same light emitting element group 295. In short, the spot pitch ds between the two spots (the downstream-most spot and the upstream-most spot) formed by the different light emitting element groups 295UP, 295DW tends to vary more significantly than the spot pitch ss between the two spots formed by the same light emitting element group 295. Such a variation sometimes results in a defect that the downstream-most spot DWS and the upstream-most spot UPS fail to be contiguous but become discontiguous.

In contrast, the line head 29 according to the fourth embodiment requires setting the first main-scanning-direction pitches Δe, the second main-scanning-direction pitches Δg and the absolute value h of the optical magnification to appropriate values to thereby form the line head 29 so that the spot pitches ds are narrower than the spot pitches ss. Hence, the line head 29 according to the invention is capable of suppressing occurrence of a defect that the downstream-most spot DWS and the upstream-most spot UPS fail to be contiguous but become discontiguous, and hence, of forming favorable spots.

Further, the image forming apparatus according to the fourth embodiment uses the line head 29 described above as the exposure section. This makes it possible to discourage occurrence of a defect that the downstream-most spot DWS and the upstream-most spot UPS fail to be contiguous but become discontiguous, and permits forming an image with favorable spots.

For instance, although the fourth embodiment does not refer to a specific numerical value as the absolute value h of the optical magnification of the imaging optical systems, the absolute value h of the optical magnification may be greater than 1. This is because such a structure works to an advantage in satisfying the above spots relationship and more securely suppresses occurrence of a defect that the downstream-most spot DWS and the upstream-most spot UPS fail to be contiguous but become discontiguous, which is preferable.

Further, according to the fourth embodiment, one light emitting element group 295 is formed by arranging in the lateral direction LTD two light emitting element trains R2951 each formed by four light emitting elements 2951 which are lined up in longitudinal direction LGD (FIG. 19). In addition, the embodiment above requires arranging two lens rows RML along the sub scanning direction SD. However, the structure of the light emitting element group 295, the arrangement of the lens rows RML and the like are not limited to this but may be as described below for instance.

Fifth Embodiment

Figure 22:
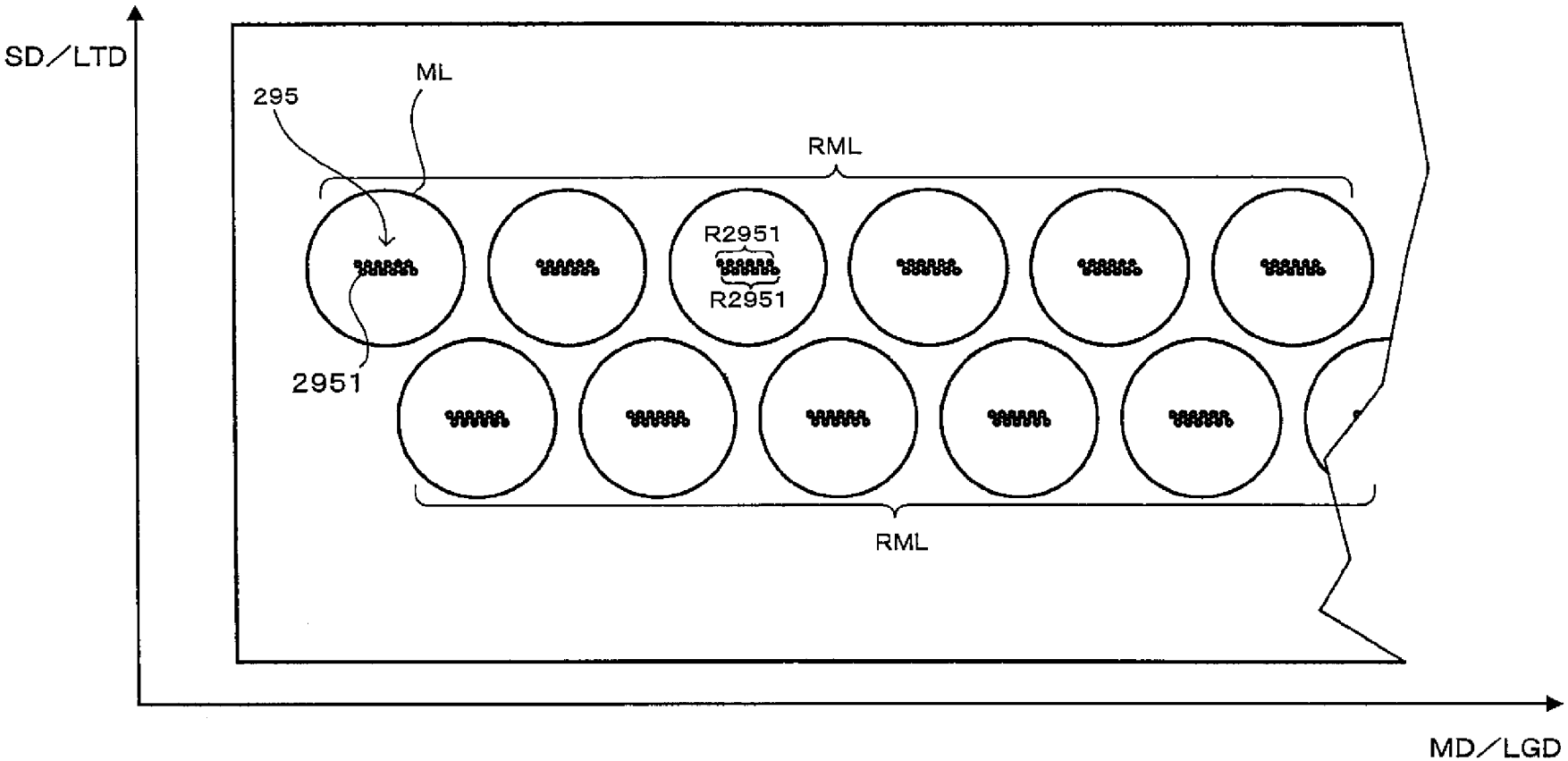
FIG. 22 is a drawing which shows a line head according to a fifth embodiment of the invention.

FIG. 22 is a drawing which shows a line head according to a fifth embodiment of the invention. The embodiment illustrated in FIG. 22 demands arranging in the lateral direction LTD corresponding to the sub scanning direction SD two light emitting element trains R2951 each formed by six light emitting elements 2951 which are lined up in the longitudinal direction LGD corresponding to the main scanning direction MD, thereby forming the light emitting element groups 295. Further, there are three lens rows RML along the sub scanning direction SD. The line head having this structure as well achieves the effect of the invention described above. That is, as the first main-scanning-direction pitches Δe, the second main-scanning-direction pitches Δg and the absolute value h of the optical magnification are set so that the spot pitches ds are narrower than the spot pitches ss, it is possible to suppress occurrence of a defect that the downstream-most spot DWS and the upstream-most spot UPS fail to be contiguous but become discontiguous, and hence, to form favorable spots.

In addition, the light emitting element groups 295 are formed by plural organic ELs which are provided on the back surface of the glass substrate 293 according to the fourth and fifth embodiments. However, the structure of the light emitting element groups 295 is not limited to this but may be as described below for instance.

Sixth Embodiment

Figure 23:
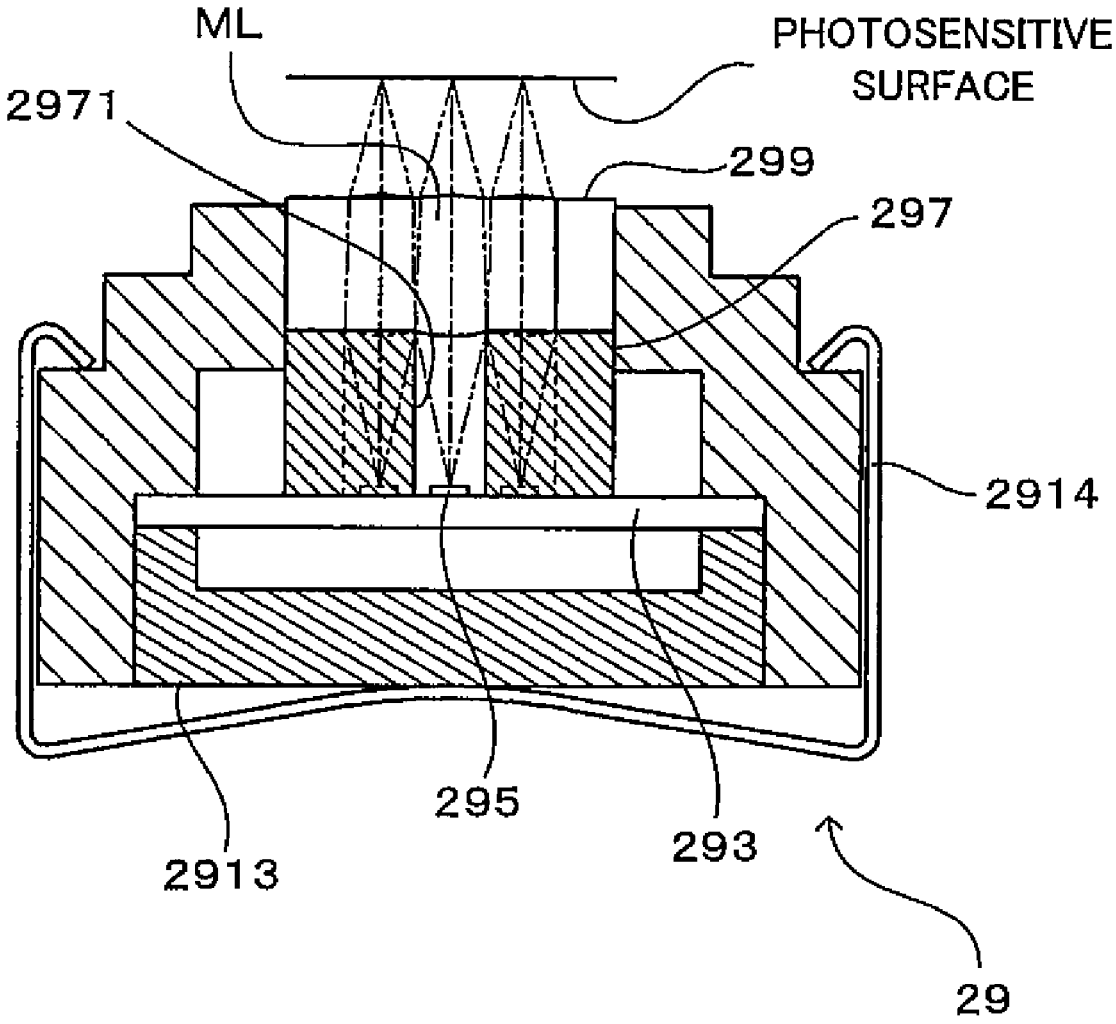
FIG. 23 is a drawing which shows a line head according to a sixth embodiment of the invention.

FIG. 23 is a drawing which shows a line head according to a sixth embodiment of the invention. The embodiment illustrated in FIG. 23 requires forming the light emitting element groups 295 on the front surface of the glass substrate 293 (which is one of the two surfaces of the glass substrate 293 which is closer to the microlens array 299). Further, the light emitting element groups 295 may be formed by LEDs (Light Emitting Diodes) for instance. In the line head 29 having the structure described above, light beams emitted from the light emitting element groups 295 impinge upon the microlenses ML directly without getting transmitted by the glass substrate 293. The light beams impinging upon the microlenses ML are then imaged at the predetermined optical magnification (i.e., the optical magnification of the microlenses ML) on the surface of the photosensitive drum 21. In short, according to the embodiments shown in FIG. 23, the microlenses ML function as the "imaging optical systems" of the invention. Hence, where the absolute value h of the optical magnification of the microlenses ML, the first main-scanning-direction pitches Δe and the second main-scanning-direction pitches Δg are set so that the spot pitches ds are narrower than the spot pitches ss, it is possible to suppress occurrence of a defect that the downstream-most spot DWS and the upstream-most spot UPS fail to be contiguous but become discontiguous, and hence, to form favorable spots.

As described in the fourth to sixth embodiments, the line head having the structure described above comprises plural light emitting element groups and plural imaging optical systems which are disposed in one-to-one correspondence to the plural light emitting element groups. Multiple light emitting elements are at first main-scanning-direction pitches in each light emitting element group, and the plural light emitting element groups are disposed at second main-scanning-direction pitches. The first main-scanning-direction pitches are pitches between the main-scanning-direction positions of two adjacent light emitting elements whose main-scanning-direction positions are next to each other and which belongs to the same light emitting element group, and the second main-scanning-direction pitches are pitches between the main-scanning-direction positions of two light emitting element groups whose main-scanning-direction positions are next to each other. The main-scanning-direction positions are the positions of objects (light emitting elements or light emitting element groups) along the longitudinal direction corresponding to the main scanning direction. The line head described above images, by means of its imaging optical systems, light beams emitted from the associated light emitting element groups at a predetermined optical magnification and forms spots on a surface-to-be-scanned. This spot forming operation performed by the line head will be now described in detail.

Using the plural light emitting element groups disposed at the second main-scanning-direction pitches, the line head described above forms multiple spots adjacent to each other on a surface-to-be-scanned. Let a consideration be given on spots which are created by two light emitting element groups which are at the second main-scanning-direction pitch, namely, the two light emitting element groups whose main-scanning-direction positions are at the second main-scanning-direction pitch. Of the two light emitting element groups, the group on the upstream side along the main scanning direction will be referred to as the upstream-side light emitting element group and the group on the downstream side along the main scanning direction will be referred to as the downstream-side light emitting element group. On the surface-to-be-scanned, the upstream-side light emitting element group forms plural spots lined up in the main scanning direction (namely, an upstream-side spot row), and on the downstream side to the upstream-side spot row, the downstream-side light emitting element group forms plural spots lined up in the main scanning direction (namely, a downstream-side spot row). The pitches between thus formed plural spots have the following characteristic due to the group structure of the light emitting element described above.

The pitch between two spots which are adjacent to each other in the main scanning direction and formed by the same light emitting element group is a pitch which is calculated by multiplying the first main-scanning-direction pitch by the optical magnification of the associated imaging optical system. In other words, the pitch between two spots which are adjacent to each other in the main scanning direction and formed by the same light emitting element group is determined by the two factors, one being the first main-scanning-direction pitch and the other being the optical magnification. On the contrary, the pitch between two spots which are adjacent to each other in the main scanning direction and formed by the different light emitting element groups, namely, the pitch between the downstream-most spot formed by the upstream-side light emitting element group and the upstream-most spot formed by the downstream-side light emitting element group is relevant to a factor attributable to the fact that the light emitting element groups are different, besides the two factors above. The downstream-most spot is the spot located at the downstream-most position in the upstream-side spot row formed by the upstream-side light emitting element group, and the upstream-most spot is the spot located at the upstream-most position in the downstream-side spot row formed by the downstream-side light emitting element group. A factor attributable to the fact that the light emitting element groups are thus different may for example be different distances from the two light emitting element groups to the surface-to-be-scanned. In this manner, the pitch between two spots (the downstream-most spot and the upstream-most spot) formed by different light emitting element groups is more susceptible to more factors than the pitch between two spots formed by the same light emitting element group. In short, the pitch between two spots (the downstream-most spot and the upstream-most spot) formed by different light emitting element groups tends to vary more as compared to the pitch between two spots formed by the same light emitting element group. Such a variation sometimes results in a defect that the downstream-most spot and the upstream-side most fail to be contiguous but become discontiguous.

In contrast, the line head according to the invention satisfies the following spots relationship between the first main-scanning-direction pitches, the second main-scanning-direction pitches and the optical magnification. The spots relationship herein referred to is a relationship that in two light emitting element groups whose main-scanning-direction positions are next to each other, the downstream-most spot in an upstream-side spot row formed by the light emitting element group which is on the upstream side along the main scanning direction is located on the upstream side to the upstream-most spot in a downstream-side spot row formed by the light emitting element group which is on the downstream side along the main scanning direction and that the pitch between the downstream-most spot and the upstream-most spot is narrower than spot pitches in each spot row. The line head according to the invention can therefore suppress occurrence of a defect that the downstream-most spot and the upstream-most spot fail to be contiguous but become discontiguous, which realizes creation of favorable spots.

The absolute value of the magnification of the imaging optical systems may be greater than 1. This is because such a structure works to an advantage in satisfying the above spots relationship and more securely suppressing occurrence of a defect that the downstream-most spot and the upstream-most spot fail to be contiguous but become discontiguous, which is preferable.

The image forming apparatus according to the fourth to six embodiments of the invention comprises a latent image carrier whose surface is transported along a sub scanning direction and an exposure section having the same structure as that of the line head described above which treats the surface of the latent image carrier as a surface-to-be-scanned and creates spots on the surface of the latent image carrier. It is therefore possible to discourage occurrence of a defect that the downstream-most spot and the upstream-side most fail to be contiguous but become discontiguous, and hence, to form an image using favorable spots.

Seventh Embodiment

Figure 24:
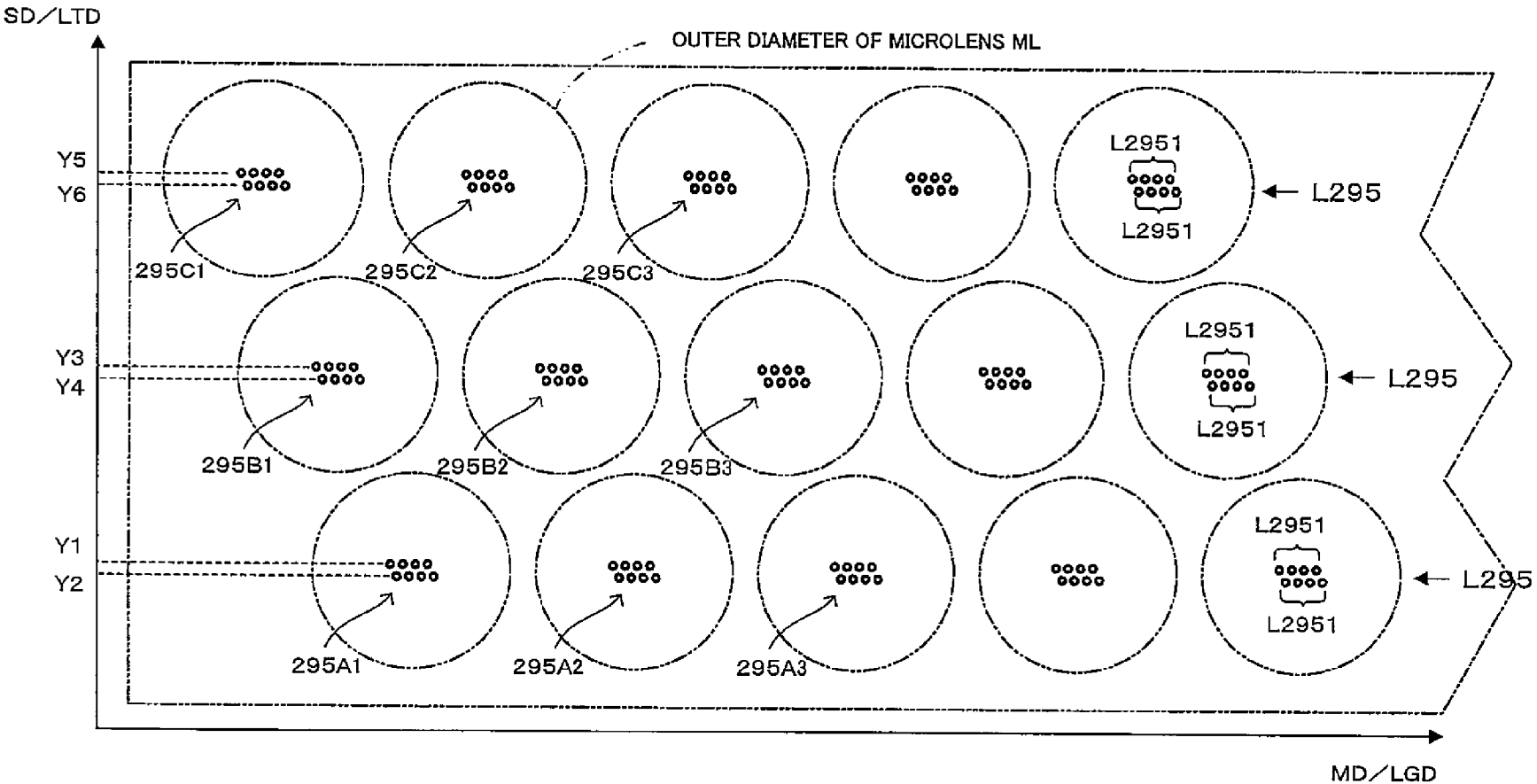
FIG. 24 is a drawing which shows the arrangement of the multiple light emitting element groups in a seventh embodiment.

FIG. 24 is a drawing which shows the arrangement of the multiple light emitting element groups in a seventh embodiment. This embodiment requires arranging along the lateral direction LTD corresponding to the sub scanning direction SD two light emitting element rows L2951, each formed by four light emitting elements 2951 which are lined up equidistant from each other along the longitudinal direction LGD corresponding to the main scanning direction MD, which forms one light emitting element group 295. That is, eight light emitting elements 2951, which correspond to the microlens ML denoted at the double-dot lines in FIG. 24, constitute one light emitting element group 295. The multiple light emitting element groups 295 are arranged in the following manner.

In other words, the multiple light emitting element groups 295 are disposed in a two-dimensional arrangement so that three light emitting element group rows L295 (group rows), each formed by a predetermined number of (two or more) light emitting element groups 295 which are arranged along the longitudinal direction LGD, are lined up along the lateral direction LTD. All light emitting element groups 295 are located at main-scanning-direction positions which are different from each other. Further, the multiple light emitting element groups 295 are disposed in such a manner that the sub-scanning-direction positions of those light emitting element groups whose main-scanning-direction positions are next to each other (e.g., a light emitting element group 295C1 and a light emitting element group 295B1) are different from each other. The geometric gravity points of the light emitting elements 2951 are herein treated as the positions of the light emitting elements 2951. Hence, a distance between two light emitting elements is a distance between the geometric gravity points of these light emitting elements. In addition, what is herein referred to as the "geometric gravity point of the light emitting element group" are the geometric gravity point of all light emitting elements which belong to the same light emitting element group 295. Further, main-scanning-direction positions and sub-scanning-direction positions mean main-scanning-direction components and sub-scanning-direction components at target positions.

The light guiding holes 2971 are formed in the light blocking member 297 at positions which correspond to how the light emitting element groups 295 are arranged, and the lens pairs formed by the lenses 2993A and 29933 are disposed. That is, in this embodiment, the gravity positions of the light emitting element groups 295, the central axes of the light guiding holes 2971 and the optical axes OA of the lens pairs formed by the lenses 2993A and 2993B approximately coincide with each other. Light beams emitted from the light emitting elements 2951 of the light emitting element groups 295 impinge upon the microlens array 299 via the corresponding light guiding holes 2971, and are imaged by the microlens array 299 as spots on the surface of the photosensitive drum 21.

Figure 25:
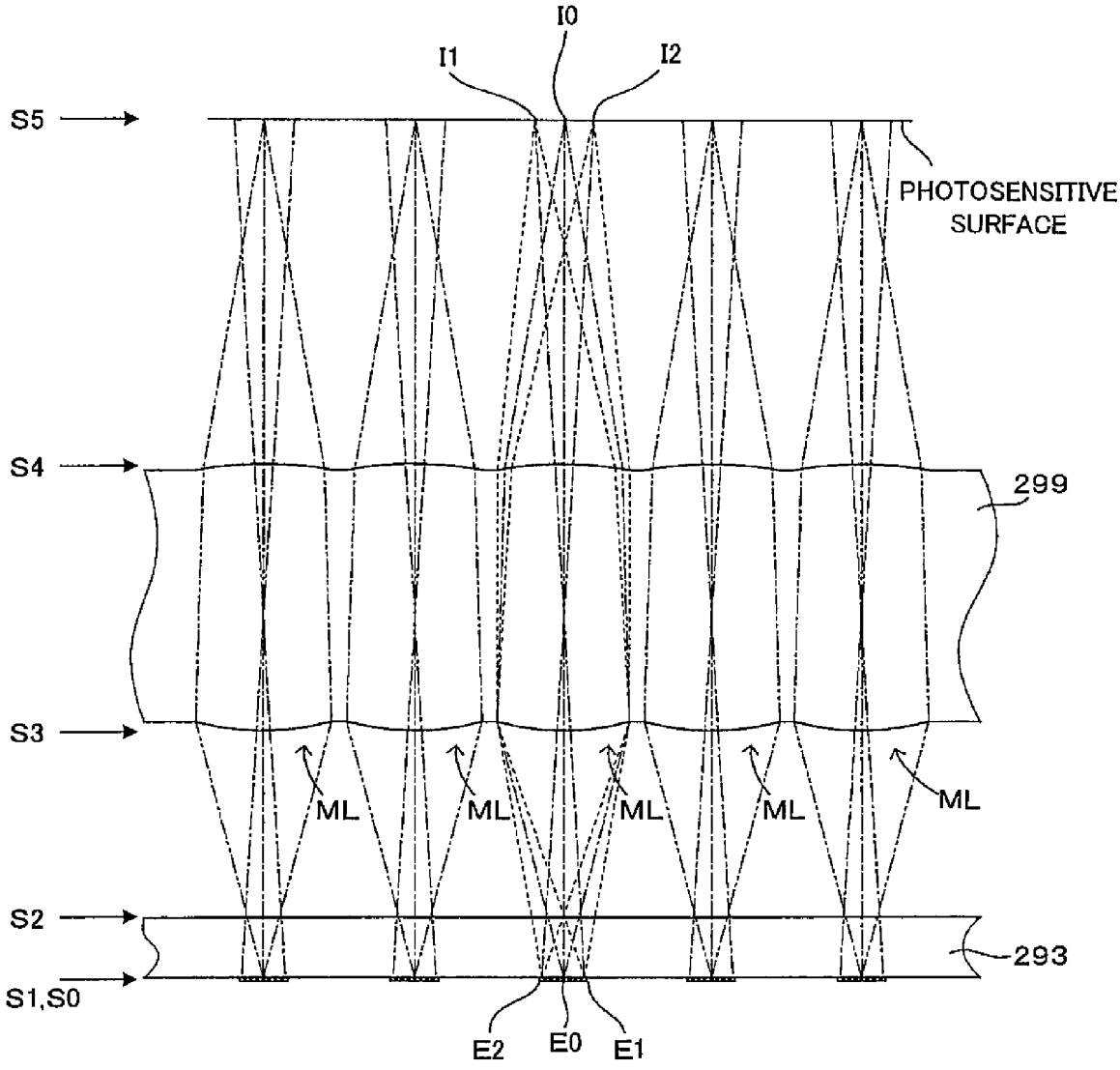
FIG. 25 is a drawing which shows how the microlens array forms an image according to the seventh embodiment.

FIG. 25 is a drawing which shows how the microlens array forms an image according to the seventh embodiment. For the purpose of illustrating the imaging characteristic of the microlens array 299, FIG. 25 shows the geometric gravity points E0 of the light emitting element groups 295 and the trajectories of light beams emitted from the positions E1 and E2 which are away by predetermined gaps from the geometric gravity points E0. As the trajectories indicate, the light beams emitted from the respective positions, after impinging upon the back surface of the glass substrate 293, exit the front surface of the glass substrate 293. The light beams leaving the front surface of the glass substrate 293 thereafter reach the surface of the photosensitive drum (surface-to-be-scanned) via the microlens array 299.

As FIG. 25 shows, the light beams coming from the geometric gravity points E0 of the light emitting element groups are imaged at intersections I0 of the surface of the photosensitive drum 21 and the optical axes OA of the lens pairs formed by the lenses 2993A and 2993B. This is because the geometric gravity points E0 of the light emitting element groups 295 (namely, the positions of the light emitting element groups 295) are on the optical axes OA of the lens pairs formed by the lenses 2993A and 2993B in this embodiment as described above. Meanwhile, the light beams coming from the positions E1 and E2 are imaged respectively at positions I1 and I2 on the surface of the photosensitive drum 21. In short, the light beams coming from the positions E1 are imaged at the positions I1 which are on the opposite side to the optical axes OA of the lens pairs formed by the lenses 2993A and 2993B along the main scanning direction MD, and the light beams coming from the positions E2 are imaged at the positions I2 which are on the opposite side to the optical axes OA of the lens pairs formed by the lenses 2993A and 2993B along the main scanning direction MD. Imaging lenses formed by the lens pairs of the lenses 2993A and 2993B sharing the common optical axes and the glass substrate 2991 located between the lenses of the pairs thus serve as so-called inverting optical systems which exhibit an inversion characteristic.

Further, as shown in FIG. 25, distances between the positions I1 and I0 at which the light beams are imaged are longer than distances between the positions E0 and E1. That is, the absolute value of the magnification (optical magnification) of the imaging lenses exceeds "1" in the seventh embodiment, which means that the optical systems according to this embodiment are so-called expanding optical systems which exhibit an expansion characteristic. In this embodiment, the microlens ML, which are the optical systems formed by the lens pairs formed by the lenses 2993A and 2993B sharing the common optical axes and the glass substrate 2991 located between the lenses of the pairs, function as the "imaging lenses" of the invention. Further, the microlens array 299 formed by the plural microlenses ML corresponds to the "imaging optical system" of the invention.

The microlenses (imaging lenses) ML may be those which exhibit optical properties shown in Table 1 and lens data shown in Table 2 for instance. In this example, organic EL elements of the bottom-emission type are used as the light emitting elements which form the line head. As described in relation to the embodiment above, the organic EL elements are provided on the back surface of the glass substrate 293. The light emitting surfaces (bearing the surface number S1) of the light emitting elements and the back surface (bearing the surface number S2) of the glass substrate 293 are opposed to each other with a surface clearance of 0.

TABLE 1

DATA OF OPTICAL SYSTEM

| ITEM | SYMBOL | VALUE |
|---|---|---|
| WAVELENGTH | λ | 760 nm |
| DIAMETER OF LIGHT EMITTING ELEMENT | d | 30 μm |
| OPTICAL MAGNIFICATION | β | 2 |

TABLE 2

LENS DATA

UNIT [mm]

| SURFACE NUMBER | SURFACE TYPE | RADIUS OF CURVATURE | SURFACE INTERVAL | REFRACTIVE INDEX |
|---|---|---|---|---|
| S1 (OBJECT PLANE) | | ∞ | 0 | |
| S2 | PLANE | ∞ | 0.5 | nd = 1.51680, vd = 64.2 |
| S3 | PLANE | ∞ | 0.6 | |
| S4 | SPHERICAL SURFACE | 0.57 | 3.323644 | nd = 1.54041, vd = 51.1 |
| S5 | SPHERICAL SURFACE | −1.03 | 2 | |
| S6 (IMAGE PLANE) | | | 0 | |

Light beams from the positions E0 on the object surface are imaged at the positions I0 on the surface-to-be-scanned (image surface) via the glass substrate 293 and the microlens array 299. Meanwhile, light beams from the positions E1 on the object surface are imaged at the positions I1 on the surface-to-be-scanned (image surface) via the glass substrate 293 and the microlens array 299. The positions E0 and the positions E1 are both on the optical axes of the microlenses ML. As FIG. 25 shows, distances between the positions I0 and the positions I1 on the image surface are wider than distances between the positions E0 and the positions E1 on the object surface. In short, the absolute value of the optical magnification of the imaging lens formed by the glass substrate 293 and the microlens array 299 exceeds 1, and more specifically, is 2.

Figure 26:
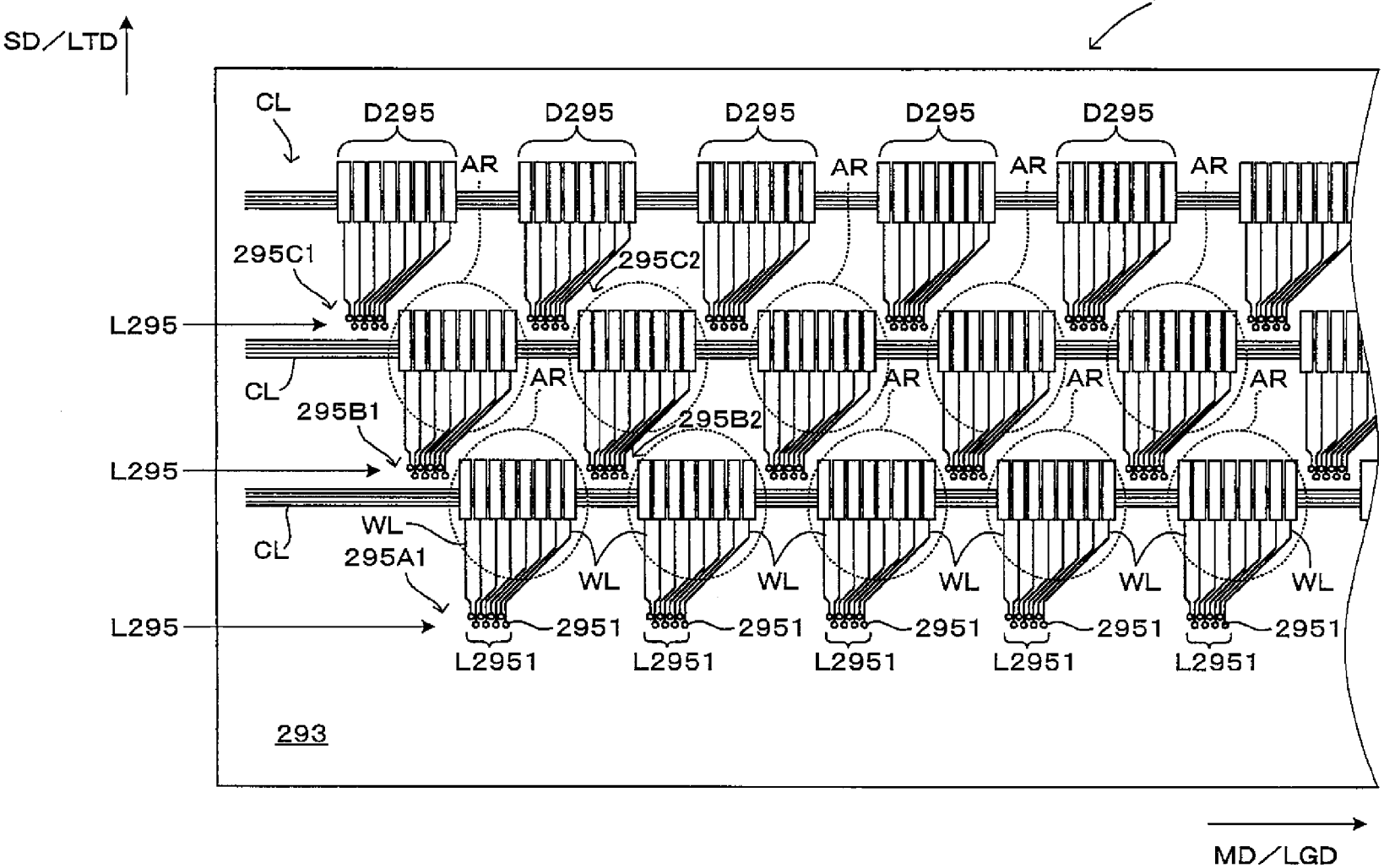
FIG. 26 is a drawing which shows the arrangement of and the interconnections for the respective sections of the line head in the seventh embodiment.

FIG. 26 is a drawing which shows the arrangement of and the interconnections for the respective sections of the line head in the seventh embodiment. The arrangement of the driver circuits which drive the respective light emitting elements, the interconnections electrically connecting the driver circuits with the light emitting elements, control signal lines which control the light emitting elements will now be described with reference to FIG. 26. In this embodiment, the multiple light emitting element groups 295 are disposed in a two-dimensional arrangement so that three group rows L295, each formed by four light emitting element groups 295 along the main scanning direction MD, are lined up but spaced apart from each other along the sub scanning direction SD. The multiple light emitting elements 2951 belonging to the same light emitting element group 295 are disposed in a two-dimensional arrangement so that the group trains L2951, each formed by four light emitting elements 2951 along the main scanning direction MD, are lined up but spaced apart from each other along the sub scanning direction SD. The multiple light emitting element groups 295 are thus disposed in a two-dimensional arrangement. This permits large expansion of clearance areas AR enclosed by the multiple light emitting element groups 295 on the substrate.

Noting this, this embodiment requires disposing within the clearance areas AR portions of the driver circuits D295, which comprise TFTs (Thin Film Transistors) driving the light emitting elements 2951, and portions of interconnections WL which electrically connect the driver circuits D295 with the light emitting elements 2951. The clearance area AR surrounded by the light emitting element groups 295C1, 295C2 and 295B1 for instance contains, within the intergroup area held between the light emitting element groups 295C1 and 295C2, the driver circuit (TFT) D295 which drives the light emitting element group 295B1, and the interconnection WL electrically connects the driver circuit D295 with the light emitting element group 295B1. In other clearance areas AR as well, the driver circuits D295 and the interconnections WL are provided in a similar manner to that described above. The inter-group areas within the clearance areas AR are thus areas held between two adjacent light emitting element groups 295 in the group rows L295, and contained within the inter-group areas are some of the driver circuits which drive the light emitting elements which form one of the group trains. Let a discussion now be given on this with a focus upon the group row L295 which is formed by the light emitting element groups 295C1, 295C2, . . . for example.

In this group row L295, the plural driver circuits D295 are disposed as they are held between the light emitting element groups 295C1, 295C2, . . . , in the inter-group areas contained in the respective clearance areas AR. These driver circuits D295 are circuits which drive the light emitting elements 2951 of the light emitting element groups 295B1, . . . which form the next group row L295. In the respective clearance areas AR, the interconnections WL electrically connecting these driver circuits D295 with the light emitting element groups 295B1, . . . are also provided. To be noted as for this embodiment, the driver circuits D295 and the light emitting element groups 295B1, . . . are arranged so as to be opposed to each other within the clearance areas AR as shown in FIG. 26. This shortens the distances from the driver circuits D295 to the associated light emitting elements 2951 and shortens the interconnections WL which electrically connect them together. This realizes an efficient use of the clearance areas AR, which works to an advantage in reducing the size of the line head 29 and enhancing the resolution.

Further, in this embodiment, control signal lines CL for transmitting a control signal which controls the light emitting elements 2951 is connected with the driver circuits D295. As shown in FIG. 26, the respective control signal lines CL extend along the main scanning direction MD between the mutually adjacent group rows L295. For instance, it is the control signal line CL at the center in FIG. 26 that is connected with the driver circuit D295 which drives the light emitting element groups 295B1, . . . . This interconnection structure minimizes the control signal lines CL. In short, this interconnection structure permits an efficient use of the clearance areas AR, which works to an advantage in reducing the size of the line head 29 and enhancing the resolution.

Figure 27:
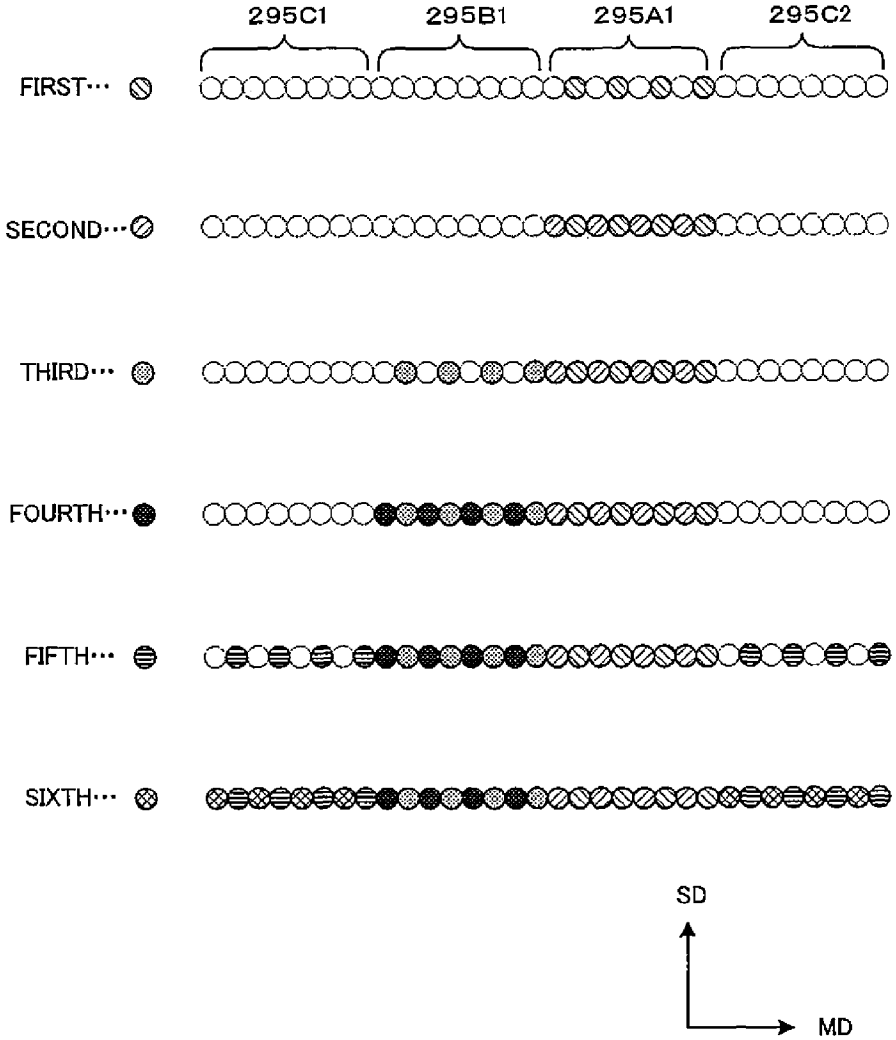
FIG. 27 is a drawing which shows a spot forming operation with using the line head according to the seventh embodiment.

FIG. 27 is a drawing which shows a spot forming operation with using the line head according to the seventh embodiment. The spot forming operation by the line head according to this embodiment will now be described with reference to FIGS. 2, 24 and 27. For easy understanding of the invention, the following is dedicated to an instance that plural spots are formed side by side on a straight line which extends in the main scanning direction MD. In the first embodiment, the head control module 400 makes the multiple light emitting elements emit light at predetermined timing while the surface (surface-to-be-scanned) of the photosensitive drum 21 (latent image carrier) is being transported in the sub scanning direction SD, thereby forming plural spots side by side on a straight line which extends in the main scanning direction MD.

In other words, there are six light emitting element rows L2951 lined up along the sub scanning direction SD within the line head according to the first embodiment such that they correspond to the sub-scanning-direction positions Y1 to Y6, respectively (FIG. 24). Noting this, in this embodiment, the light emitting element rows L2951 located at the same sub-scanning-direction position emit light approximately the same timing while light emission from the light emitting element rows L2951 located at the different sub-scanning-direction positions is timed differently. Describing this in more specific details, the light emitting element rows L2951 emit light while taking turns in the order of the sub-scanning-direction positions Y1 to Y6. As the light emitting element rows L2951 emit light in this order while the surface of the photosensitive drum 21 is being transported in the sub scanning direction SD, plural spots are formed side by side on a straight line which extends in the main scanning direction MD.

This operation will now be described with reference to FIGS. 10 and 24. First light emission is from the light emitting elements 2951 of the light emitting element rows L2951 located at the sub-scanning-direction position Y1 and belonging to the upstream-most light emitting element groups 295A1, 295A2, 295A3, . . . along the sub scanning direction SD. Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIRST" in FIG. 27. In FIG. 27, the white circles denote future spots yet to be formed. Meanwhile, the spots denoted at 295C1, 295B1, 295A1 and 295C2 in FIG. 27 are spots formed by the light emitting element groups 295 which correspond to these reference symbols.

Next light emission is from the light emitting elements 2951 of the light emitting element rows L2951 located at the sub-scanning-direction position Y2 and belonging to the upstream-most light emitting element groups 295A1, 295A2, 295A3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SECOND" in FIG. 27. The reason why light emission starts at the downstream light emitting element rows L2951 along the sub scanning direction SD (i.e., in the order of the sub-scanning-direction positions Y1 and Y2) while the transportation direction of the surface of the photosensitive drum 21 is the sub scanning direction SD is because the "imaging lenses" exhibit the inversion characteristic.

Next light emission is from the light emitting elements 2951 of the light emitting element rows L2951 located at the sub-scanning-direction position Y3 and belonging to the second upstream-most light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "THIRD" in FIG. 27.

Next light emission is from the light emitting elements 2951 of the light emitting element rows L2951 located at the sub-scanning-direction position Y4 and belonging to these light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FOURTH" in FIG. 27.

Next light emission is from the light emitting elements 2951 of the light emitting element rows L2951 located at the sub-scanning-direction position Y5 and belonging to the downstream-most light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIFTH" in FIG. 27.

The last light emission is from the light emitting elements 2951 of the light emitting element rows L2951 located at the sub-scanning-direction position Y6 and belonging to these light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SIXTH" in FIG. 27. As the first through the sixth light emitting operations are thus executed, the plural spots are formed side by side on the straight lines which extend in the main scanning direction MD.

As described above, in the seventh embodiment, the multiple light emitting element groups 295 are disposed in a two-dimensional arrangement and the microlenses ML (imaging lenses) which are expanding optical systems, and image light the beams emitted from the respective light emitting element groups 295 on the surface of the photosensitive drum (surface-to-be-scanned). This expands the intervals between the light emitting element groups 295 on the substrate 293, whereby the clearance areas AR are relatively large. In the respective clearance areas AR, the driver circuits D295, the interconnections WL and the like are disposed. Hence, even when more light emitting elements 2951 are provided in an attempt to enhance the resolution, it is possible to ensure a sufficient space for the driver circuits, a sufficient interconnection space and the like on the substrate 293 without enlarging the size of the substrate. It is therefore possible to satisfy the needs for size reduction of the line head 29 and a higher resolution at the same time. Further, use of such a line head 29 attains size reduction of apparatus as well.

Figure 28:
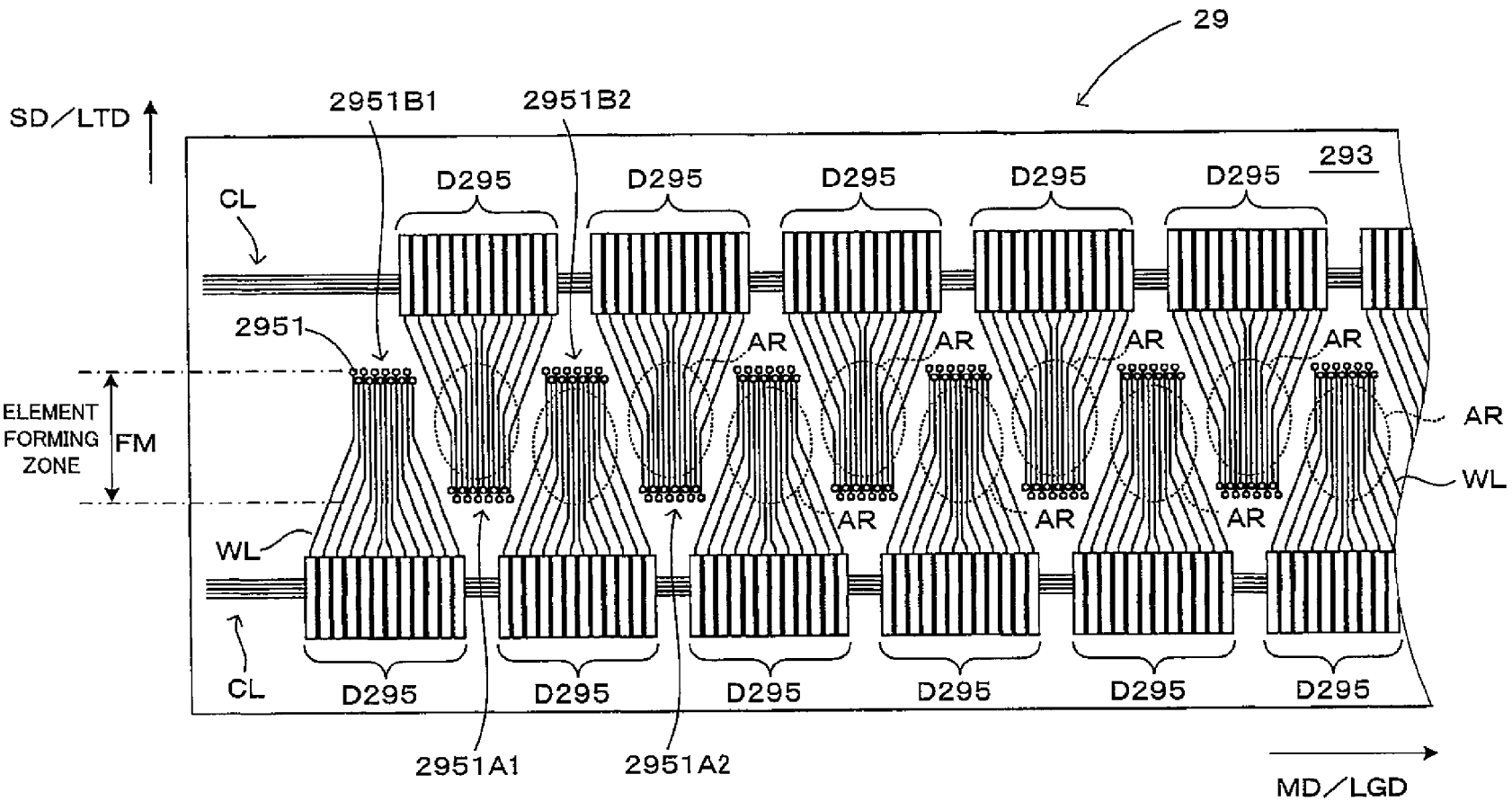
FIG. 28 is a drawing which shows the arrangement of interconnections, driver circuits and the like in the line head.

Although the seventh embodiment require forming the light emitting element groups 295 in the manner shown in FIG. 24, the structure of the light emitting element groups 295 is not limited to this. The important benefit is that the light emitting element groups 295 including the light emitting element rows L2951 are formed as two or more light emitting elements 2951 are lined up side by side along the main scanning direction MD, and the clearance areas AR are secured as these light emitting element groups 295 are disposed in a two-dimensional arrangement. For further expansion of the clearance areas AR, the microlenses ML may be formed by expanding optical systems. Relatively large clearance areas AR are created owing to the combination of the two-dimensional arrangement of the light emitting element groups 295 and the microlenses ML which are expanding optical systems. As shown in FIG. 28 for instance, (6×2) light emitting element groups 295 may form group rows which extend in the main scanning direction MD, and only two such group rows may be provided to thereby arrange the light emitting element groups 295 in a two-dimensional arrangement within the element forming zone FM.

The locations at which the driver circuits D295 are disposed are not limited to the clearance areas AR: as shown in FIG. 28 for example, the driver circuits D295 may be disposed adjacent to the element forming zone FM. Disposing the driver circuits D295 in one-to-one correspondence to the light emitting element groups 295 such that they are opposed to each other in particular makes it possible to shorten the interconnections WL which electrically connect them together and install the interconnections WL efficiently within the clearance areas AR. This realizes size reduction of and an improved resolution of the line head 29. Instead of the driver ICs, for instance, correction circuits for adjusting the time at which the light emitting elements 2951 are turned on, shift registers or the like may be used as the driver circuits D295.

Although the microlenses ML (imaging lenses) which are expanding optical systems are lenses whose optical magnification is 2 in the embodiment above, the structure of the microlens ML is not limited to this, but other expanding optical systems may be used instead. For instance, the microlenses (imaging lenses) ML may be those exhibiting optical properties shown in Table 3 and lens data shown in Table 4.

TABLE 3

DATA OF OPTICAL SYSTEM

| ITEM | SYMBOL | VALUE |
|---|---|---|
| WAVELENGTH | λ | 760 nm |
| DIAMETER OF LIGHT EMITTING ELEMENT | d | 30 μm |
| OPTICAL MAGNIFICATION | β | 1.5 |

TABLE 4

LENS DATA

UNIT[mm]

| SURFACE NUMBER | SURFACE TYPE | RADIUS OF CURVATURE | SURFACE INTERVAL | REFRACTIVE INDEX |
|---|---|---|---|---|
| S1 (OBJECT PLANE) | | ∞ | 0 | |
| S2 | PLANE | ∞ | 0.5 | nd = 1.51680, vd = 64.2 |
| S3 | PLANE | ∞ | 0.84 | |
| S4 | SPHERICAL SURFACE | 0.76 | 3.256971 | nd = 1.54041, vd = 51.1 |
| S5 | SPHERICAL SURFACE | −0.98 | 2 | |
| S6 (IMAGE PLANE) | | | 0 | |

In this structure according to the seventh embodiment, the plural light emitting element groups are in a two-dimensional arrangement, and the imaging lenses are disposed corresponding to the light emitting element groups. That is, as many imaging lenses as the light emitting element groups are disposed, and the plural light emitting element groups are in one-to-one correspondence to the plural imaging lenses. As the light emitting elements forming each light emitting element group emit light beams, the imaging lens corresponding to the light emitting element group image the light beams on the surface-to-be-scanned and spots are formed. Such a two-dimensional arrangement of the light emitting element groups ensures wider intervals between the adjacent light emitting element groups than where the light emitting element groups are disposed linearly. Further, according to the seventh embodiment, the imaging lenses have an optical magnification exceeding 1. In short, the imaging lenses are expanding optical systems. The intervals at which the light emitting element groups are disposed on the substrate are therefore wide. Interconnections are disposed between these light emitting element groups. Hence, even when more light emitting elements are disposed in an attempt to enhance the resolution, it is possible to ensure a sufficient interconnection space on the substrate without enlarging the size of the substrate. It is therefore possible to satisfy the needs for size reduction of the line head and a higher resolution at the same time.

Alternatively, the driver circuits may be disposed partially or in their entirety within clearance areas which are enclosed by plural adjacent light emitting element groups. With the driver circuits thus provided in the clearance areas, the size of the line head is further reduced. The clearance areas include inter-group areas which are located between two light emitting element groups which are adjacent to each other in a group row. The inter-group areas may contain some of the driver circuits which drive the light emitting elements forming other group row which is next to this group row. Disposing the driver circuits in this manner shortens the distances from the light emitting elements which these driver circuits drive and attains an efficient use of the interconnection space. This further reduces the size of the line head and enhances the resolution.

Meanwhile, a control signal line for transmission of a control signal which controls the light emitting elements may sometimes be connected with the driver circuits. In such an instance, it is preferable that the control signal line extends in a main scanning direction across mutually adjacent group rows. This is because use of such an interconnection structure best shortens the control signal line and reduces the interconnection space for installing the control signal line, which greatly contributes to size reduction of the line head and improvement of the resolution.

Alternatively, the driver circuits may be disposed next to an element forming zone in which the multiple light emitting element groups are formed. This arrangement shortens distances between the light emitting elements and the driver circuits, which further reduces the size of the line head and attains an even higher resolution.

While LEDs (Light Emitting Diodes) or the like may be used as the light emitting elements, use of organic EL elements of the bottom-emission type in particular as the light emitting elements makes the invention extremely useful. This is because a transparent substrate of glass or the like is used as the substrate in relation to use of organic EL elements and the light emitting elements are provided on the back surface of the transparent substrate. Light beams emitted from the light emitting elements are transmitted by the transparent substrate and then head for imaging lenses from the front surface of the substrate. To this end, the light emitting elements should never overlap the interconnections, the driver circuits and the like in a plane arrangement, as such a restriction upon the arrangement is one of principal factors which increase the size of the line head. In contrast, the invention makes it possible to reduce the size of the line head while clearing this restriction.

Further, for each one of the light emitting element groups, plural light emitting element trains may be disposed as they are spaced apart from each other in a sub scanning direction and plural light emitting elements may be arranged in a two-dimensional arrangement. This widens the intervals between the light emitting elements which form the light emitting element trains, and enhances the freedom regarding the arrangement of the interconnections, the driver circuits and the like in the clearance areas.

The image forming apparatus according to the seventh embodiment is characterized in comprising a latent image carrier whose surface is transported along the sub scanning direction and an exposure section having the same structure as that of the line head described above which treats the surface of the latent image carrier as the surface-to-be-scanned and creates spots on the surface of the latent image carrier. Due to such a compact line head having a high resolution described above mounted to the image forming apparatus having this structure, it is possible to form an image at a high resolution despite the compact size of the image forming apparatus.

Eighth Embodiment

Figure 29:
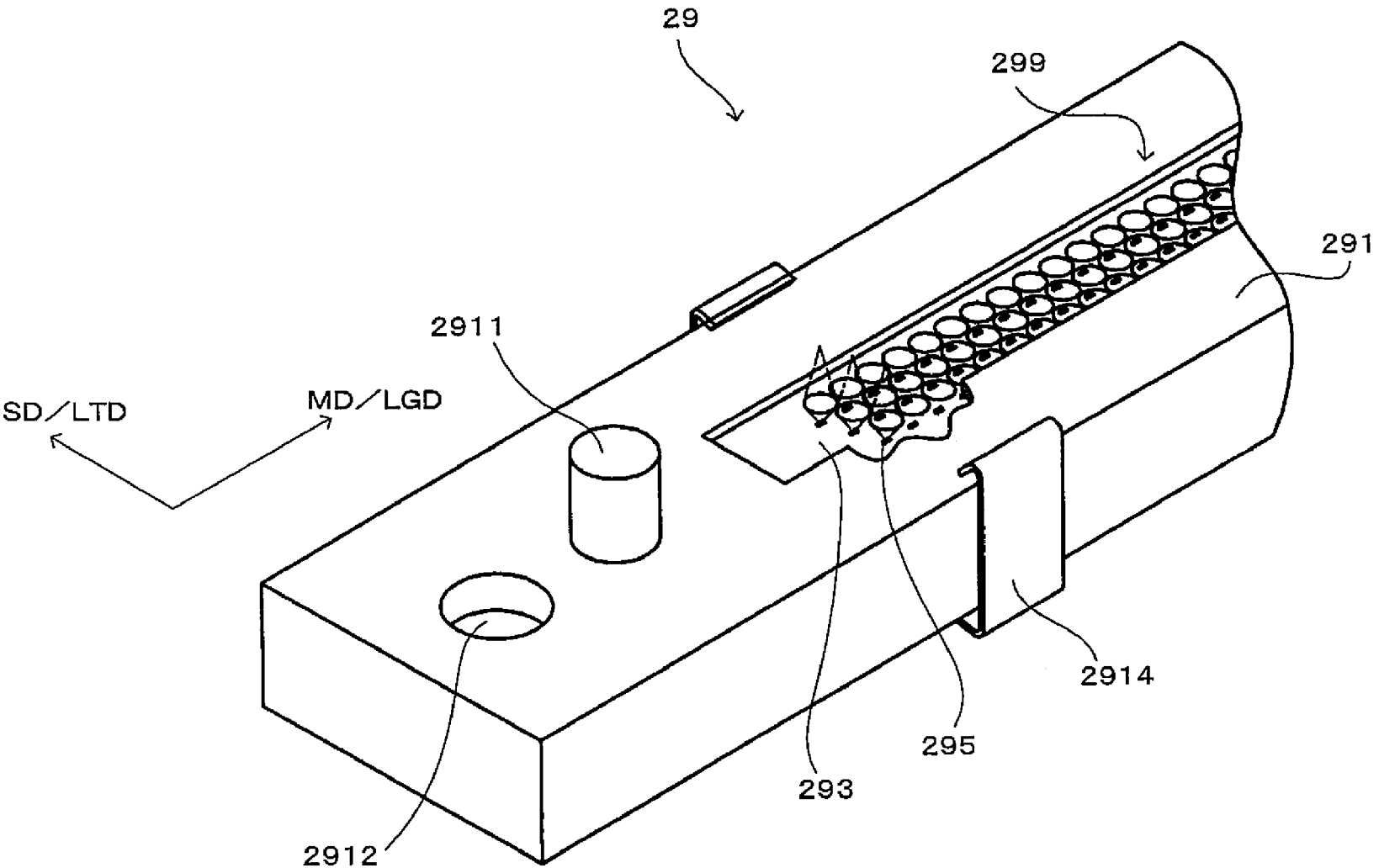
FIG. 29 is a schematic perspective view of the line head according to an eighth embodiment of the invention.
Figure 30:
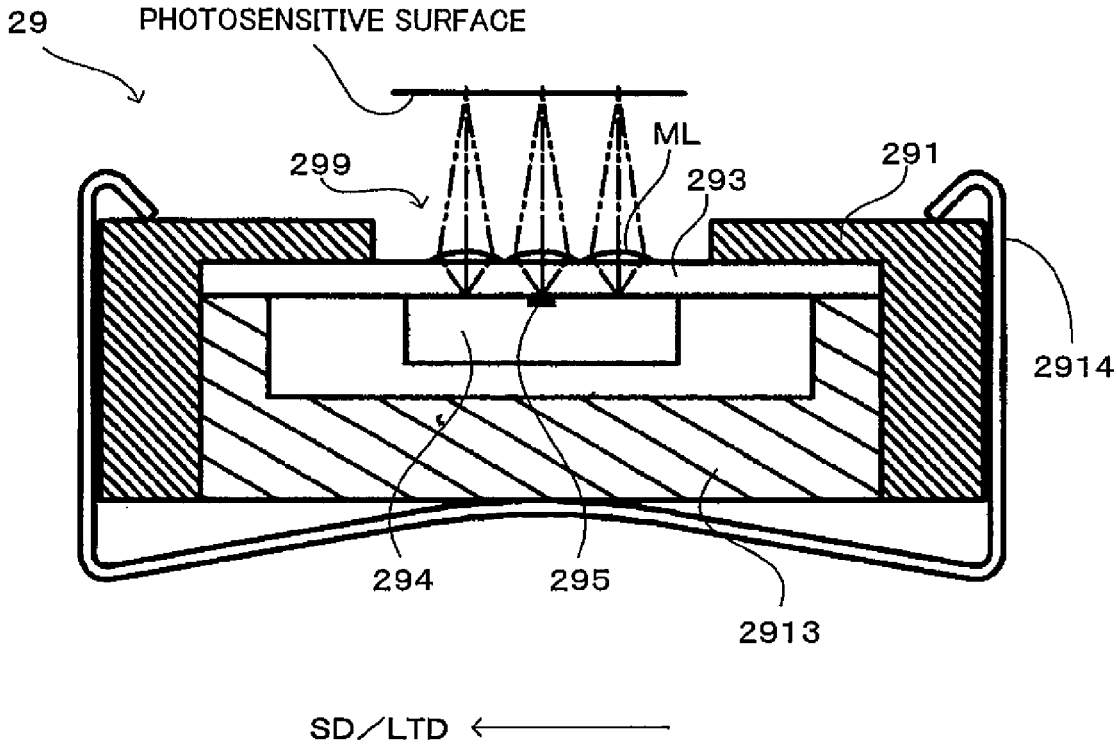
FIG. 30 is a cross sectional view of the line head according to the eighth embodiment taken along a sub scanning direction.

FIG. 29 is a schematic perspective view of the line head according to an eighth embodiment of the invention. FIG. 30 is a cross sectional view of the line head according to the eighth embodiment taken along a sub scanning direction. The line head (exposure section) 29 according to the eighth embodiment comprises a case 291 whose longitudinal direction is along a main scanning direction MD, and positioning pins 2911 and screw insertion holes 2912 are formed at the both ends of the case 291. With the positioning pins 2911 fit in positioning holes (not shown) formed in a photosensitive member cover (not shown) which covers the photosensitive drum 21 and is positioned relative to the photosensitive drum 21, the line head 29 is positioned relative to the photosensitive drum 21. As fixing screws are screwed into and fixed in screw holes (not shown) of the photosensitive member cover via the screw insertion holes 2912, the line head 29 is positioned and fixed to the photosensitive drum 21. That is, the line head 29 is positioned so that the longitudinal direction LGD of the line head 29 corresponds to the main scanning direction MD and lateral direction LTD of the line head 29 corresponds to the sub scanning direction SD.

The case 291 holds a glass substrate 293 inside. The front surface of the glass substrate 293 seats a microlens array 299 which is opposed to the surface of the photosensitive drum 21. The back surface of the glass substrate 293 (which is one of the two surfaces of the glass substrate 293 which is on the opposite side to the microlens array 299) mounts plural light emitting element groups 295. In short, the plural light emitting element groups 295 are arranged in a two-dimensional arrangement on the back surface of the glass substrate 293 so that they are spaced apart from each other by predetermined pitches along the main scanning direction MD and the sub scanning direction SD. Each light emitting element group 295 is formed by a two-dimensional arrangement of multiple light emitting elements. This embodiment uses organic ELs (Electro-Luminescence) as the light emitting elements. That is, organic ELs are mounted as light emitting elements on the back surface of the glass substrate 293 according to the eighth embodiment. Light beams emitted from the multiple light emitting elements toward the photosensitive drum 21 head for the microlens array 299 via the glass substrate 293 (transparent substrate). Impinging upon the microlens array 299, the light beams are imaged as spots on the surface of the photosensitive drum 21.

As shown in FIG. 30, a fixing tool 2914 presses a back lid 2913 against the case 291 via the glass substrate 293. In short, the fixing tool 2914 has elasticity which pushes the back lid 2913 toward the case 291, and as the back lid 2913 is pressed with the elasticity, the inside of the case 291 is sealed up light-tight (i.e., so that light will not leak out from within the case 291 and light will not come into the case 291 from outside). There plural such fixing tools 2914 at plural locations along the longitudinal direction of the case 291. The light emitting element groups 295 are covered with a sealing member 294.

Figure 31:
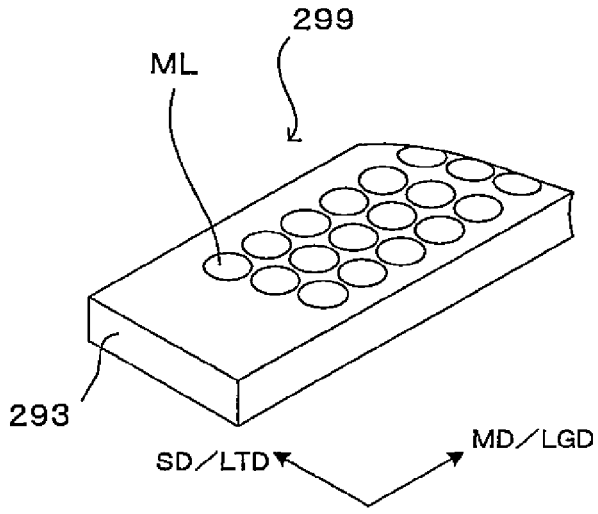
FIG. 31 is a schematic perspective view of the microlens array.
Figure 32:
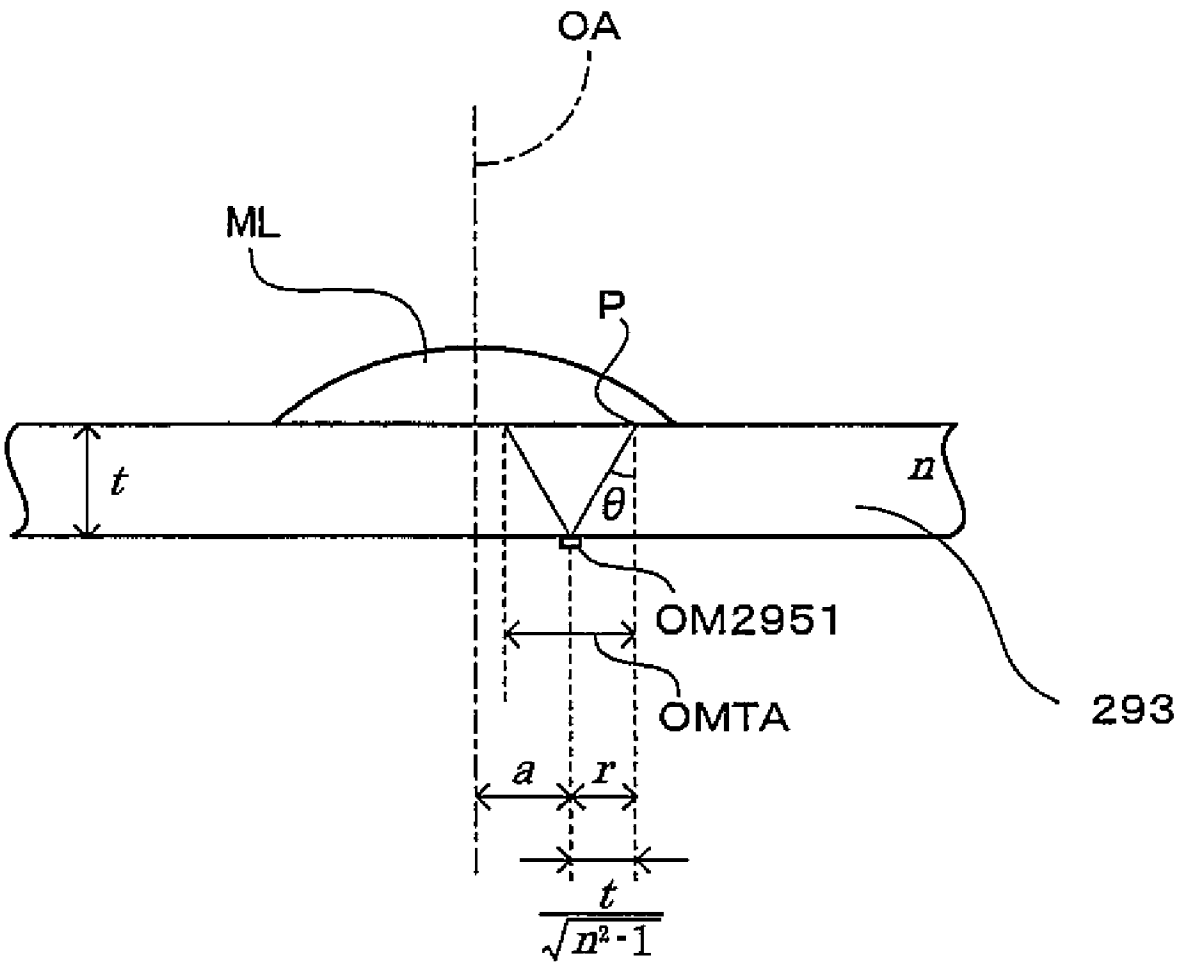
FIG. 32 is a cross sectional view of the microlens and the glass substrate.

FIG. 31 is a schematic perspective view of the microlens array. FIG. 32 is a cross sectional view of the microlens and the glass substrate. The microlens array 299 is disposed on the front surface of the glass substrate 293 (transparent substrate). Describing this in more specific details, the microlens array 299 is formed by multiple microlenses ML which are formed on the front surface of the glass substrate 293. The multiple microlenses ML may be made of resin and disposed directly on the front surface of the glass substrate 293. The multiple microlenses NL are arranged in a two-dimensional arrangement so that they are spaced apart from each other by predetermined pitches along the main scanning direction MD and the sub scanning direction SD and so that the multiple microlenses ML correspond to the arrangement of the light emitting element groups 295.

Each microlens ML images at a predetermined optical magnification light beams from the light emitting elements 2951 of the corresponding light emitting element group 295 on the surface of the photosensitive drum 21. At this stage, the light beams emitted from the light emitting elements 2951 are imaged on the surface of the photosensitive drum 21 as they are rotated 180 degrees with respect to the optical axis OA of the microlens ML. That is, spots are formed as inverted images of the light emitting elements 2951 on the surface of the photosensitive drum 21. The characteristic of the microlenses ML of imaging on the surface of the photosensitive drum 21 images which are inverted with respect to the optical axes OA will be hereinafter referred to as an "inversion characteristic".

Figure 33:
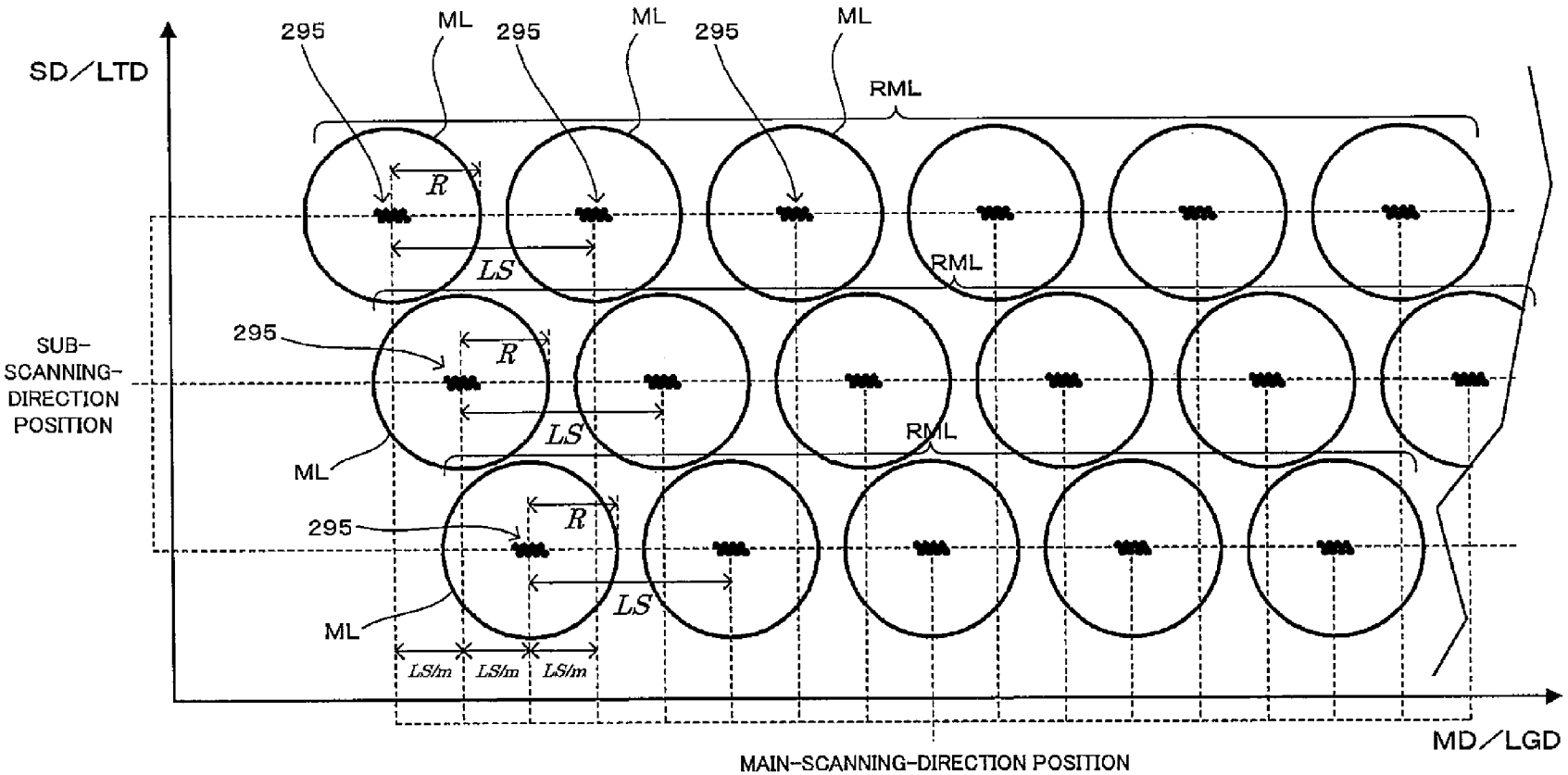
FIG. 33 is a drawing which shows the arrangement of the light emitting element groups and the microlenses.

FIG. 33 is a drawing which shows the arrangement of the light emitting element groups and the microlenses. As shown in FIG. 33, in the eighth embodiment, the multiple light emitting element groups 295 are disposed in a two-dimensional arrangement so that they are spaced apart by predetermined pitches in the longitudinal direction LGD corresponding to the main scanning direction MD and the lateral direction LTD corresponding to the sub scanning direction SD. The multiple microlenses ML (imaging lenses) are disposed in one-to-one correspondence to the multiple light emitting element groups 295. As shown in FIG. 33, the multiple microlenses ML are arranged, forming lens rows RML in which the microlenses ML are at lens spacing LS along the longitudinal direction LGD. There are three such lens rows RML in the lateral direction LTD, and the main-scanning-direction positions of the multiple microlenses ML are different from each other. Further, the multiple microlenses ML are arranged so that the sub-scanning-direction positions of two microlenses ML whose main-scanning-direction positions are next to each other are different from each other. In other words, the multiple microlenses ML are arranged in such a manner that the two microlenses ML whose main-scanning-direction positions are next to each other belong to different lens rows RML from each other and a distance along the main scanning direction between these two microlenses ML is approximately equal to LS/m. The value m denotes the number of the lens rows RML lined up along the sub scanning direction SD, and m=3 in this embodiment. The radius R of the microlenses ML is smaller than half the lens spacing LS.

Figure 34:
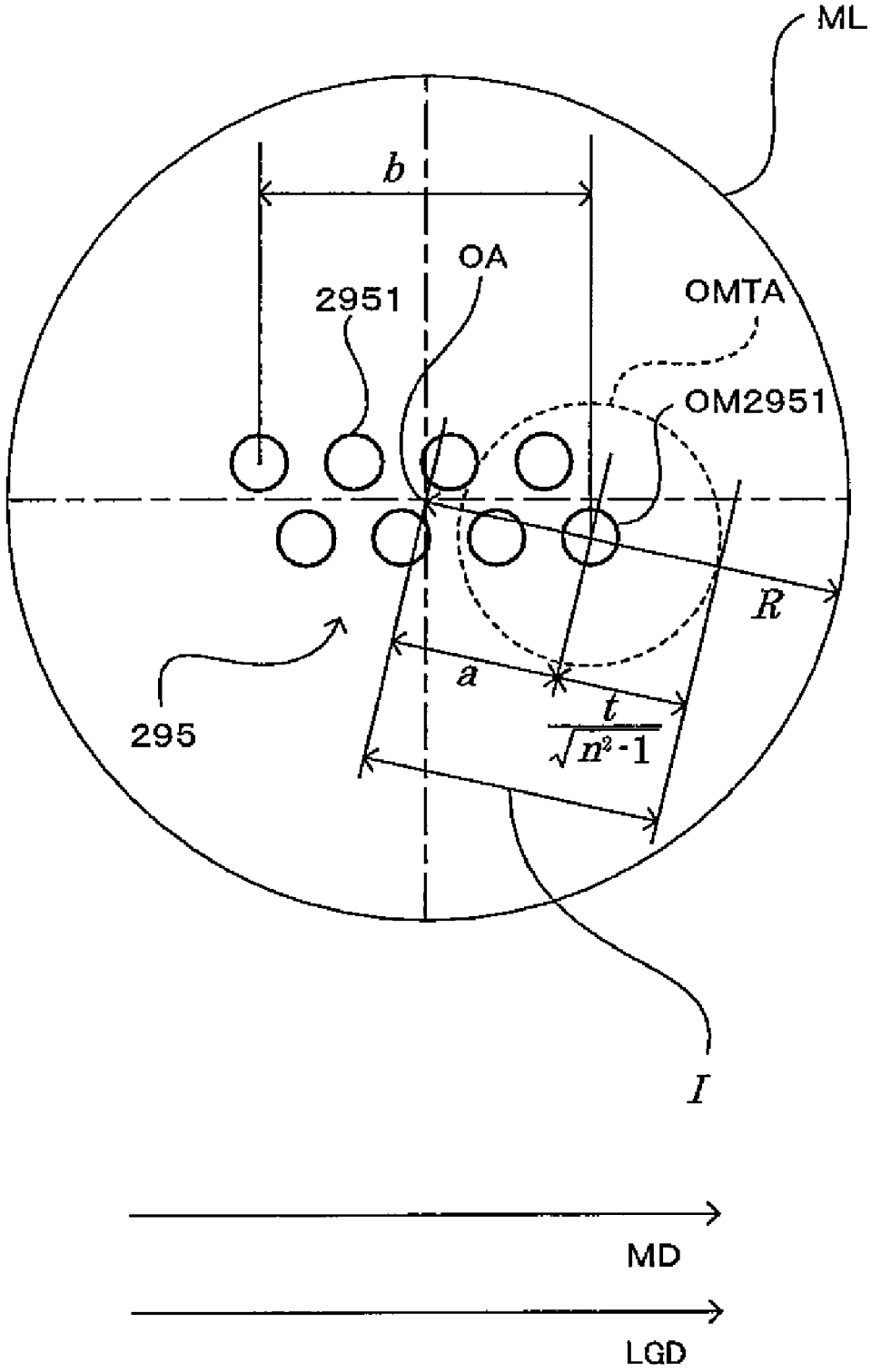
FIG. 34 is a drawing which shows a relationship between the light emitting elements and the radius of the microlenses.

FIG. 34 is a drawing which shows a relationship between the light emitting elements and the radius of the microlenses. As shown in FIG. 34, in this embodiment, one light emitting element group 295 is formed by a two-dimensional arrangement of eight light emitting elements 2951. The eight light emitting elements 2951 are disposed symmetric with respect to the optical axis OA of the microlens ML. The radius R of the microlens ML is defined as follows in relation to the outer-most element OM2951 among the eight light emitting elements 2951, namely, the farthest light emitting element from the optical axis OA of the microlens ML. That is, the radius R of the microlens ML is set to be larger than a distance I between the optical axis OA and the farthest position from the optical axis OA of the microlens ML within an outer-most passage area OMTA (namely, the area enclosed by the dashed line in FIG. 34). The outer-most passage area OMTA is an area within the surface of the glass substrate 293 which a light beam emitted from the outer-most element OM2951 can move passed the surface without getting totally reflected.

A relationship between the glass substrate 293 (transparent substrate) and the outer-most passage area OMTA will now be described with reference to FIG. 32. The radius r of the outer-most passage area OMTA is defined as follows:

$$\frac{t}{\sqrt{n^2-1}} \quad \text{(Formula 3)}$$

where the symbol t denotes the thickness of the glass substrate 293 (transparent substrate) and the symbol n denotes the index of refraction of the glass substrate 293 (transparent substrate). The reason will now be described.

The light beam emitted from the outer-most element OM2951 is totally reflected on the boundary of the outer-most passage area OMTA. In short, the light beam emitted from the outer-most element OM2951 is totally reflected at the far-right point P in FIG. 32 of the outer-most passage area OMTA. Hence, the following relationship holds true where the symbol θ denotes an angle between the normal line to the surface of the glass substrate 293 and the light beam heading for the point P from the outer-most element OM2951:

$$n \cdot \sin\theta = 1 \quad \text{(Formula 4)}$$

Utilizing that the relationship below is satisfied, $$\sin^2\theta = \frac{r^2}{r^2+t^2} \quad \text{(Formula 5)}$$

the relationship formula 4 may be modified as follows:

$$\frac{1}{n^2} = \frac{r^2}{r^2+t^2} \quad \text{(Formula 6)}$$

When the relationship formula 6 is solved as for the radius r, the following formula is obtained:

$$r = \frac{t}{\sqrt{n^2-1}} \quad \text{(Formula 7)}$$

In light of this, the eighth embodiment defines the distance I as follows as shown in FIG. 34:

$$I = a + \frac{t}{\sqrt{n^2-1}} \quad \text{(Formula 8)}$$

where the value a denotes a distance from the outer-most element OM2951 to the optical axis OA of the microlens ML which corresponds to the light emitting element group 295 which the outer-most element OM2951 belongs to.

In other words, satisfying the following relationship, the radius R of the microlens ML (imaging lens) exceeds the distance I in this embodiment:

$$R > \left(a + \frac{t}{\sqrt{n^2 - 1}}\right) \quad \text{(Formula 9)}$$

Further, the lens spacing LS is set as follows in this embodiment. That is, the lens spacing LS is set so that the following relationship is satisfied:

$$LS = h \cdot b \cdot m \cdot \frac{k}{k-1} \quad \text{(Formula 10)}$$

where the symbol k (k=8 in this embodiment) denotes the number of the light emitting elements in each light emitting element group 295, the symbol b denotes a main-scanning-direction distance between two light emitting elements 2951 which are at the both ends along the main scanning direction MD among the k light emitting elements of the light emitting element group 295 (FIG. 34), and the symbol h denotes the absolute value of the optical magnification of the microlens ML. In addition, the radius R of the microlens ML is set to be smaller than half the lens spacing LS described earlier.

Hence, in this embodiment, the radius R of the microlens ML satisfies the inequality below:

$$h \cdot b \cdot m \cdot \frac{k}{k-1} > 2 \cdot R \quad \text{(Formula 11)}$$

The reason of setting the lens spacing LS in this manner will be described in detail later.

Figure 35:
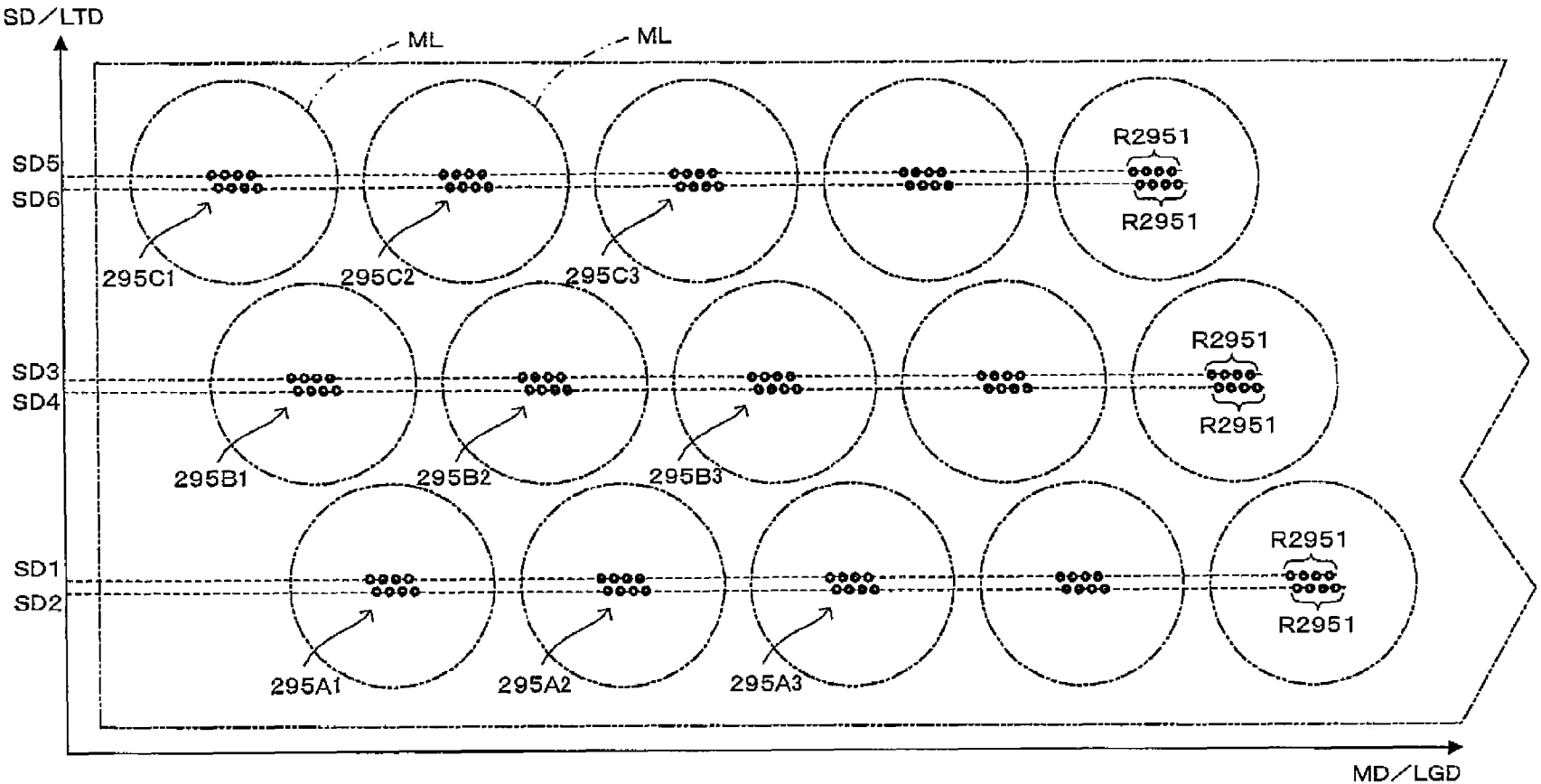
FIG. 35 is a drawing which shows the arrangement of the multiple light emitting element groups in an eighth embodiment.
Figure 36:
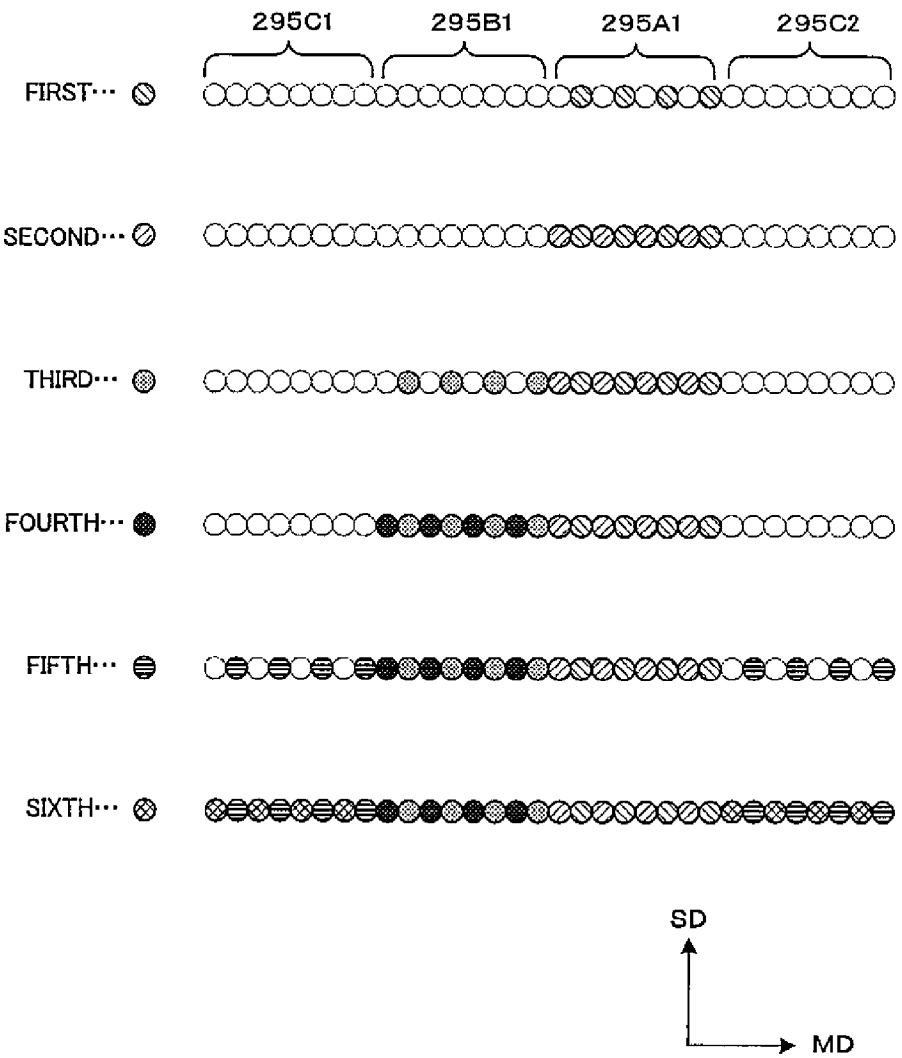
FIG. 36 is a drawing which shows a spot forming operation with using the line head according to the eighth embodiment.

FIGS. 35 and 36 are explanatory diagrams for describing operations of the line head according to the eighth embodiment. The spot forming operation performed by the line head 29 according to this embodiment will be now described with reference to FIGS. 3, 35 and 36. For easy understanding of the invention, forming of plural equidistant spots on a straight line which extends in the main scanning direction MD will be described. In this embodiment, the multiple light emitting elements 2951 emit light at predetermined timing while the surface (surface-to-be-scanned) of the photosensitive drum 21 (latent image carrier) is being transported in the sub scanning direction SD, thereby forming plural spots side by side on a straight line which extends in the main scanning direction MD.

In other words, there are six light emitting element rows R2951 lined up along the sub scanning direction SD within the line head according to the fourth embodiment such that they correspond to the sub-scanning-direction positions SD1 to SD6, respectively (FIG. 35). Noting this, in this embodiment, the light emitting element rows R2951 located at the same sub-scanning-direction position emit light approximately the same timing while light emission from the light emitting element rows R2951 located at the different sub-scanning-direction positions is timed differently. Describing this in more specific details, the light emitting element rows R2951 emit light while taking turns in the order of the sub-scanning-direction positions SD1 to SD6. As the light emitting element rows R2951 emit light in this order while the surface of the photosensitive drum 21 is being transported in the sub scanning direction SD, plural spots are formed side by side on a straight line which extends in the main scanning direction MD.

This operation will now be described with reference to FIGS. 11 and 35. First light emission is from the light emitting elements 2951 of the light emitting element rows R2951 located at the sub-scanning-direction position SD1 and belonging to the upstream-most light emitting element groups 295A1, 295A2, 295A3, . . . along the sub scanning direction SD. Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIRST" in FIG. 36. In FIG. 36, the white circles denote future spots yet to be formed. Meanwhile, the spots denoted at 295C1, 295B1, 295A1 and 295C2 in FIG. 36 are spots formed by the light emitting element groups 295 which correspond to these reference symbols.

Next light emission is from the light emitting elements 2951 of the light emitting element rows R2951 located at the sub-scanning-direction position SD2 and belonging to the upstream-most light emitting element groups 295A1, 295A2, 295A3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SECOND" in FIG. 36. The reason why light emission starts at the downstream light emitting element rows R2951 along the sub scanning direction SD (i.e., in the order of the sub-scanning-direction positions SD1 and SD2) while the transportation direction of the surface of the photosensitive drum 21 is the sub scanning direction SD is because the "imaging lenses" exhibit the inversion characteristic.

Next light emission is from the light emitting elements 2951 of the light emitting element rows R2951 located at the sub-scanning-direction position SD3 and belonging to the second upstream-most light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "THIRD" in FIG. 36.

Next light emission is from the light emitting elements 2951 of the light emitting element rows R2951 located at the sub-scanning-direction position SD4 and belonging to these light emitting element groups 295B1, 295B2, 295B3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FOURTH" in FIG. 36.

Next light emission is from the light emitting elements 2951 of the light emitting element rows R2951 located at the sub-scanning-direction position SD5 and belonging to the downstream-most light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "FIFTH" in FIG. 36.

The last light emission is from the light emitting elements 2951 of the light emitting element rows R2951 located at the sub-scanning-direction position SD6 and belonging to these light emitting element groups 295C1, 295C2, 295C3, . . . . Multiple light beams resulting from this light emitting operation, after expanded while inverted, are imaged on the surface of the photosensitive drum by the "imaging lenses" which exhibit the inversion/expansion characteristic described above. In short, the spots are formed at the shaded positions labeled as "SIXTH" in FIG. 36. As the first through the sixth light emitting operations are thus executed, the plural spots are formed side by side on the straight lines which extend in the main scanning direction MD.

The line head 29 according to the eighth embodiment is thus structured so that the radius R of the microlens ML satisfies the formula 9. In this structure, the radius R of the microlens ML (imaging lens) exceeds the distance I between the optical axis OA of the microlens ML and the farthest position within the outer-most passage area OMTA from the optical axis OA. That is, in the line head 29 according to this embodiment, the relationship between the outer-most element OM2951 and the radius of the corresponding microlens ML corresponding to the outer-most element OM2951 is defined such that the microlens ML covers the outer-most passage area OMTA which within the surface of the glass substrate 293 (transparent substrate) which the light beam emitted from the outer-most element OM2951 can move passed the surface without getting totally reflected. Hence, the light beam moving passed the outer-most passage area OMTA can impinge almost in its entirety upon the microlens ML, which suppresses a reduction of the amount of the light beam which impinges upon the microlens ML from the outer-most element OM2951. As a result, it is possible to suppress a decrease of the amount of the light beam which contributes to creation of a spot which corresponds to the outer-most element OM2951, and hence, to form a favorable spot.

Further, in the line head 29 according to the eighth embodiment, the multiple light emitting elements 2951 are disposed symmetric with respect to the optical axis OA of the associated microlens ML, which is preferable. This is because this minimizes the distance a, which works to an advantage in satisfying formula 9.

Further, in the line head 29 according to the eighth embodiment, the radius R of the microlens ML is smaller than half the lens spacing LS, which is preferable. This is because it makes it possible to suppress overlap between the microlenses ML which are adjacent to each other in the main scanning direction MD.

In addition, this embodiment requires forming the line head 29 so that two microlenses ML whose main-scanning-direction positions are next to each other belong to different lens rows RML from each other. This is preferable as the sub-scanning-direction positions of the two microlenses ML whose main-scanning-direction positions are next to each other are different from each other. This is because such a structure ensures long distances between the microlenses M which are adjacent to each other in the main scanning direction MD, which works to an advantage in satisfying the condition that "the radius R of the microlens ML is smaller than half the lens spacing LS".

Further, the eighth embodiment requires forming the line head 29 so that a main-scanning-direction between two microlenses ML whose main-scanning-direction positions are next to each other is approximately equal to LS/m and that the formula 10 is satisfied. This attains a favorable arrangement along the main scanning direction MD of spots which are formed by two light emitting element groups 295 whose main-scanning-direction positions are next to each other, which is preferable. The reason will now be described.

Figure 37:
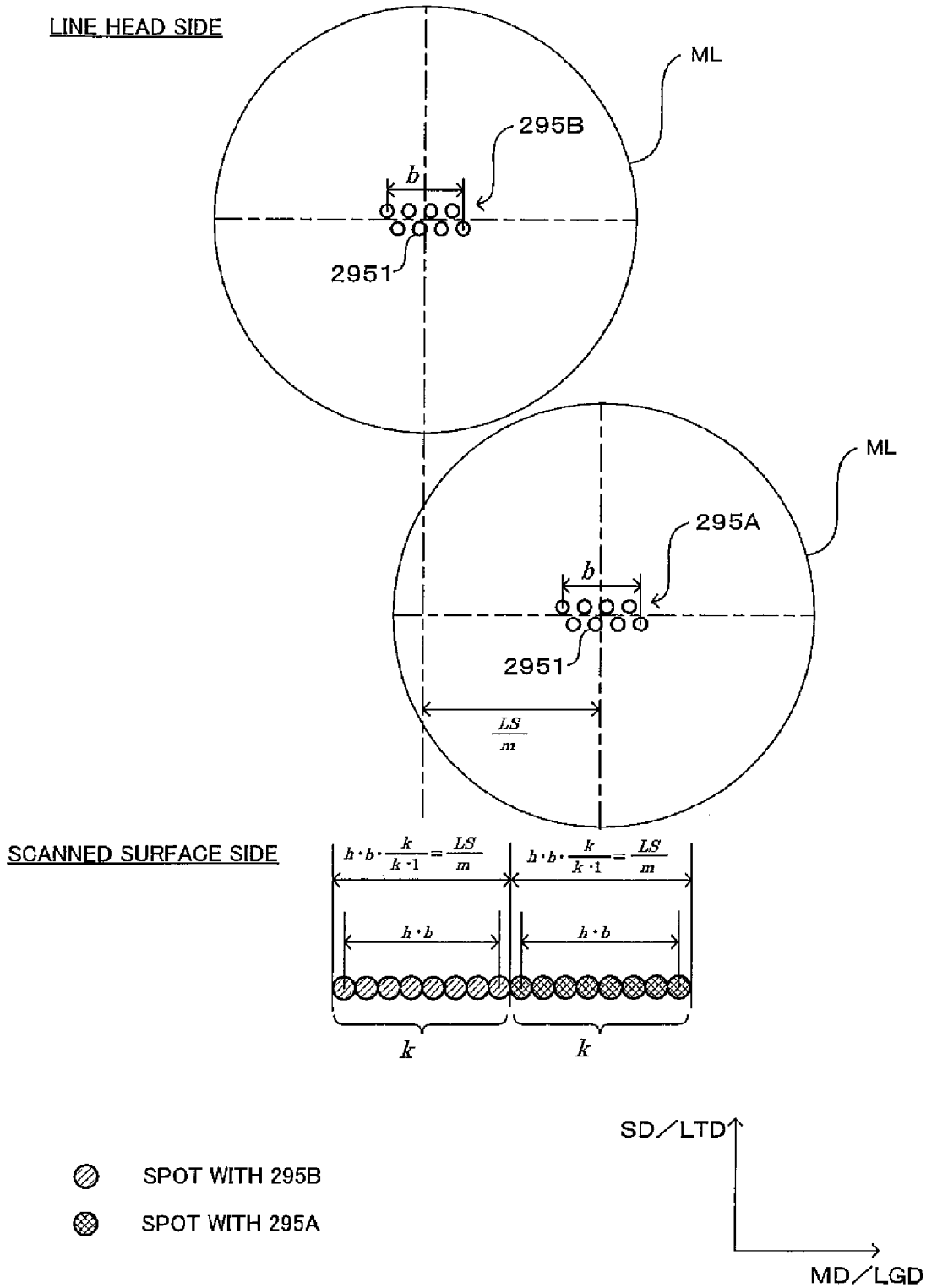
FIG. 37 is a drawing which shows how two light emitting element groups whose main-scanning-direction positions are next to each other form spots.

FIG. 37 is a drawing which shows how two light emitting element groups whose main-scanning-direction positions are next to each other form spots. In short, shown in FIG. 37 are spots which are formed side by side on the surface-to-be-scanned along the main scanning direction MD by light emitting element groups 295A, 295B whose main-scanning-direction positions are next to each other. In this embodiment, m lens rows RML are arranged in the sub scanning direction SD, and in one lens row, the lens spacing between adjacent microlenses ML in the main scanning direction MD is LS. The lens spacing LS is equal to the pitch between adjacent light emitting elements in the main scanning direction MD. Hence, the pitch between the light emitting element groups 295A, 295B whose main-scanning-direction positions are next to each other is LS/m.

Further, the number of the light emitting elements in one light emitting element groups 295 is k (k=8 in this embodiment). Hence, one light emitting element groups 295 forms on the surface-to-be-scanned a spot row in which there are k spots in the main scanning direction MD. The k spots formed side by side in the main scanning direction MD by one light emitting element group hereinafter referred to as a "spot row". By the way, a distance between two spots at the ends of a spot row along the main scanning direction is given by h·b. Hence, considering that the distance h·b corresponds to the length of (k−1) spots, the length of the spot row along the main scanning direction is yielded by the following formula:

$$h \cdot b \cdot \frac{k}{k-1} \qquad \text{(Formula 12)}$$

In short, as shown in FIG. 37, the two light emitting element groups 295A, 295B, whose main-scanning-direction positions are next to each other, form two spot rows whose lengths are calculated by formula 12.

Noting this, the eighth embodiment requires forming the line head 29 so that the spacing LS/m between the light emitting element groups 295A, 295B becomes equal to the value yielded from formula 12, that is, so that the lens spacing LS satisfies the formula 10. In this structure, the spot pitches in one spot row are equal to the spot pitches in a spot row which is located next in the main scanning direction MD. This ensures equal spot pitches between plural spots formed side by side in the main scanning direction MD by the two light emitting element groups 295A, 295B whose main-scanning-direction positions are next to each other. This attains a favorable arrangement along the main scanning direction MD of spots which are formed by two light emitting element groups 295 whose main-scanning-direction positions are next to each other, which is preferable.

Further the image forming apparatus according to the eighth embodiment comprises, as an exposure section, the line head 29 which treats the surface of the photosensitive drum 21 (latent image carrier) as the surface-to-be-scanned and creates spots. It is therefore possible to suppress a reduction of the amount of the light beam which impinges upon the microlens ML from the outer-most element OM2951. As a result, it is possible to suppress a decrease of the amount of the light beam which contributes to creation of a spot which corresponds to the outer-most element OM2951, and hence, to form an image with a favorable spot.

In short, the eighth embodiment requires arranging two light emitting element trains R2951, each formed by four light emitting elements 2951 along the longitudinal direction LGD corresponding to the main scanning direction MD, in the lateral direction LTD corresponding to the sub scanning direction SD to thereby form one light emitting element group 295 (FIGS. 10 and 34). However, the structure of the light emitting element groups 295 is not limited to this but may be as described below for instance.

Ninth Embodiment

Figure 38:
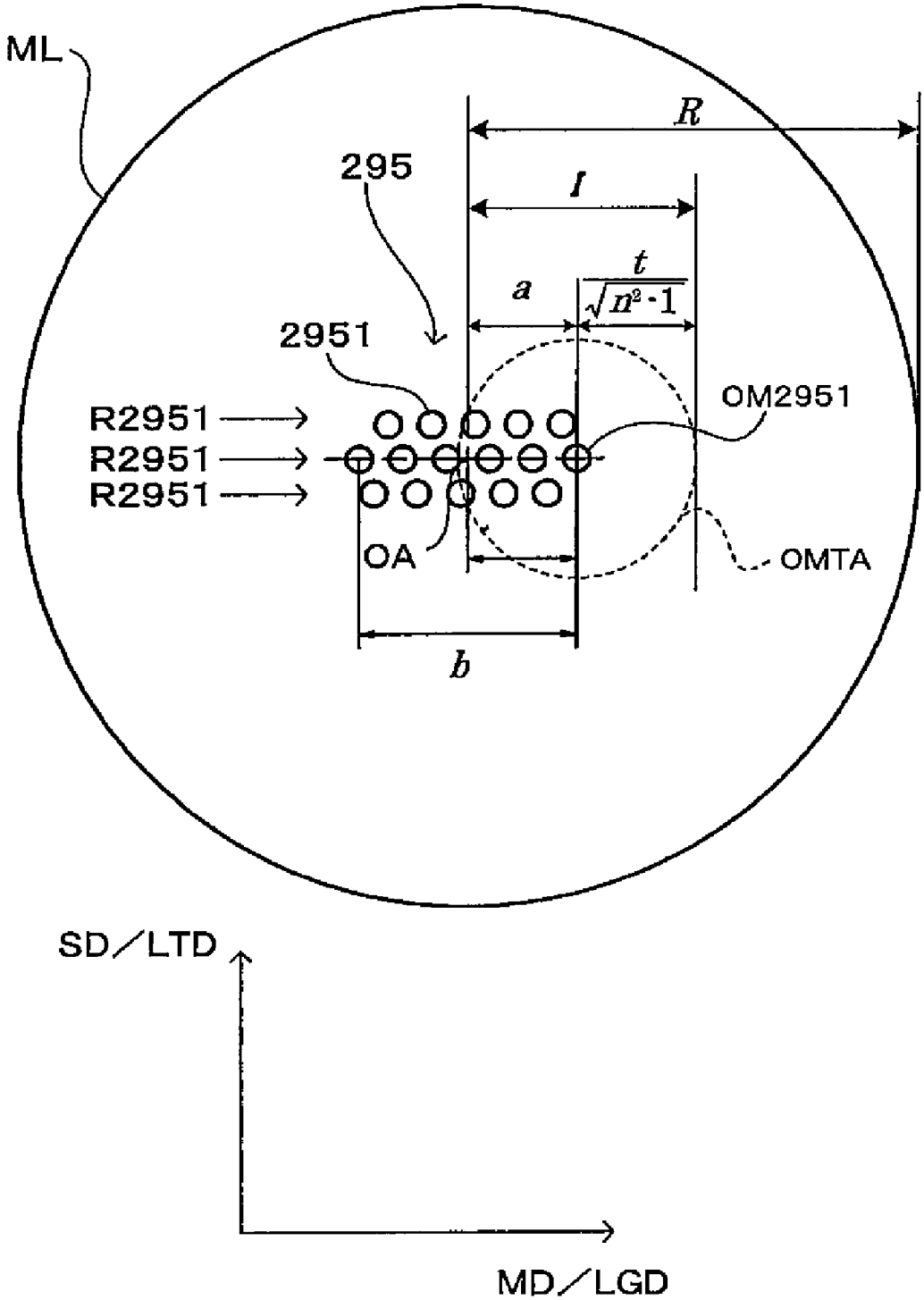
FIG. 38 is a drawing which shows a line head according to a ninth embodiment of the invention.

FIG. 38 is a drawing which shows a line head according to a ninth embodiment of the invention. As shown in FIG. 38, the ninth embodiment requires arranging three light emitting element trains R2951, each formed by light emitting elements 2951 along the longitudinal direction LGD corresponding to the main scanning direction MD, in the lateral direction LTD corresponding to the sub scanning direction SD to thereby form one light emitting element groups 295. Describing this in more detail, in the embodiment shown in FIG. 38, the light emitting element trains R2951, each formed by five light emitting elements 2951 along the longitudinal direction LGD, are disposed on the top and the bottom in FIG. 38, and the light emitting element train R2951 formed by six light emitting elements 2951 along the longitudinal direction LGD is disposed in the middle in FIG. 38. In short, the sixteen light emitting elements 2951 form one light emitting element groups 295 in the embodiment shown in FIG. 38. That is, the number k of the light emitting elements in one light emitting element groups 295 is set to 16 in the embodiment shown in FIG. 38.

In the ninth embodiment as well, the radius R of the microlenses ML satisfies the formula 9. This structure ensures that the radius R of the microlenses ML (imaging lenses) is greater than the distance I between the optical axis OA of the associated microlens ML and the farthest position within the outer-most passage area OMTA from the optical axis OA. In short, the relationship between the outer-most element OM2951 and the radius of the microlens ML corresponding to the outer-most element OM2951 is defined such that the corresponding microlens ML covers the outer-most passage area OMTA in the embodiment shown in FIG. 38 as well. Hence, the light beam moving passed the outer-most passage area OMTA can impinge almost in its entirety upon the microlens ML, which suppresses a reduction of the amount of the light beam which impinges upon the microlens ML from the outer-most element OM2951. As a result, it is possible to suppress a decrease of the amount of the light beam which contributes to creation of a spot which corresponds to the outer-most element OM2951, and hence, to form a favorable spot.

Further, in the ninth embodiment as well, the multiple light emitting elements 2951 are disposed symmetric with respect to the optical axis OA of the associated microlens ML, which is preferable. This is because this minimizes the distance a, which works to an advantage in satisfying formula 9

Further, in the ninth embodiment as well, the symbol b defines a main-scanning-direction distance between two light emitting elements 2951 which are at the both ends along the longitudinal direction LGD among the k light emitting elements 2951 of each light emitting element group. Hence, as the microlenses ML are disposed so as to satisfy the formula 10 as in the embodiment shown in FIGS. 9, 10 and 33, spots formed by two light emitting element groups 295 whose main-scanning-direction positions are next to each other are arranged in a favorable arrangement, which is preferable.

As described in the eighth and ninth embodiments, the radius of the imaging lens is larger than a distance between the farthest position in the outer-most passage area from the optical axis of the imaging lens and the optical axis. The outer-most passage area in this context is, where the farthest light emitting element belonging to a light emitting element group from the optical axis of the imaging lens which corresponds to the light emitting element group is defined as the outer-most element, such an area within the surface of a transparent substrate which a light beam emitted from the outer-most element can move passed the surface without getting totally reflected. In other words, in the line head according to the invention, a relationship between the outer-most element and the radius of the imaging lens corresponding to the outer-most element is defined so that the imaging lens covers the outer-most passage area within the surface of the transparent substrate which the light beam emitted from the outer-most element can move passed the surface without getting totally reflected. Hence, the light beam moving passed the outer-most passage area can impinge almost in its entirety upon the imaging lens, which suppresses a reduction of the amount of the light beam which impinges upon the imaging lens from the outer-most element. As a result, it is possible to suppress a decrease of the amount of the light beam which contributes to creation of a spot which corresponds to the outer-most element, and hence, to form a favorable spot.

Further, a line head in which the thickness of a transparent substrate is t and the index of refraction of the transparent substrate is n may have the following structure. That is, for each one of the multiple light emitting element groups, where the symbol a denotes a distance from the outer-most element to the optical axis of the imaging lens corresponding to the light emitting element group to which the outer-most element belongs and the symbol R denotes the radius of this imaging lens, the line head satisfies the formula 9. In the line head having this structure, the outer-most passage area within the surface of the transparent substrate which the light beam emitted from the outer-most element can move passed the surface without getting totally reflected is covered by the corresponding imaging lens. This suppresses a reduction of the amount of the light beam which contributes to creation of a spot which corresponds to the outer-most element, and hence, permits forming a favorable spot.

The line head may have such a structure in which multiple light emitting elements are disposed in a symmetric arrangement relative to the optical axis of the imaging lens in each one of the multiple light emitting element groups. This is because the symmetric arrangement minimizes the distance a, which works to an advantage in satisfying the inequality above.

Further, the following structure may be used for a line head in which multiple imaging lenses are disposed so as to form lens rows which are lined up over predetermined lens spacing LS along a main scanning direction. That is, in the line head, the radius R of the imaging lenses may be shorter than half the lens spacing LS. This is because such makes it possible to suppress overlap between the imaging lenses which are adjacent to each other in the main scanning direction, which is preferable.

Further, the following structure may be used for a line head in which m lens rows (m is a natural number which is equal to or larger than 2) are lined up along a sub scanning direction which is approximately perpendicular to the main scanning direction and multiple imaging lenses are disposed so as to have mutually different main-scanning-direction positions. That is, in the line head, the sub-scanning-direction positions of two imaging lenses whose main-scanning-direction positions are next to each other are different from each other. This is because such a structure makes it possible to ensure large distances between the imaging lenses which are adjacent to each other in the main scanning direction, which is advantageous in satisfying the condition above that "the radius R of the imaging lenses is shorter than half the lens spacing LS".

From a perspective of satisfaction of the above condition, the following structure may be used. That is, in the line head, two imaging lenses whose main-scanning-direction positions are next to each other belong to different lens rows. This is because such a structure ensures that the sub-scanning-direction positions of the two imaging lenses whose main-scanning-direction positions are next to each other are different from each other, which works to an advantage in satisfying the above condition.

Further, a main-scanning-direction distance between two imaging lenses whose main-scanning-direction positions are next to each other is approximately equal to LS/m in the line head having such a structure, and in addition, the line head may satisfy the formula 10. This structure attains a favorable arrangement of spots along the main scanning direction which are formed by two light emitting element groups whose main-scanning-direction positions are next to each other, which is preferable.

The image forming apparatus according to the fourth to six embodiments of the invention comprises a latent image carrier whose surface is transported along a sub scanning direction and an exposure section having the same structure as that of the line head described above which treats the surface of the latent image carrier as a surface-to-be-scanned and creates spots on the surface of the latent image carrier. This permits suppressing a decrease of the amount of the light beam which impinges upon the imaging lens from the outermost element. As a result, it is possible to suppress a decrease of the amount of the light beam which contributes to creation of a spot which corresponds to the outer-most element, and hence, to form an image with a favorable spot.

Others

The invention is not limited to the embodiments described above but may be modified in various manners in addition to the embodiments above, to the extent not deviating from the object of the invention. For instance, although the foregoing has disclosed the specific numerical values of the distances Gx, Gy, Pox and Py in relation to the first and second embodiments, it is needless to mention that the distances are not limited to these numerical values. To be noted is that as the main-scanning-direction group pitch Px is set to be wider than the sub-scanning-direction group pitch Py in the line head in which the main-scanning-direction group width Gx exceeds the sub-scanning-direction group width Gy, it is possible to form favorable spots while suppressing crosstalk in the main scanning direction MD.

Further, although the first and second embodiments use expanding optical systems as the imaging lenses, this is not an indispensable requirement for the invention. The important benefit is that the line head in which the main-scanning-direction group width Gx is greater than the sub-scanning-direction group width Gy is structured so that the main-scanning-direction group pitch Px exceeds the sub-scanning-direction group pitch Py, it is possible to form favorable spots while suppressing crosstalk in the main scanning direction MD. Use of expanding optical systems as the imaging lenses however is preferable in that it makes it possible to more effectively suppress crosstalk in the main scanning direction as described above.

Further, although the first and second embodiments require disposing the multiple light emitting elements 2951 in one light emitting element group 295 such that they are symmetric with respect to the geometric gravity point of this light emitting element group 295 and such that the geometric gravity point of the light emitting element group 295 coincides with the optical axis OA of the imaging lens, this is not an indispensable requirement for the invention. The gist is that as the main-scanning-direction group pitch Px is set to be wider than the sub-scanning-direction group pitch Py in the line head in which the main-scanning-direction group width Gx exceeds the sub-scanning-direction group width Gy, it is possible to suppress crosstalk in the main scanning direction MD and accordingly form favorable spots. A symmetric arrangement of the multiple light emitting elements with respect to the optical axis OA of the imaging lens is preferable in that it makes it possible to more effectively suppress crosstalk in the main scanning direction as described above.

Further, the line head of the invention forms plural spots linearly along the main scanning direction MD in the first and second embodiments as shown in FIG. 12. However, this spot forming operation is merely one example of the operation of the line head according to the invention, and operations this line head can perform are not limited to this. In other words, spots to form do not necessarily be linearly along the main scanning direction MD. For example, spots may be formed so that they are at a predetermined angle with respect to the main scanning direction MD or they are in a zigzag or wavy arrangement.

Further, although the first and second embodiments require using organic ELs as the light emitting elements 2951, the structure of the light emitting elements 2951 is not limited to this: LEDs (Light Emitting Diodes) may be used as the light emitting elements 2951 for example.

Further, the line head of the invention forms plural spots linearly along the main scanning direction MD in the seventh embodiment. However, this spot forming operation is merely one example of the operation of the line head according to the invention, and operations this line head can perform are not limited to this. In other words, spots to form do not necessarily be linearly along the main scanning direction MD. For example, spots may be formed so that they are at a predetermined angle with respect to the main scanning direction MD or they are in a zigzag or wavy arrangement.

It is needless to mention that the material of the transparent substrate is not limited to glass although the transparent substrate is made of glass in the eighth and ninth embodiments. That is, the transparent substrate may be made of any material which can transmit a light beam.

Further, although the k light emitting elements belonging to each light emitting element group 295 are disposed symmetric with respect to the optical axis OA in the eighth and ninth embodiments, this is not an indispensable requirement for the invention. This arrangement is however preferable in that it minimizes the distance a, works to an advantage in satisfying the inequality formula 9, and easily permits forming a favorable spot.

Further, although three lens rows RML are arranged in the sub scanning direction SD in the eighth and ninth embodiments, the number of the lens rows RML is not limited to this but may be changed as necessary. In other words, the number of the lens rows RML may be 1, 2, 3 or greater.

Further, the lens spacing LS satisfies the formula 10 in the eighth and ninth embodiments, the lens spacing LS satisfying the formula 10 is not an indispensable requirement for the invention. This structure is however preferable in that it attains a favorable arrangement along the main scanning direction MD of spots which are formed by two light emitting element groups 295 whose main-scanning-direction positions are next to each other as described earlier.

Further, the eighth and ninth embodiments requires forming plural equidistant spots linearly in the main scanning direction MD as shown in FIG. 36 using the line head according to the invention. However, this spot forming operation is merely one example of the operation which the line head according to the invention performs, and operations which the line head according to the invention can perform are not limited to this.

In other words, where the relationship between the outermost element OM2951 and the radius of the microlens ML corresponding to the outer-most element OM2951 is defined such that the associated microlens ML covers the outer-most passage area OMTA, the effect of the invention is attainable regardless of the specific operation of the line head 29, which is creation of a favorable spot while suppressing a decrease of the amount of the light beam which contributes to creation of a spot which corresponds to the outer-most element OM2951.

Further, although the embodiments above are directed to an application of the invention to a color image forming apparatus, applications of the invention are not limited to this: the invention is applicable also to a monochrome image forming apparatus which forms so-called monochrome images.

EXAMPLES

Examples of the invention will now be described. The examples do not in any sense limit the invention but may of course be modified appropriately to the extent serving the intension of the invention described earlier. All such modifications are within the technical scope of the invention.

Example 1

Table 5 is a table of the first main-scanning-direction pitches Δe, the second main-scanning-direction pitches Δg and the optical magnification h in an example 1. The structure of the light emitting element groups 295 in Example 1 is similar to that shown in FIG. 18. In other words, the number k of the light emitting elements 2951 which form one light emitting element group 295 is 8. Where the first main-scanning-direction pitches Δe, the second main-scanning-direction pitches Δg and the optical magnification h are set as shown in Table 1, the spot pitches ds (35.4 μm) are narrower than the spot pitches ss (43.0 μm).

TABLE 5

| PHYSICAL VALUE | UNIT | VALUE |
|---|---|---|
| FIRST MAIN-SCANNING-DIRECTION PITCH Δe | μm | 21.2 |
| SECOND MAIN-SCANNING-DIRECTION PITCH Δg | μm | 338.4 |
| ABSOLUTE VALUE h OF OPTICAL MAGNIFICATION | | 2.042 |
| NUMBER k OF LIGHT EMITTING ELEMENT IN ONE GROUP | | 8 |
| SPOT PITCH ss | μm | 43.3 |
| SPOT PITCH ds | μm | 35.4 |

Figure 39:
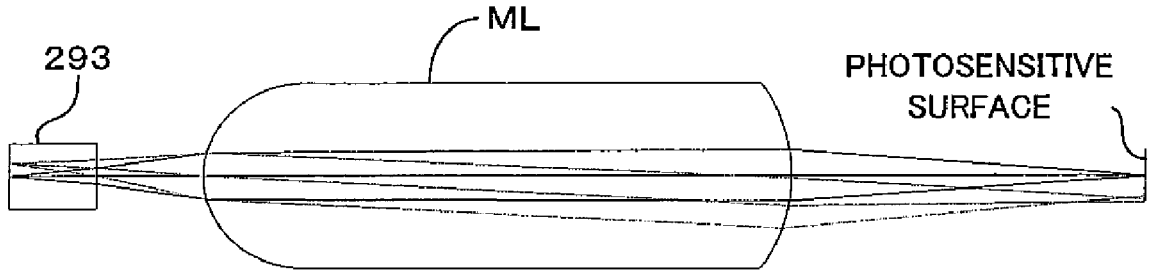
FIG. 39 is a drawing of the imaging optical systems in Example 1.

Tables 6 and 7 show data regarding the imaging optical systems and the light emitting elements which attain the optical magnification h which is specified in Table 5. FIG. 39 is a drawing of the imaging optical systems in Example 1. As Table 6 shows, the diameter of light emitting pixels of the light emitting elements 2951 is 30 μm and the wavelength of light beams emitted from the light emitting elements 2951 is 760 nm in Example 1. Used as the light emitting elements 2951 are organic ELs, and the organic ELs are formed on the back surface of the glass substrate 293. The light emitting surface (bearing the surface number S1) of the light emitting element 2951 and the back surface (bearing the surface number S2) of the glass substrate 293 are opposed to each other with a surface clearance of 0. As the imaging optical systems are formed as shown in FIG. 39 and Table 3, the optical magnification is set to −2.042.

TABLE 6

| ITEM | VALUE |
|---|---|
| WAVELENGTH | 760 nm |
| DIAMETER OF LIGHT EMITTING ELEMENT | 30 μm |
| OPTICAL MAGNIFICATION | −2.042 |

TABLE 7

LENS DATA

UNIT [mm]

| SURFACE NUMBER | SURFACE TYPE | RADIUS OF CURVATURE | SURFACE INTERVAL | REFRACTIVE INDEX |
|---|---|---|---|---|
| S1 (OBJECT PLANE) | | ∞ | 0 | |
| S2 | PLANE | ∞ | 0.5 | nd = 1.51680, vd = 64.2 |
| S3 | PLANE | ∞ | 0.6 | |
| S4 | SPHERICAL SURFACE | 0.5700 | 3.323644101 | nd = 1.54041, vd = 51.1 |
| S5 | SPHERICAL SURFACE | −1.0502 | 2 | |
| S6 (IMAGE PLANE) | | | 0 | |

Since the first main-scanning-direction pitches Δe, the second main-scanning-direction pitches Δg and the absolute value h of the optical magnification are set as shown in Table 5 in Example 1, the spot pitches ds (35.4 μm) are narrower than the spot pitches ss (43.3 μm). This makes it possible to discourage occurrence of a defect that the downstream-most spot DWS and the upstream-most spot UPS fail to be contiguous but become discontiguous, and permits forming an image with favorable spots.

In addition, Example 1 requires setting the optical magnification of the imaging optical systems to −2.042. That is, the absolute value h of the optical magnification is greater than 1. Such a structure of the imaging optical systems works to an advantage in satisfying the spots relationship that the spot pitches ds (35.4 μm) are narrower than the spot pitches ss (43.3 μm). It is therefore possible to more securely suppress occurrence of a defect that the downstream-most spot DWS and the upstream-most spot UPS fail to be contiguous but become discontiguous, which is desirable.

Example 2

Table 8 is a table of the first main-scanning-direction pitches Δe, the second main-scanning-direction pitches Δg and the optical magnification h in Example 2. The structure of the light emitting element groups 295 in Example 2 is similar to that shown in FIG. 22. In other words, the number k of the light emitting elements 2951 which form one light emitting element group 295 is 12. Where the first main-scanning-direction pitches Δe, the second main-scanning-direction pitches Δg and the optical magnification h are set as shown in Table 8, the spot pitches ds (35.4 μm) are narrower than the spot pitches ss (43.0 μm).

TABLE 8

| PHYSICAL VALUE | UNIT | VALUE |
|---|---|---|
| FIRST MAIN-SCANNING-DIRECTION PITCH Δe | μm | 28.2 |
| SECOND MAIN-SCANNING-DIRECTION PITCH Δg | μm | 507.6 |
| ABSOLUTE VALUE h OF OPTICAL MAGNIFICATION | | 1.525 |
| NUMBER k OF LIGHT EMITTING ELEMENT IN ONE GROUP | | 12 |
| SPOT PITCH ss | μm | 43.0 |
| SPOT PITCH ds | μm | 34.5 |

Figure 40:
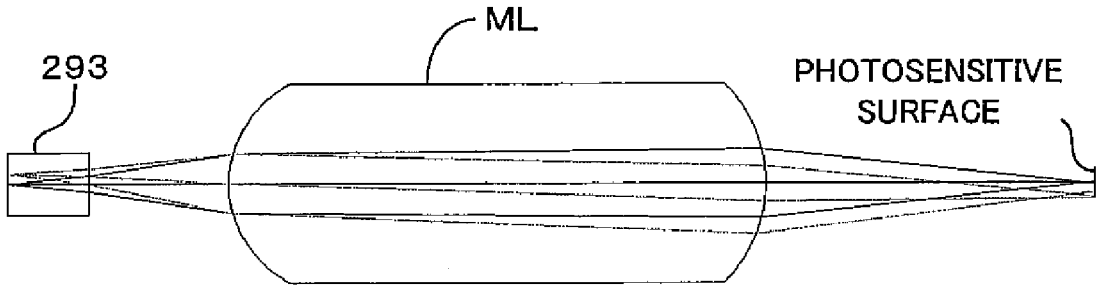
FIG. 40 is a drawing of the imaging optical systems in Example 2.

Tables 9 and 10 show data regarding the imaging optical systems and the light emitting elements which attain the optical magnification h which is specified in Table 8. FIG. 40 is a drawing of the imaging optical systems in Example 2. As Table 5 shows, the diameter of light emitting pixels of the light emitting elements 2951 is 30 μm and the wavelength of light beams emitted from the light emitting elements 2951 is 760 nm in Example 2. Used as the light emitting elements 2951 are organic ELs, and the organic ELs are formed on the back surface of the glass substrate 293. The light emitting surface (bearing the surface number S1) of the light emitting element 2951 and the back surface (bearing the surface number S2) of the glass substrate 293 are opposed to each other with a surface clearance of 0. As the imaging optical systems are formed as shown in FIG. 40 and Table 6, the optical magnification is set to −1.525.

TABLE 9

| ITEM | VALUE |
|---|---|
| WAVELENGTH | 760 nm |
| DIAMETER OF LIGHT EMITTING ELEMENT | 30 μm |
| OPTICAL LATERAL MAGNIFICATION | −1.525 |

TABLE 10

LENS DATA

UNIT [mm]

| SURFACE NUMBER | SURFACE TYPE | RADIUS OF CURVATURE | SURFACE INTERVAL | REFRACTIVE INDEX |
|---|---|---|---|---|
| S1 (OBJECT PLANE) | | ∞ | 0 | |
| S2 | PLANE | ∞ | 0.5 | nd = 1.51680, vd = 64.2 |
| S3 | PLANE | ∞ | 0.84 | |
| S4 | SPHERICAL SURFACE | 0.7600 | 3.256971397 | nd = 1.54041, vd = 51.1 |
| S5 | SPHERICAL SURFACE | −0.9975 | 2 | |
| S6 (IMAGE PLANE) | | | 0 | |

As described above, as the first main-scanning-direction pitches Δe, the second main-scanning-direction pitches Δg and the absolute value h of the optical magnification are set as shown in Table 8 in Example 2, the spot pitches ds (34.5 μm) are narrower than the spot pitches ss (43.0 μm). This makes it possible to discourage occurrence of a defect that the downstream-most spot DWS and the upstream-most spot UPS fail to be contiguous but become discontiguous, which permits forming an image with favorable spots.

In addition, Example 2 requires setting the optical magnification of the imaging optical systems to −1.525. That is, the absolute value h of the optical magnification is greater than 1. Such a structure of the imaging optical systems works to an advantage in satisfying the spots relationship that the spot pitches ds (34.5 μm) are narrower than the spot pitches ss (43.0 μm). It is therefore possible to more securely suppress occurrence of a defect that the downstream-most spot DWS and the upstream-most spot UPS fail to be contiguous but become discontiguous, which is desirable.

Although the invention has been described with reference to specific embodiments, this description is not meant to be construed in a limiting sense. Various modifications of the disclosed embodiments as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head comprising:

multiple light emitting element groups each including multiple light emitting elements; and multiple imaging lenses which are disposed in association with the light emitting element groups, wherein k light emitting elements (k is a natural number which is equal to or larger than 2) are arranged at first pitches Δe along a first direction in each one of the light emitting element groups, and the light emitting element groups are disposed at second pitches Δg along the first direction, each one of the multiple imaging lenses converges light beams from the light emitting elements and forms spots along the first direction on a surface-to-be-scanned which is transported in a second direction, and the absolute value h of the optical magnification of the imaging lenses, the first pitch AΔ and the second pitch Δg are related to each other so as to satisfy the formula below:

$$\Delta g-(k-1)\cdot\Delta e\cdot h<\Delta e\cdot h.$$

2. The line head of claim 1, wherein the absolute value of the optical magnification of the imaging lenses is greater than 1.

3. An image forming apparatus comprising:

a latent image carrier;

multiple light emitting element groups each including multiple light emitting elements; and multiple imaging lenses which are disposed in association with the light emitting element groups, wherein k light emitting elements (k is a natural number which is equal to or larger than 2) are arranged at first pitches Δe along a first direction in each one of the light emitting element groups, and the light emitting element groups are disposed at second pitches Δg along the first direction, each one of the multiple imaging lenses converges light beams from the light emitting elements and forms spots along the first direction on a surface-to-be-scanned which is transported in a second direction, and the absolute value h of the optical magnification of the imaging lenses, the first pitch Δe and the second pitch Δg are related to each other so as to satisfy the formula below:

$$\Delta g-(k-1)\cdot\Delta e\cdot h<\Delta e\cdot h.$$

* * * * *